US007372002B2

(12) United States Patent
Nakamura et al.

(10) Patent No.: US 7,372,002 B2
(45) Date of Patent: May 13, 2008

(54) FLUID HEATING DEVICE AND CLEANING DEVICE USING THE SAME

(75) Inventors: Kazushige Nakamura, Yamatokoriyama (JP); Shigeru Shirai, Yamabe-gun (JP); Yasuhiro Umekage, Ritto (JP); Mitsuyuki Furubayashi, Yamatokoriyama (JP); Koji Oka, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/566,977

(22) PCT Filed: Aug. 3, 2004

(86) PCT No.: PCT/JP2004/011417

§ 371 (c)(1),
(2), (4) Date: Feb. 2, 2006

(87) PCT Pub. No.: WO2005/015092

PCT Pub. Date: Feb. 17, 2005

(65) Prior Publication Data

US 2006/0289455 A1 Dec. 28, 2006

(30) Foreign Application Priority Data

| | | |
|---|---|---|
| Aug. 5, 2003 | (JP) | 2003-286650 |
| Sep. 18, 2003 | (JP) | 2003-325805 |
| Oct. 16, 2003 | (JP) | 2003-356069 |
| Dec. 9, 2003 | (JP) | 2003-410012 |
| May 26, 2004 | (JP) | 2004-155815 |

(51) Int. Cl.
*H05B 1/02* (2006.01)

(52) U.S. Cl. ..... 219/494; 219/497; 219/505; 219/543; 219/553; 392/314; 392/320; 392/465

(58) Field of Classification Search ..... 219/490, 219/491, 494, 497, 501, 505, 535–540; 392/314, 392/320, 465, 488, 491
See application file for complete search history.

(56) References Cited

U.S. PATENT DOCUMENTS 4,501,952 A * 2/1985 Lehrke ..... 392/491

(Continued)

FOREIGN PATENT DOCUMENTS

JP 50-073048 6/1975

(Continued)

OTHER PUBLICATIONS

English Language Abstract of JP 2003-106669.

(Continued)

*Primary Examiner*—Mark Paschall
(74) *Attorney, Agent, or Firm*—Greenblum & Bernstein, P.L.C.

(57) ABSTRACT

A washing water inlet for receiving washing water is provided on an upper surface at one end of a case main body in a fluid heating device, and a washing water outlet for feeding heated washing water to a pump is provided on an upper surface at the other end of the case main body. A linear sheathed heater is arranged so as to penetrate the case main body. A spring is spirally wound around an outer peripheral surface of the sheathed heater. An outer peripheral surface of the sheathed heater, the spring, and an inner peripheral surface of the case main body form a flow path. The flow path is formed in a spiral shape with the length of the case main body used as its axis.

41 Claims, 42 Drawing Sheets

U.S. PATENT DOCUMENTS

| | | | | |
|---|---|---|---|---|
| 5,497,824 | A * | 3/1996 | Rouf | 165/184 |
| 5,797,414 | A * | 8/1998 | Sirovich et al. | 137/13 |
| 2003/0138244 | A1* | 7/2003 | Long et al. | 392/485 |

FOREIGN PATENT DOCUMENTS

| | | |
|---|---|---|
| JP | 58-000040 | 1/1983 |
| JP | 58-062447 | 4/1983 |
| JP | 1-035256 | 7/1983 |
| JP | 59-065337 | 5/1984 |
| JP | 59-096525 | 6/1984 |
| JP | 63-107695 | 7/1988 |
| JP | 1-025238 | 7/1989 |
| JP | 5-161781 | 6/1993 |
| JP | 3033412 | 10/1996 |
| JP | 9-289076 | 11/1997 |
| JP | 10-160249 | 6/1998 |
| JP | 2001-279786 | 10/2001 |
| JP | 2002-322713 | 11/2002 |
| JP | 2003-106669 | 4/2003 |

OTHER PUBLICATIONS

English Language Abstract of JP 2002-322713.
English Language Abstract of JP 10-160249.
English Language Abstract of JP 2001-279786.
English Language Abstract of JP 5-161781.
English Language Partial Translation of JP 1-035256.
English Language Abstract of JP 58-120039.
English Language Abstract and Partial Translation of JP 58-062447.
English Language Partial Translation of JP 1-025238.
English Language Partial Translation of JP 50-073048.
English Language Partial Translation of JP 59-065337.
English Language Partial Translation of JP 59-096525.
English Language Abstract of JP 9-289076.
English Language Partial Translation of JP 63-107695.
English Language Partial Translation of JP 3033412.
English Language Abstract of JP 58-000040.

* cited by examiner

FLUID HEATING DEVICE AND CLEANING DEVICE USING THE SAME

TECHNICAL FIELD

The present invention relates to a fluid heating device that heats a fluid and a washing apparatus using the fluid heating device.

BACKGROUND ART

Conventionally in sanitary washing apparatuses that wash the private parts of the human bodies, there are provided heating devices that heat washing water used for washing to suitable temperatures in order not to give uncomfortable feelings to the human bodies. Examples of the sanitary washing apparatuses comprising such heating devices include hot water storage type sanitary washing apparatuses or instantaneous heating type sanitary washing apparatuses.

The hot water storage type sanitary washing apparatuses comprise hot water tanks previously storing predetermined amounts of washing water as well as heating the washing water to predetermined temperatures by heaters contained therein (see JP 2003-106669 A), and employ methods of feeding by pressure the washing water previously heated to the predetermined temperatures within the hot water tanks by tap water pressure or pumps or the like to spray the washing water from nozzles.

FIG. 39 is a schematic sectional view of a hot water tank unit in a conventional hot water storage type sanitary washing apparatus. The hot water tank unit in the hot water storage type sanitary washing apparatus is disclosed in JP 2002-322713 A.

As shown in FIG. 39, in the hot water tank unit, a thermistor 904 detects the temperature of washing water within a hot water tank 901 through a heat sensitive plate 903. A control circuit 905 instructs a hot water heater 902 provided within the hot water tank 901 to apply heat on the basis of the temperature detected by the thermistor 904.

Washing water previously stored in the hot water tank 901 can be heated and stored by the hot water tank unit. In the hot water tank unit, the temperature of washing water can be transmitted to the thermistor 904 irrespective of the posture of the hot water tank by providing the heat sensitive plate 903 extending from an upper part to a lower part of the hot water tank 901, whereby boil-dry of the hot water tank can be prevented.

In this hot water storage type sanitary washing apparatus, however, washing water within the hot water tank must previously continue to be maintained at a predetermined temperature until the private parts of the human body are washed. Therefore, power must be always supplied to the heating device so that power consumption is increased. When a plurality of persons continuously wash their private parts and previously use washing water whose amount is not less than the amount of the washing water heated to the predetermined temperature within the hot water tank, the temperature of the washing water within the hot water tank is lowered to not more than the predetermined temperature, giving the human bodies uncomfortable feelings.

On the other hand, the instantaneous heating type sanitary washing apparatuses employ methods of instantaneously heating washing water to predetermined temperatures by heating devices superior in temperature rise speed and feeding by pressure washing water utilizing tap water pressures or using pumps or the like to spray the washing water from nozzles when they wash the private parts of the human bodies.

Therefore, power need not be always supplied to the heating device so that power consumption is small. Even when a plurality of persons continuously wash their private parts and previously use washing water whose amount is not less than the amount of the washing water heated to the predetermined temperature within the hot water tank, the temperature of the washing water within the hot water tank is not lowered to not more than the predetermined temperature, not to give the human bodies uncomfortable feelings.

Heating devices having both the respective configurations of the hot water storage type sanitary washing apparatuses and the instantaneous heating devices have been developed. The heating device having both the respective configurations of the hot water storage type sanitary washing apparatus and the instantaneous heating device is disclosed in JP 2003-106669 A.

FIG. 40 is a schematic view of a conventional heating device having both the respective configurations of a hot water storage type sanitary washing apparatus and an instantaneous heating device.

As shown in FIG. 40, washing water is stored in a hot water tank 982 from an introduction port 980. A communication pipe 983 is provided within the hot water tank 980, so that washing water flows to a heating chamber 984 provided within the hot water tank 980 through the communication pipe 983. A cylindrical heater 986 is provided within the heating chamber 984, so that washing water flows to a washing nozzle 987 while being heated by the cylindrical heater 986. Consequently, hot water is sprayed from the washing nozzle 987.

In this heating device, the heating chamber 984 is provided within the hot water tank 980, so that the washing water within the hot water tank 980 is previously heated to a predetermined temperature. The washing water is heated again by the heater 986 before being sprayed from the washing nozzle 987. Thus, power can be reduced, and washing water suitably heated can be sprayed.

However, the heating device is difficult to miniaturize.

A ceramic heater is generally used as the heating device in the sanitary washing apparatus. The ceramic heater is disclosed in JP 10-160249 A.

FIG. 41 is a perspective view showing an example of a conventional ceramic heater.

As shown in FIG. 41, a ceramic heater 952 is provided so as to divide a tank 954 into two parts. The ceramic heater 952 is provided with a plurality of projection plates 953 so that a flow path snaked along the ceramic heater 952 is formed. Thus, it is possible to realize a hot water device having high heat exchange efficiency and superior in control response.

However, the ceramic heater is difficult to miniaturize.

A heating device that can be miniaturized, as compared with the ceramic heater, has been developed. The heating device is disclosed in JP 2001-279786 A.

FIG. 42 is a schematic sectional view of a conventional heating device.

As shown in FIG. 42, the heating device has a double pipe structure comprising a cylindrical base material pipe 961 and an outer cylinder 962. A heater 963 is provided outside the base material pipe 961. A helical core 965 is inserted into the base material pipe 961. Washing water is heated by the heater 963 while flowing between the helical core 965 and the base material pipe 961. As a result, washing water suitably heated by a small-sized heating device can be supplied In the heating device, however, heat from the heater 963 is radiated toward the outside of the base material pipe 961, so that heat exchange efficiency is not high. Since the helical core 965 is provided inside the heater 963, there is such a limitation that the helical core 965 must be formed of a thermally solid material.

In recent years, hot water has been put in a washing tub to do washing even in a clothes washing apparatus. In the conventional clothes washing apparatus, two water supply valves are disposed. One of the water supply valves is connected to a water facet as a water supply-side water supply valve, and the other water supply valve is connected to a water heater as a hot water supply-side water supply valve. In the conventional clothes washing apparatus, there are states where the temperature of hot water greatly varies depending on the capability of the water heater, the water temperature of tap water, and so on, and the temperature of hot water during hot water supply is not stabilized. As a result, when the water pressure is reduced so that the temperature of hot water is too raised, clothes may be damaged by heat. Therefore, a clothes washing apparatus capable of stably supplying hot water having a set temperature even if the temperature of the hot water in a water heater or the temperature of tap water varies is disclosed in JP 5-161781 A.

FIG. 43 is a schematic sectional view of a conventional clothes washing apparatus.

As shown in FIG. 43, the clothes washing apparatus is provided with a tap water-side water supply valve 984 for supplying washing water to a washing tub 981 from a water facet and a hot water supply-side water supply valve 985 for supplying washing water as hot water to the washing tub 981 from a water heater.

The clothes washing apparatus is provided with a thermistor 983 for detecting the water temperature within the washing tub 981, and a heater 982 for adjusting the water temperature within the washing tub 981 is provided below the washing tub 981.

When the temperature of hot water within the washing tub 981 is lower than a desired temperature, therefore, it is possible to adjust the temperature of the hot water by the heater 982 or supply hot water from the hot water supply-side water supply valve 985. When the temperature of hot water within the washing tub 981 is higher than a desired temperature, it is possible to supply water from the tap water-side water supply valve 984. As a result, the water temperature within the washing tub 981 can be changed to a predetermined temperature.

In the clothes washing apparatus, however, it takes a long time to boil water by the heater 982, so that a washing time period is lengthened. As a result, the washing performance of the clothes washing apparatus is reduced.

DISCLOSURE OF INVENTION

An object of the present invention is to provide a fluid heating device that is small in size and has high heat exchange efficiency.

Another object of the present invention is to provide a washing apparatus comprising a fluid heating device that is small in size and has high heat exchange efficiency.

A fluid heating device according to an aspect of the present invention comprises a case member; and a heating element accommodated in the case member, a flow path being formed between an outer surface of the heating element and an inner surface of the case member, and further comprises a turbulent flow generation mechanism that generates turbulent flow in at least a part of the flow path.

In the fluid heating device, a fluid flows in the flow path formed between the outer surface of the heating element and the inner surface of the case member so that the fluid is heated. In this case, the turbulent flow is generated by the turbulent flow generation mechanism in at least a part of the flow path, so that the fluid is agitated. Further, the fluid flows on the outer surface of the heating element, so that heat radiated from the heating element can be all supplied to the fluid. Consequently, the heat from the heating element can be efficiently supplied to the fluid. As a result, it is possible to realize the fluid heating device that can be miniaturized and has high heat exchange efficiency.

The fluid is brought into a turbulent flow state so that adhesion of a scale or the like generated on the surface of the heating element can be reduced, which allows the life of the fluid heating device to be lengthened.

The turbulent flow generation mechanism may be provided in a portion where the speed of a fluid circulated in the flow path is reduced.

In this case, the fluid can be brought into the turbulent flow state in the portion where the speed of the fluid is reduced. As a result, the adhesion of the scale or the like generated on the surface of the heating element can be reduced, which allows the life of the fluid heating device to be lengthened.

The turbulent flow generation mechanism may be provided on the downstream side of the flow path. In this case, the fluid can be brought into the turbulent flow state in a downstream portion where the speed of the fluid is liable to be reduced. Further, no turbulent flow generation mechanism is provided in a portion other than the downstream portion of the flow path, whereby a pressure loss in the flow path can be prevented.

The turbulent flow generation mechanism may be intermittently provided in the flow path. In this case, the turbulent flow generation mechanism is intermittently provided, so that a pressure loss in the flow path can be prevented, as compared with that in a case where the turbulent flow generation mechanism is provided throughout.

The turbulent flow generation mechanism may be provided on the upstream side of the flow path. In this case, the turbulent flow generation mechanism is provided on the upstream side of the flow path, so that a pressure loss in the flow path can be prevented, as compared with that in a case where the turbulent flow generation mechanism is provided throughout.

The heating element may have a stick shape having a circular or elliptical cross section. In this case, the fluid smoothly flows on the outer surface of the heating element, so that the pressure loss can be reduced. Further, the configuration of the heating element is simplified so that it becomes easy to manufacture the fluid heating device.

The turbulent flow generation mechanism may comprise a spiral member wound around an outer peripheral surface of the heating element. In this case, the fluid can form spiral flow along the outer peripheral surface of the heating element by the spiral member.

As a result, the distance the fluid flows becomes longer, as compared with that in a case where the fluid linearly flows along the outer peripheral surface of the heating element, so that the speed of the fluid is increased. Consequently, the heat generated from the heating element can be efficiently absorbed while the fluid is maintaining the turbulent flow state. Further, the fluid enters the turbulent flow state, so that the adhesion of the scale or the like generated on the surface of the heating element can be reduced, which allows the life of the fluid heating device to be lengthened.

The spiral member may be composed of a spiral spring. In this case, the fluid flows in the flow path composed of the spiral spring, so that the spiral spring having elasticity is vibrated. As a result, the adhesion of the scale or the like generated on the surface of the heating element can be reduced, which allows the life of the fluid heating device to be lengthened.

The fluid heating device can be manufactured by inserting the heating element into the spiral spring and covering the heating element with the case member. Consequently, the fluid heating device is easy to manufacture, which makes it feasible to reduce manufacturing cost.

The case member may have a cylindrical fluid inlet and a cylindrical fluid outlet that are provided parallel to the direction in which the spiral member is wound. In this case, the cylindrical fluid inlet and the cylindrical fluid outlet are provided in a direction parallel to the direction in which the spiral member is wound, so that the fluid smoothly flows into the flow path from the cylindrical fluid inlet and smoothly flows out to the cylindrical fluid outlet from the flow path, whereby a pressure loss in the fluid can be prevented.

The case member may have a fluid inlet and a fluid outlet, and at least one of the fluid inlet and the fluid outlet may be provided at a position eccentric from the center axis of the heating element such that a fluid flows in in a direction along the outer peripheral surface of the heating element or flows out in the direction along the outer peripheral surface of the heating element.

In this case, the fluid flowing in from the fluid inlet spirally flows along the outer peripheral surface of the heating element, or the fluid spirally flowing flows into the fluid outlet in the direction along the outer peripheral surface of the heating element. As a result, the pressure loss in the fluid can be prevented. Further, the spiral flow of the fluid can be formed, so that the fluid can efficiently absorb heat generated from the heating element.

The heating element may have a maximum calorific value of not less than approximately 1.5 kW nor more than approximately 2.5 kW. In this case, the water inlet temperatures of the fluid in the summer periods, intermediate periods, and the winter periods can be raised to a predetermined temperature (approximately 40° C.).

The heating element may have such a performance that the maximum gradient of the temperature rise speed of a fluid is not less than approximately 10 K per second.

In this case, the temperature of the fluid can be raised in a short time. Consequently, no overshoot and undershoot appear in temperature control response for the fluid. Further, thermal response of the heating element is fast, so that the heating element is suitable for heating of stable washing water whose variation width is approximately 1° C. As a result, the temperature of washing water can be quickly controlled to one desired by a user.

The heating element may comprise a sheathed heater. In this case, it is possible to manufacture a heating element that is low in cost and is not easily damaged.

The sheathed heater may have a maximum watt density of not less than approximately 30 W/cm$^2$ nor more than 50 W/cm$^2$.

In this case, the temperature of the fluid can be raised in a short time. Consequently, no overshoot and undershoot appear in temperature control response for the fluid. Further, thermal response of the heating element is fast, so that the heating element is suitable for heating of stable washing water whose variation width is approximately 1° C. As a result, the temperature of washing water can be quickly controlled to one desired by a user.

The heating element may comprise a ceramic heater. In this case, the heat capacity is low, so that the watt density need not be increased, which allows the life to be lengthened.

The fluid heating device may further comprise a temperature detector that detects the temperature of the heating element, and a control device that controls the supply of power to the heating element on the basis of the temperature detected by the temperature detector.

In this case, the temperature of the heating element can be changed to a predetermined temperature by the control device, so that the temperature of the fluid that absorbs heat from the heating element can be adjusted to the predetermined temperature, so that a fluid having a stable temperature can be supplied.

The fluid heating device may further comprise a heat sensitive plate having a portion provided so as to come into contact with the heating element and projecting toward the outside of the case member, and the temperature detector may be provided outside the case member and detect the temperature of the heating element through the heat sensitive plate.

In this case, even when it is difficult to mount the temperature detector depending on the shape of the heating element, the temperature detector can be easily mounted through the heat sensitive plate.

The heating element may have a heating portion and a non-heating portion, and the heat sensitive plate may be provided so as to come into contact with the non-heating portion in the heating element.

In this case, the heat generated from the heating element is also transferred to the non-heating portion. The temperature of the heating portion can be presumed from the temperature detected using the temperature detector by providing the non-heating portion with the heat sensitive plate. Further, the heat sensitive plate is not directly mounted on the heating portion, whereby the temperature of the heat sensitive plate can be prevented from being excessively raised and varied.

The case member may have the fluid inlet and the fluid outlet, and the heat sensitive plate may be provided so as to come into contact with the heating element in the vicinity of the fluid outlet of the case member.

In this case, the heat sensitive plate is provided so as to come into contact with the heating element in the vicinity of the fluid outlet, so that the change in temperature of the heat sensitive plate appears more significantly, and the temperature of the fluid flowing out of the fluid heating device can be accurately presumed.

The heat sensitive plate may be joined to the heating element. In this case, it is possible to prevent backlash between the heat sensitive plate and the heating element. As a result, the accurate temperature can be detected by the temperature detector.

The heat sensitive plate may be brazed to the heating element. In this case, it is possible to prevent backlash between the heat sensitive plate and the heating element by the brazing. As a result, the more accurate temperature can be detected by the temperature detector.

The heat sensitive plate may have a leakage preventing function for preventing leakage of a fluid within the case member.

In this case, the heat sensitive plate is also used as the leakage preventing means, whereby it is possible to reduce the manufacturing cost as well as to improve the assembling properties.

The heat sensitive plate may be composed of a metal. In this case, the heat sensitive plate made of a metal is high in thermal conductivity, so that the temperature of the heating element can be quickly and accurately transmitted to the temperature detector.

The heat sensitive plate may be composed of a copper plate. In this case, copper has particularly superior thermal conductivity and long-term usable corrosion resistance, so that the temperature of the heating element can be quickly and accurately transmitted to the temperature detector over a long time period.

The heat sensitive plate may be formed in a substantially L shape. In this case, a portion that greatly projects from the outer shape of the fluid heating device is not formed, whereby it is feasible to miniaturize the fluid heating device.

The fluid heating device may further comprise a heat transfer member having a portion provided so as to come into contact with the fluid in the flow path and projecting toward the outside of the case member, and an electronic component provided in a portion of the heat transfer member projecting toward the outside of the heat transfer member.

In this case, heat generated from the electronic component is supplied to the fluid through the heat transfer member, whereby the water cooling effect of the electronic component can be ensured.

The case member may have the fluid inlet and the fluid outlet, and the heat transfer member may be provided so as to come into contact with the fluid in the vicinity of the fluid inlet of the case member.

In this case, the heat transfer member is brought into contact with the fluid that has not been heated by the heating element in the vicinity of the fluid inlet, whereby the water cooling effect of the electronic component can be further ensured through the heat transfer member. Further, the temperature of the fluid can be raised in the vicinity of the fluid inlet.

The heat transfer member may have a leakage preventing function for preventing leakage of a fluid within the case member.

In this case, the heat transfer member is also used as leakage preventing means, whereby it is possible to reduce the manufacturing cost as well as to improve the assembling properties.

The heat transfer member may be composed of a metal. In this case, the heat transfer member made of a metal is high in thermal conductivity, so that the temperature of the heating element can be quickly and accurately transmitted to the temperature detector.

The heat transfer member may be composed of a copper plate. In this case, copper has particularly superior thermal conductivity and long-term usable corrosion resistance, so that the temperature of the heating element can be quickly and accurately transmitted to the temperature detector over a long time period.

The heat transfer member may be formed in a substantially L shape. In this case, the portion that greatly projects from the outer shape of the fluid heating device is not formed, whereby it is feasible to miniaturize the fluid heating device.

The case member may comprise a plurality of case member parts, the heating element may comprise a plurality of heating element parts respectively accommodated in the plurality of case member parts, a flow path may be formed between an inner surface of each of the case member parts and an outer surface of each of the heating element parts, and the turbulent flow generation mechanism may further comprise a plurality of turbulent flow generation mechanism parts for generating turbulent flow in at least a part of each of the plurality of flow paths.

In this case, the plurality of heating element parts are provided, so that the maximum calorific value of the fluid heating device can be raised. As a result, the flow rate at a predetermined temperature can be ensured depending on a user's taste or a use environment.

Each of the plurality of case member parts may have a fluid inlet and a fluid outlet, and the fluid outlet of one of the case member parts may be formed such that it can be fitted in the fluid inlet of the other case member part.

In this case, the fluid outlet of the one case member part and the fluid inlet of the other case member part can be fitted in each other, whereby the plurality of case member parts can be connected to one another without using a new member.

Each of the plurality of case member parts may have a fluid inlet and a fluid outlet, and the fluid heating device may further comprise a connection member for connecting the fluid outlet of one of the case member parts and the fluid inlet of the other case member part.

In this case, the fluid flowing out of the fluid outlet of the one case member part can be supplied to the fluid inlet of the other case member part by the connection member. As a result, the plurality of case member parts can be connected to one another.

The plurality of case member parts may have the same shape. In this case, it is possible to reduce the manufacturing cost.

A washing apparatus according to another aspect of the present invention is a washing apparatus that sprays a fluid supplied from a water supply source to a portion to be washed of the human body, comprising a fluid heating device that heats the fluid supplied from the water supply source while causing the fluid to flow; and a spray device that sprays the fluid heated by the fluid heating device to the human body, the fluid heating device further comprising a case member, and a heating element accommodated in the case member, a flow path being formed between an outer surface of the heating element and an inner surface of the case member, and further comprising a turbulent flow generation mechanism that generates turbulent flow in at least a part of the flow path.

In this washing apparatus, the washing water heated in the fluid heating device can be sprayed to the human body from the spray device.

In the fluid heating device, the fluid flows in the flow path formed between the outer surface of the heating element and the inner surface of the case member so that the fluid is heated. In this case, the turbulent flow is generated by the turbulent flow generation mechanism in at least a part of the flow path, so that the fluid is agitated.

Further, the fluid flows on the outer surface of the heating element, so that heat radiated from the heating element can be all supplied to the fluid. Consequently, the heat from the heating element can be efficiently supplied to the fluid. As a result, it is possible to realize a washing apparatus using the fluid heating device that can be miniaturized and has high heat exchange efficiency. Consequently, washing water having a temperature that is comfortable for the human body can be sprayed.

A washing apparatus according to still another aspect of the present invention is a washing apparatus that washes clothes using a fluid supplied from a water supply source, comprising a washing tub; a fluid heating device that heats the fluid supplied from the water supply source while causing the fluid to flow; and a supply device that supplies to the washing tub the fluid heated by the fluid heating device, the fluid heating device comprising a case member, and a heating element accommodated in the case member, a flow path being formed between an outer surface of the heating element and an inner surface of the case member, and further comprising a turbulent flow generation mechanism that generates turbulent flow in at least a part of the flow path.

In the washing apparatus, the fluid heated by the fluid heating device is supplied to the washing tub, so that washing is done.

In this fluid heating device, the fluid flows in the flow path formed between the outer surface of the heating element and the inner surface of the case member, so that the fluid is heated. In this case, the turbulent flow is generated by the turbulent flow generation mechanism in at least a part of the flow path, so that the fluid is agitated. Further, the fluid flows on the outer surface of the heating element, so that heat radiated from the heating element can be all supplied to the fluid. Consequently, the heat from the heating element can be efficiently supplied to the fluid.

As a result, it is possible to realize the washing apparatus using the fluid heating device that can be miniaturized and has high heat exchange efficiency. Consequently, dirt on laundry can be efficiently washed away. Consequently, it is possible to do washing that takes a short time and is high in washing performance.

According to the present invention, the fluid can be heated by the fluid heating device that can be miniaturized and has high heat exchange efficiency, and the fluid heating device can be utilized for washing of objects to be washed using the heated fluid, for example.

BEST MODE FOR CARRYING OUT THE INVENTION

Figure 1:
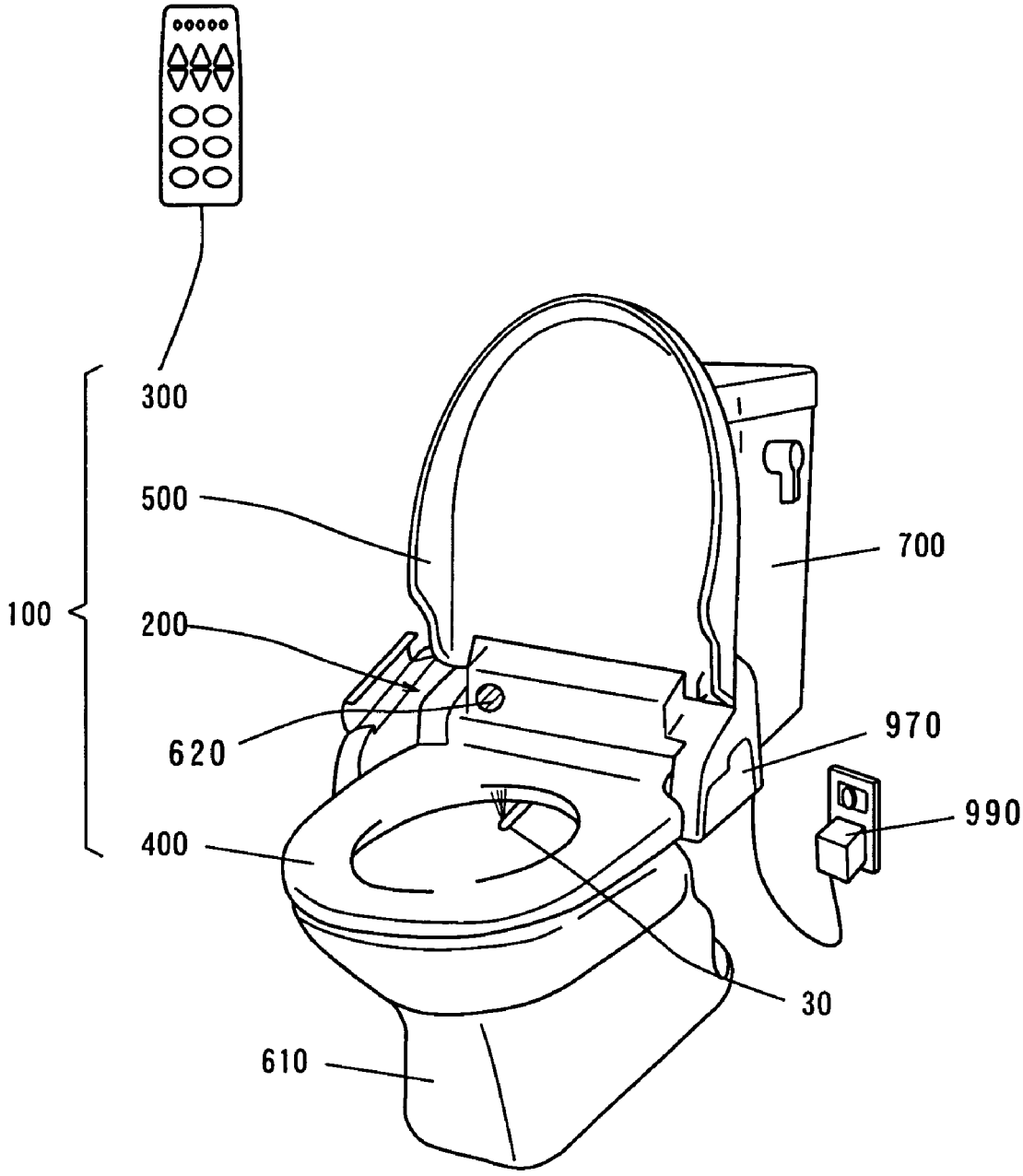
FIG. 1 is a perspective view showing a state where a sanitary washing apparatus according to a first embodiment is mounted on a toilet bowl.

A sanitary washing apparatus comprising a fluid heating device according to an embodiment of the present invention will be described while referring to the drawings, and a clothes washing apparatus comprising the fluid heating device according to the embodiment of the present invention will be then described while referring to the drawings.

First Embodiment

A sanitary washing apparatus comprising a fluid heating device according to a first embodiment of the present invention will be described.

FIG. 1 is a perspective view showing a state where a sanitary washing apparatus according to a first embodiment is mounted on a toilet bowl.

As shown in FIG. 1, a sanitary washing apparatus 100 is mounted on a toilet bowl 610. A tank 700 is connected to a tap water pipe, and supplies washing water to the toilet bowl 610.

The sanitary washing apparatus 100 comprises a main body 200, a remote control device 300, a toilet seat 400, and a cover 500. Predetermined power is supplied by a power supply port 990 to the sanitary washing apparatus 100.

The toilet seat 400 and the cover 500 are mounted on the main body 200 so as to be capable of being opened or closed. The main body 200 comprises a seating detection device 620. Further, a fluid heating unit insertion port 970 is provided on a side surface of the main body 200. The seating detection device 620 and the fluid heating unit insertion port 970 will be described later.

The main body 200 is provided with a washing water supply mechanism including a nozzle unit 30, and contains a controller. The controller in the main body 200 controls the washing water supply mechanism on the basis of a signal transmitted by the remote control device 300, as described later. Further, the controller in the main body 200 also controls a heater contained in the toilet seat 400, and a deodorizing device (not shown) and a warm air supply device (not shown) that are provided in the main body 200, and so on.

Figure 2:
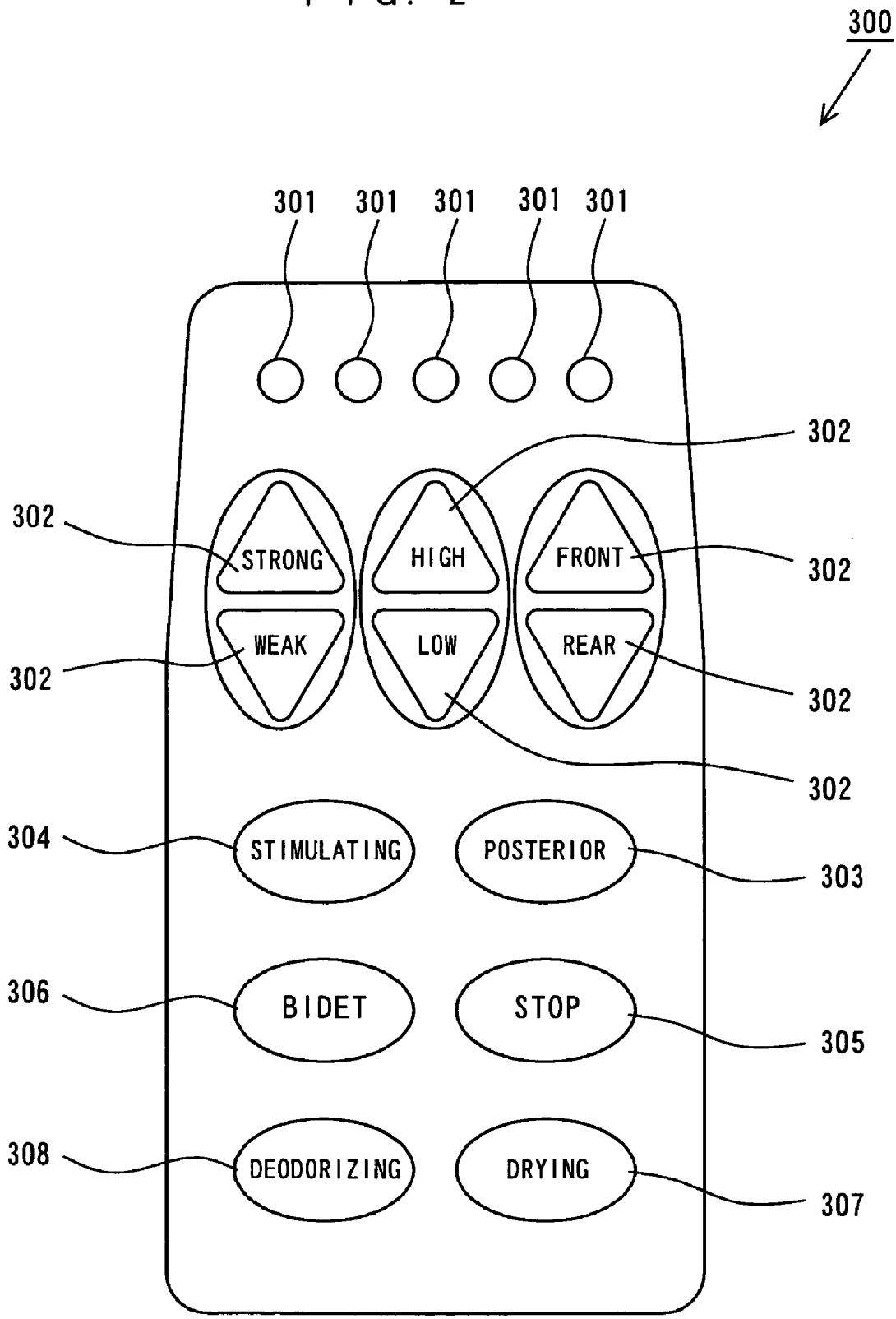
FIG. 2 is a schematic view showing an example of a remote control device shown in FIG. 1.

FIG. 2 is a schematic view showing an example of the remote control device shown in FIG. 1.

As shown in FIG. 2, the remote control device 300 comprises a plurality of LEDs (Light Emitting Diodes) 301, a plurality of adjustment switches 302, a posterior switch 303, a stimulation switch 304, a stop switch 305, a bidet switch 306, a drying switch 307, and a deodorizing switch 308.

A user presses the adjustment switch 302, the posterior switch 303, the stimulation switch 304, the stop switch 305, the bidet switch 306, the drying switch 307, and the deodorizing switch 308. Consequently, the remote control device 300 transmits by radio a predetermined signal to the controller provided in the main body 200 in the sanitary washing apparatus 100, described later. The controller in the main body 200 receives the predetermined signal transmitted by radio from the remote control device 300, and controls a washing water supply mechanism or the like.

The nozzle unit 30 in the main body 200 shown in FIG. 1 moves so that the washing water is sprayed by the user pressing the posterior switch 303 or the bidet switch 306, for example. The washing water for stimulating the private parts of the human body is sprayed from the nozzle unit 30 in the main body 200 shown in FIG. 1 by pressing the stimulation switch 304. The spray of the washing water from the nozzle unit 30 is stopped by pressing the stop switch 305.

Warm air is blown by a warm air supply device (not shown) in the sanitary washing apparatus 100 on the private parts of the human body by pressing the drying switch 307. A deodorizing device (not shown) in the sanitary washing apparatus 100 removes an odor from its surroundings by pressing the deodorizing switch 308.

By the user pressing the adjustment switch 302, the position of the nozzle unit 30 in the main body 200 in the sanitary washing apparatus 100 shown in FIG. 1 is changed, the temperature of the washing water sprayed from the nozzle unit 30 is changed, and the pressure of the washing water sprayed from the nozzle unit 30 is changed. The plurality of LEDs (Light Emitting Diodes) 301 light up as the adjustment switch 302 is pressed.

Figure 3:
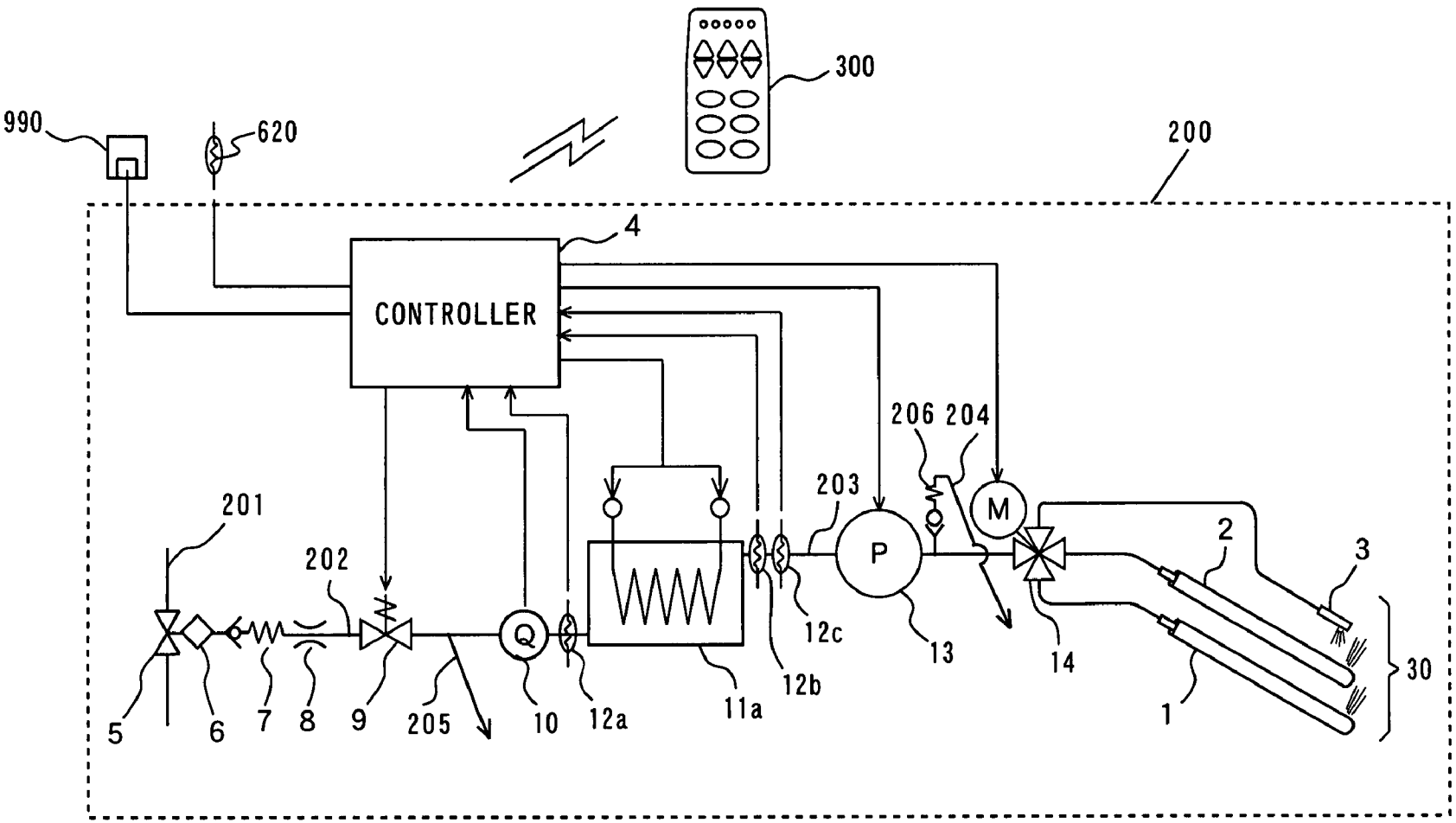
FIG. 3 is a schematic view showing the configuration of a main body in the sanitary washing apparatus according to the first embodiment.

The main body 200 in the sanitary washing apparatus 100 according to the first embodiment will be described. FIG. 3 is a schematic view showing the configuration of the main body 200 in the sanitary washing apparatus 100 according to the first embodiment.

The main body 200 shown in FIG. 3 comprises a controller 4, a branched water faucet 5, a strainer 6, a check valve 7, a constant flow valve 8, a stop solenoid valve 9, a flow sensor 10, a fluid heating device 11*a*, a temperature sensor 12*a*, a temperature sensor 12*b*, a temperature fuse 12*c*, a pump 13, a switching valve 14, and a nozzle unit 30. Further, the nozzle unit 30 comprises a posterior nozzle 1, a bidet nozzle 2, and a nozzle cleaning nozzle 3.

As shown in FIG. 3, the branched water faucet 5 is inserted into a tap water pipe 201. The strainer 6, the check valve 7, the constant flow valve 8, the stop solenoid valve 9, the flow sensor 10, and the temperature sensor 12*a* are inserted in this order into a pipe 202 connected between the branched water faucet 5 and the fluid heating device 11*a*. Further, the temperature sensor 12*b* and the pump 13 are inserted into a pipe 203 connected between the fluid heating device 11*a* and the switching valve 14.

Clear water flowing through the tap water pipe 201 is first supplied as washing water to the strainer 6 by the branched water faucet 5. The strainer 6 removes dirt, impurities, etc. included in the washing water. The check valve 7 then prevents the washing water in the pipe 202 from flowing backward. The constant flow valve 8 keeps the flow rate of the washing water flowing in the pipe 202 constant.

A relief pipe 204 is connected between the pump 13 and the switching valve 14, and a relief water pipe 205 is connected between the stop solenoid valve 9 and the flow sensor 10. A relief valve 206 is inserted into the relief pipe 204. The relief valve 206 is opened when pressure, particularly on the downstream side of the pump 13, in the pipe 203 exceeds a predetermined value, to prevent problems such as damage to equipment at the abnormal time and disconnection of a hose. On the other hand, washing water, which is not sucked in by the pump 13, in washing water supplied after the flow rate thereof is adjusted by the constant flow valve 8 is discharged from the relief water pipe 205. Consequently, predetermined back pressure is exerted on the pump 13 without being dependent on tapped water supply pressure.

The flow sensor 10 then measures the flow rate of washing water flowing in the pipe 202, to give a measured flow rate value to the controller 4. The temperature sensor 12*a* measures the temperature of the washing water flowing in the pipe 202, to give a measured temperature value to the controller 4.

The fluid heating device 11*a* then heats washing water supplied through the pipe 202 to a predetermined temperature on the basis of a control signal fed by the controller 4. The temperature sensor 12*b* measures the temperature of the washing water heated to the predetermined temperature by the fluid heating device 11*a*, to feed a temperature excess signal to the controller 4 when the temperature of the washing water exceeds the predetermined temperature. In this case, the controller 4 cuts off the supply of power to the fluid heating device 11*a*.

The temperature fuse 12*c* detects the temperature of the fluid heating device 11*a*, and cuts off the supply of power to the fluid heating device 11*a* when the temperature exceeds the predetermined temperature.

The pump 13 feeds by pressure the washing water heated by the fluid heating device 11*a* to the switching valve 14 on the basis of the control signal fed by the controller 4. The switching valve 14 supplies washing water to any one of the posterior nozzle 1, the bidet nozzle 2, and the nozzle cleaning nozzle 3 in the nozzle unit 30 on the basis of the control signal fed by the controller 4. Thus, the washing water is sprayed from any one of the posterior nozzle 1, the bidet nozzle 2, and the nozzle cleaning nozzle 3.

The controller 4 determines that the human body is seated on the toilet seat 400 when a signal from the seating detection device 620 is turned on, and feeds the control signal to the stop solenoid valve 9, the fluid heating device 11*a*, the pump 13, and the switching valve 14 on the basis of the signal transmitted by radio from the remote control device 300 shown in FIG. 1, the measured flow rate value given from the flow sensor 10, the measured temperature value given from the temperature sensor 12*a*, and the temperature excess signal fed from the temperature sensor 12*b*. The controller 4 determines that the human body is not seated on the toilet seat 400 when the signal from the seating detection device 620 is turned off, and nullifies the signal transmitted by radio from the remove control device 300 shown in FIG. 1.

Predetermined power is supplied from a power supply port 990 to the controller 4. The power supplied by the controller 4 is supplied to the fluid heating device 11*a*, the pump 13, the switching valve 14, and so on.

Figure 4:
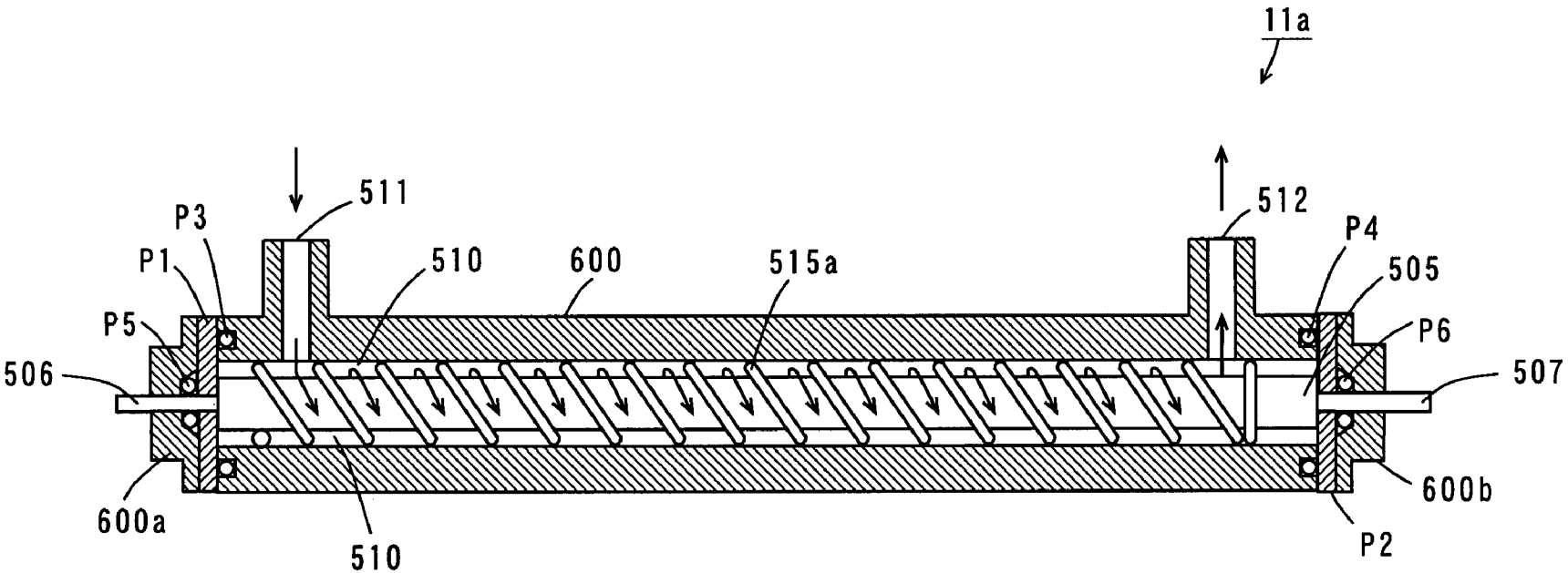
FIG. 4 is a schematic sectional view for explaining the internal configuration of a fluid heating device.

Then, FIG. 4 is a schematic sectional view for explaining the internal configuration of the fluid heating device 11*a*.

As shown in FIG. 4, the fluid heating device 11*a* mainly comprises a case main body 600 in a rectangular parallelepiped shape, a sheathed heater 505, a spring 515*a*, elastic holding members P1 and P2, and end surface holding members 600*a* and 600*b*.

A washing water inlet 511 for receiving washing water supplied from the pipe 202 (see FIG. 3) is provided on an upper surface at one end of the case main body 600 in the fluid heating device 11*a*, and a washing water outlet 512 for feeding heated washing water to the pump 13 (see FIG. 3) is provided on an upper surface at the other end of the case main body 600.

A linear sheathed heater 505 is arranged so as to penetrate the case main body 600. The spring 515*a* composed of copper is spirally wound around an outer peripheral surface of the sheathed heater 505.

The outer peripheral surface of the sheathed heater 505, the spring 515*a*, and an inner peripheral surface of the case main body 600 form a flow path 510. The flow path 510 is formed in a spiral shape with the length of the case main body 600 used as its axis. The cross-sectional area of the flow path 510 is determined by the outer peripheral surface of the sheathed heater 505, the spring 515*a*, and the inner peripheral surface of the case main body 600.

The end surface holding members 600*a* and 600*b* are respectively mounted on both end surfaces of the case main body 600 through the elastic holding member P1 and P2. Thus, respective clearances between openings at both the ends of the case main body 600 and the sheathed heater 505, described later, are closed.

Furthermore, O rings P3 and P4 are respectively provided between both the end surfaces of the case main body 600 and the elastic holding members P1 and P2, and O rings P5 and P6 are respectively provided between the end surface holding members 600*a* and 600*b* and the elastic holding members P1 and P2. Consequently, washing water is prevented from flowing out of respective joints between both the end surfaces of the case main body 600 and the end surface holding members 600*a* and 600*b* and respective areas between terminals 506 and 507 and the end surface holding members 600*a* and 600*b*. Further, the elastic holding members P1 and P2 are also used as the function of holding the sheathed heater 505.

In a case where the fluid heating device 11*a* is used for the sanitary washing apparatus 100, the flow rate of washing water to be heated by the fluid heating device 11*a* is approximately 100 mL to 2000 mL per minute. The flow rate of washing water at which a user can obtain a sufficient cleaning feeling is not less than approximately 1000 mL per minute.

When an attempt to ensure a flow rate of not less than 1000 mL per minute is made, the outer diameter of the sheathed heater 505 is approximately 3 mm to 20 mm, the inner diameter of the case main body 600 is approximately 5 mm to 30 mm, and the pitch of the spring 515*a* spirally wound around the outer peripheral surface of the sheathed heater 505 is approximately 3 mm to 20 mm.

It is preferable that the line diameter of the spring 515*a* is approximately 0.1 mm to 3 mm in terms of processibility. The spring 515*a* may not be completely fixed to the sheathed heater 505 but fixed at its one end. In this case, a part of the spring 515*a* is slidable, so that the spring 515*a* is vibrated by the pressure of washing water and the elastic force of the spring 515*a*. The vibration can prevent adhesion of a scale. Although the pitch of the spring 515*a* is made constant, the present invention is not limited to the same. For example, the pitch may be partially widened or narrowed. Thus, the turbulent flow state of washing water, described later, can be more efficiently generated.

The spring 515*a* used in the fluid heating device may be replaced with a spring made of another metal or a spiral metal line having no elasticity, spiral resin, and so on.

Figure 5:
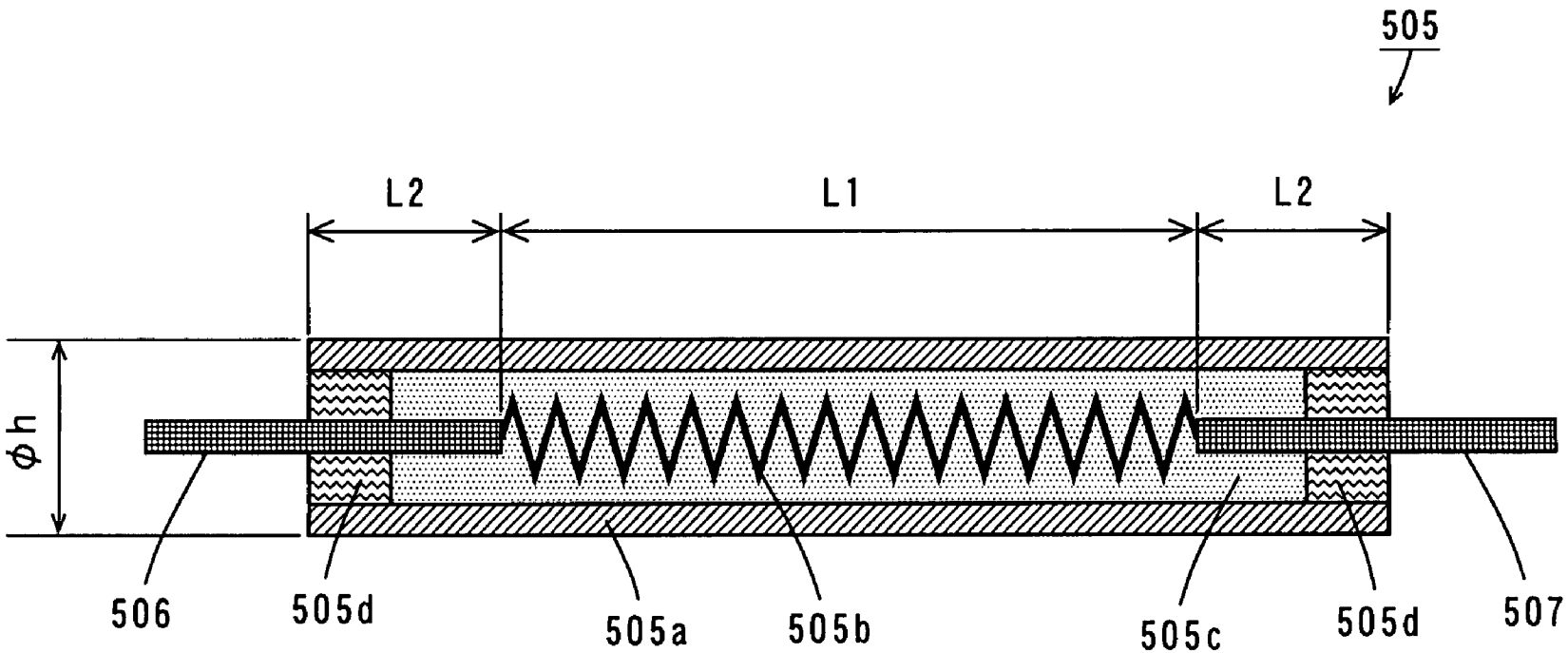
FIG. 5 is a schematic sectional view showing the internal configuration of a sheathed heater.

Then, FIG. 5 is a schematic sectional view showing the internal configuration of the sheathed heater 505.

As shown in FIG. 5, the sheathed heater 505 is mainly formed of a sheathed pipe 505*a*, a heater wire 505*b*, insulating powder 505*c*, a sealant 505*d*, and terminals 506 and 507.

As shown in FIG. 5, the heater wire 505*b* is wound spirally (in a coil shape). The terminals 506 and 507 are respectively mounted on both ends of the wound heater wire 505*b*. The terminals 506 and 507 and the heater wire 505*b* are inserted into the sheathed pipe 505*a*. The sheathed pipe 505*a* is filled with the insulating powder 505*c* such that the terminals 506 and 507 and the heater wire 505*b* are not brought into direct contact with the sheathed pipe 505*a*. Consequently, the terminal 506 and the terminal 507 are electrically insulated from each other.

A front end of the terminal 506 projects from one end of the sheathed pipe 505*a*, and a front end of the terminal 507 projects from the other end of the sheathed pipe 505*a*. Further, the one end and the other end of the sheathed pipe 505*a* are sealed with the sealant 505*d*.

Used as the sheathed pipe 505*a* is copper, SUS (stainless steel), or another metal having a high coefficient of thermal conductivity, for example. Used as the insulating powder 505*c* is a magnesium oxide having a high insulation effect, for example.

In a heater effective length L1 shown in FIG. 5, the heater wire 505*b* is spirally wound, so that the length of the heater wire 505*b* can be made larger than that in a case where the heater wire 505*n* is linearly provided. In a case where power is applied to the terminals 506 and 507, therefore, a large amount of heat can be generated from the heater wire 505*b*. As a result, heat is efficiently generated from the sheathed heater 505 in the heater effective length L1 of the sheathed heater 505.

On the other hand, in a non-heating portion L2 shown in FIG. 5, the respective resistances of the terminals 506 and 507 are low so that no heat is generated. The outer diameter ϕh of the sheathed pipe 505*a* in the sheathed heater 505 shown in FIG. 5 will be described later.

Figure 6:
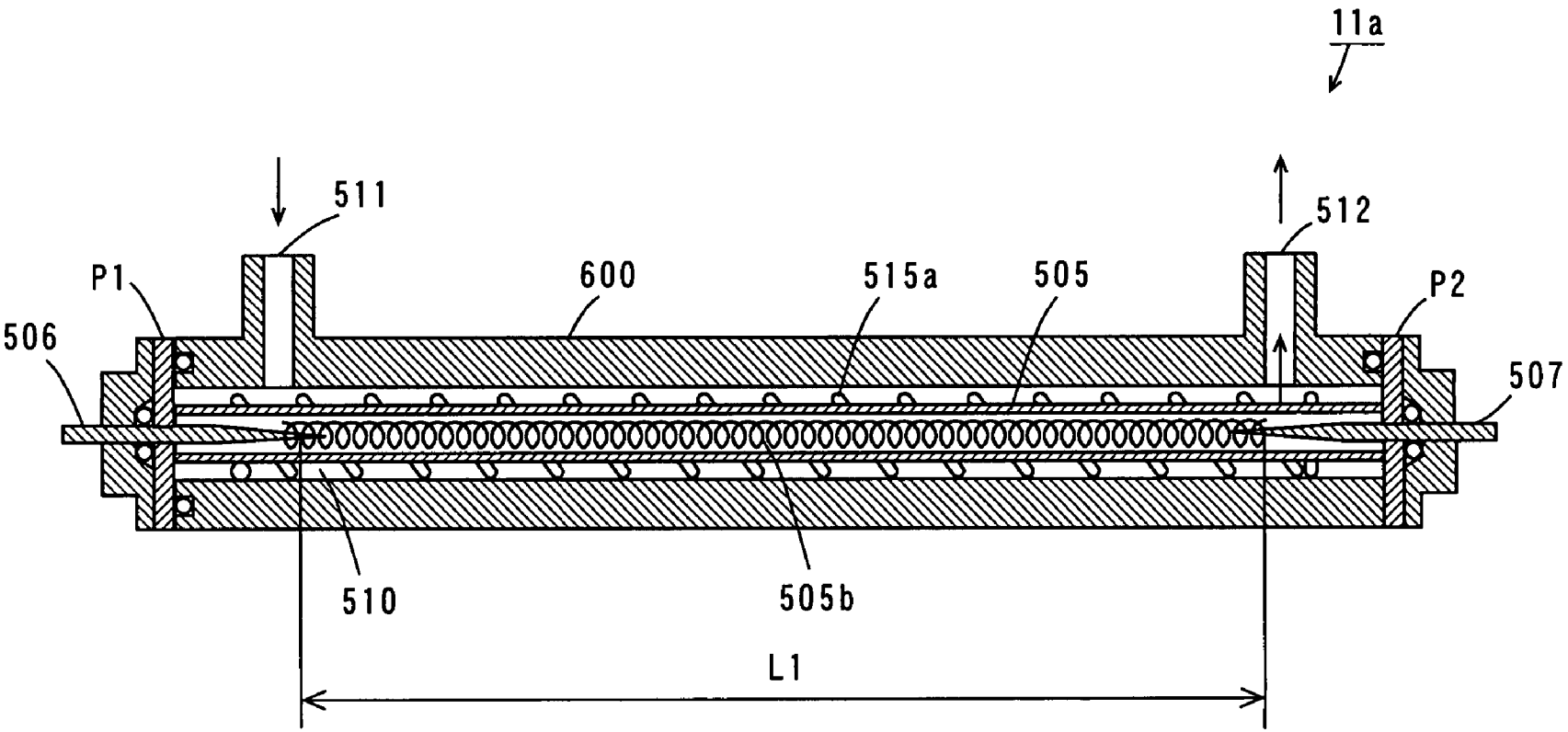
FIG. 6 is a cross-sectional view showing the internal configuration of the sheathed heater in the fluid heating device shown in FIG. 4.

Then, FIG. 6 is a cross-sectional view showing the internal configuration of the sheathed heater 505 in the fluid heating device 11*a* shown in FIG. 4.

As shown in FIG. 6, the heater effective length L1 of the sheathed heater 505 is smaller than a length from the washing water inlet 511 to the washing water outlet 512 in the case main body 600.

Thus, a heat generator is prevented from being positioned in respective water stay portions at both ends of the case main body 600.

The non-heating portion L2 in the sheathed heater 505 is held so as to be axially movable by the elastic holding members P1 and P2. Consequently, the non-heating portion L2 in the sheathed heater 505 does not reach a high temperature. As a result, the elastic holding members P1 and P2 are not melted.

A state where the non-heating portion L2 is held so as to be axially movable is a state where the sheathed heater 505 is held so as to be axially movable by the respective deflections of the elastic holding members P1 and P2 composed of rubber, for example.

Figure 7:
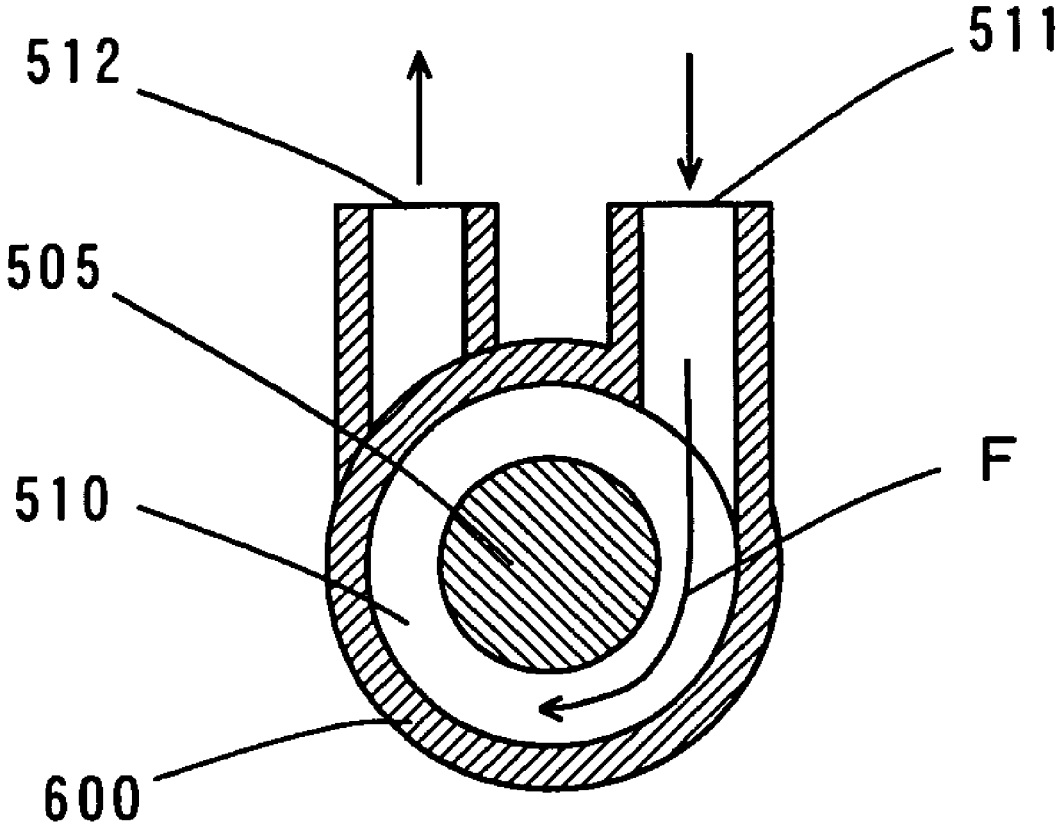
FIG. 7 is a cross-sectional view showing the fluid heating device shown in FIG. 4.

Then, FIG. 7 is a cross-sectional view of the fluid heating device 11*a* shown in FIG. 4. In FIG. 7, the illustration of the spring 515*a* is omitted.

As shown in FIG. 7, the washing water inlet 511 in the case main body 600 is provided at a position eccentric from the center, which is substantially circular in cross section, of the inner peripheral surface of the case main body 600. Therefore, washing water flows as in a circumferential direction F along the inner peripheral surface of the case main body 600 and the outer peripheral surface of the sheathed heater 505*a*. The direction of the flow in the circumferential direction F is the same as the direction of flow in the flow path 510 formed in a spiral shape. Since the flow path 510 is formed in a small cross-sectional area along the outer peripheral surface of the sheathed heater 505, the speed of washing water flowing in the flow path 510 formed in a spiral shape is made higher, as compared with the speed of washing water linearly flowing along the sheathed heater 505 from the washing water inlet 511 to the washing water outlet 512.

Consequently, washing water flows along the outer peripheral surface of the sheathed heater 505 in the flow path 510, so that heat generated from the sheathed heater 505 is efficiently transferred to the washing water.

As shown in FIG. 7, the washing water outlet 512 in the case main body 600 is provided at a position eccentric from the center, which is substantially circular in cross section, of the inner peripheral surface of the case main body 600. Consequently, washing water circulated in the flow path 510 formed in a spiral shape can be supplied to the pump 13 shown in FIG. 3 from the washing water outlet 512 without being damped.

Here, the flow path 510 will be described in detail. As described above, the flow path 510 is formed by the outer peripheral surface of the sheathed heater 505, the spring 515*a*, and the inner peripheral surface of the case main body 600.

The cross-sectional area of the flow path 510 in the direction of the flow is small. Consequently, the flow of washing water within the flow path 510 becomes fast, as described above, so that the washing water is brought into a turbulent flow state and agitated. As a result, the washing water can efficiently absorb heat from the sheathed heater 505.

Turbulent flow is used in the sense that such turbulence that the direction of flow of washing water is changed, such turbulence that the speed of flow of washing water is changed, and so on are generically referred to. Further, turbulent flow may be generated using a member other than a spring. For example, wing-shaped members that disturb the flow of washing water and various guiding members that disturb the flow of washing water may be used.

The length of the flow path 510 becomes larger than the length of a straight line from the washing water inlet 511 to the washing water outlet 512 by forming the flow path 510 in a spiral shape. When the flow path is merely lengthened in a linear manner, a rectification effect is produced in washing water flowing in the flow path so that the flow of the washing water is liable to be laminar flow. Since the flow path 510 is formed in a spiral shape, however, flow, which is deflected not linearly but constantly, of the washing water flowing in the flow path 510 is formed, so that flow in a turbulent flow state can be constantly continued. As a result, a pressure loss of the washing water can be reduced.

Figure 8:
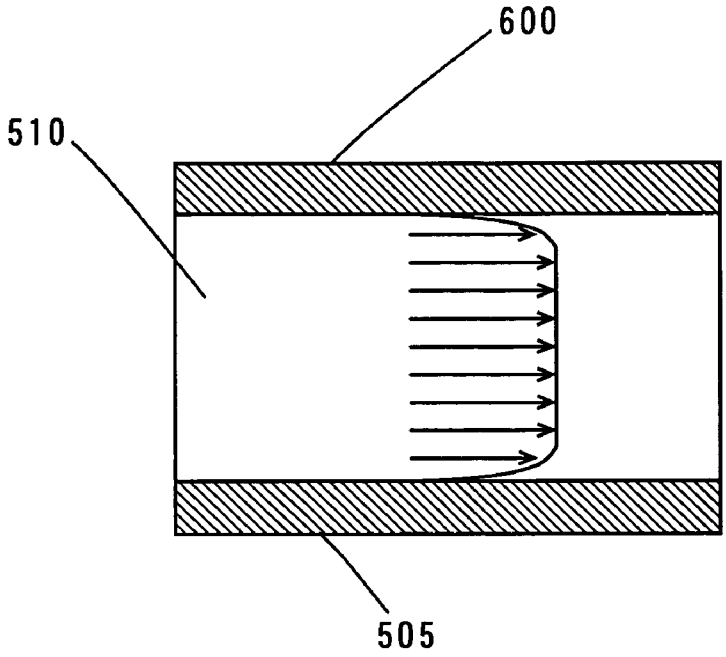
FIG. 8 is a diagram showing the flow velocity distribution of washing water flowing in a flow path.
Figure 9:
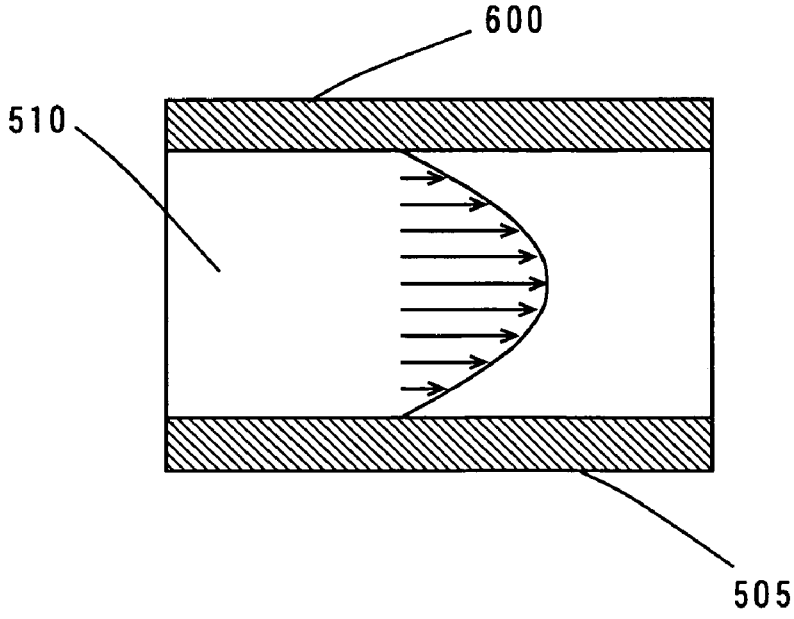
FIG. 9 is a diagram showing the flow velocity distribution of washing water flowing in a flow path.

Then, FIGS. 8 and 9 are diagrams of the flow velocity distributions of washing water flowing in the flow path 510. FIG. 8 shows a case where the flow of washing water is slow, and FIG. 9 shows a case where the flow of washing water is fast.

Generally, a scale is generated when the temperature of washing water is increased on a boundary layer between the sheathed heater 505 and water in cases such as a case where the surface temperature of the sheathed heater 505 is raised and a case where washing water flowing on the surface of the sheathed heater 505 stays.

As shown in FIG. 8, in a case where the flow of washing water within the flow path 510 surrounded by the case main body 600 and the sheathed heater 505 is slow, the boundary surface between washing water and the sheathed heater 505 is increased, and heat generated from the sheathed heater 505 cannot be efficiently delivered into the washing water, so that the surface temperature of the sheathed heater 505 is raised. As a result, a scale is generated on the surface of the sheathed heater 505.

On the other hand, as shown in FIG. 9, in a case where the flow of washing water within the flow path 510 surrounded by the case main body 600 and the sheathed heater 505 is fast, the boundary surface between the washing water and the sheathed heater 505 is reduced, and heat generated from the sheathed heater 505 cannot be efficiently delivered into the washing water, so that the surface temperature of the sheathed heater 505 is not excessively raised. As a result, a scale adhering to the surface of the sheathed heater 505 can be prevented from being generated.

In a case where the flow of washing water within the flow path 510 is fast, even if the scale is generated, the scale is caused to flow downward. Therefore, the scale generated at one point can be prevented from being fastened to grow to a large scale. Further, the scale itself can be ground by turbulent flow of the washing water. As a result, the scale can be prevented from being generated within the fluid heating device 11*a*, so that the life of the fluid heating device 11*a* itself can be lengthened.

Figure 10:
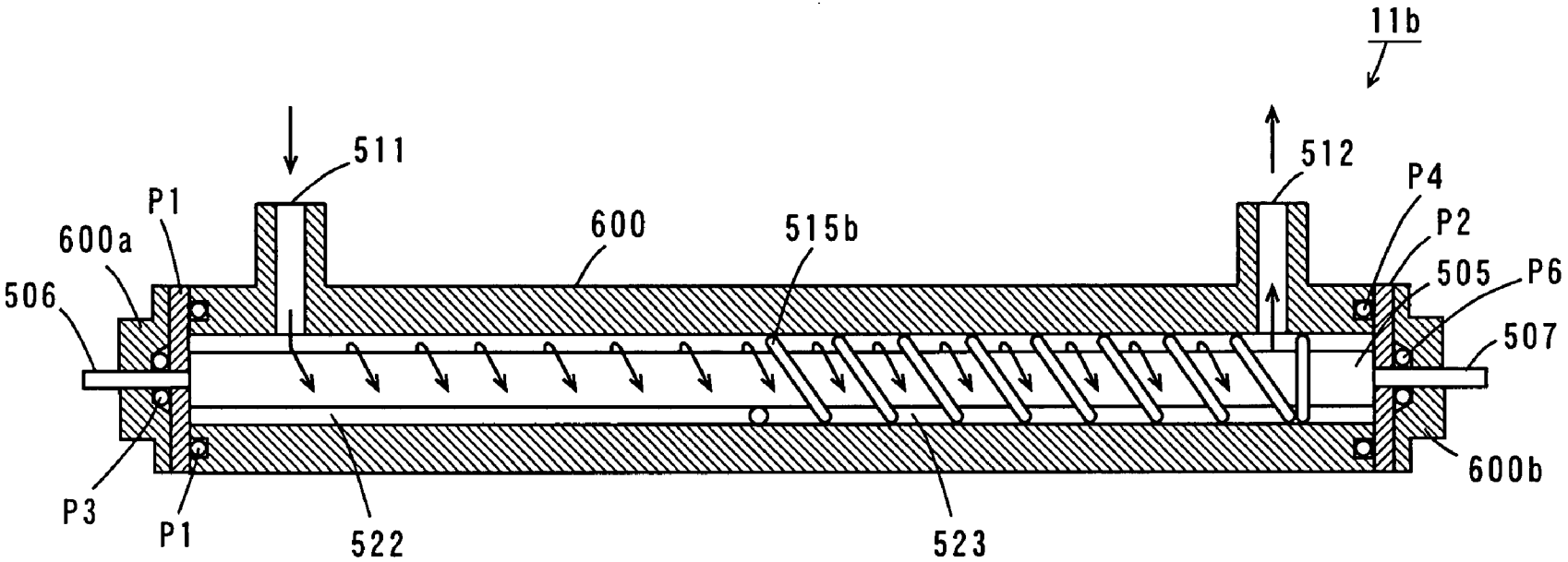
FIG. 10 is a cross-sectional view showing another example of the fluid heating device.

Then, FIG. 10 is a cross-sectional view showing another example of the fluid heating device.

A fluid heating device 11*b* shown in FIG. 10 has a spring 515*b* in place of the spring 515*a* in the fluid heating device 11*a* shown in FIG. 4, and has flow paths 522 and 523 formed therein in place of the flow path 510.

A spring 515*b* is provided in the vicinity of a washing water outlet 512 in a case main body 600. The length of the spring 515*b* is not more than the half of the length of the spring 515*a*.

In this case, washing water supplied to a washing water inlet 511 provided eccentrically from the case main body 600 flows in a spiral shape in the flow path 522 along an outer peripheral surface of a sheathed heater 505. The spiral flow is damped in the vicinity of the center between the washing water inlet 511 and the washing water outlet 512. In a case where the spiral flow is damped in the vicinity of the center of the case main body 600, the flow of washing water is only flow along the length of the fluid heating device 11*b*.

In this case, spiral flow is generated by the outer peripheral surface of the sheathed heater 505 and the spiral flow path 523 formed of the spring 515*b* toward the downstream side from the vicinity of the center of the case main body 600. Consequently, the washing water enters a turbulence state again.

Even if the spiral flow is thus weakened in the vicinity of the center of the case main body 600, the spiral flow path 523 is formed of the spring 515*b*, so that the turbulent flow of washing water is generated again, and the flow of the washing water in the flow path 523 becomes fast. In this case, even in an environment in which the temperature of washing water is raised toward the downstream side from the vicinity of the center of the case main body 600 so that the generation of a scale is increased, the turbulent flow can be generated while making the flow of the washing water fast, whereby the scale can be prevented from being generated.

Since the spring 515*b* is provided toward the downstream side from the vicinity of the center of the case main body 600, the cross-sectional area of the flow path 522 is not made smaller by the spring 515*b* on the upstream side of the case main body 600, as compared with that in a case where the whole of the case main body 600 is provided with the spring 515*a* (see FIG. 4). Consequently, a pressure loss of washing water on the upstream side of the case main body 600 is reduced.

Figure 11:
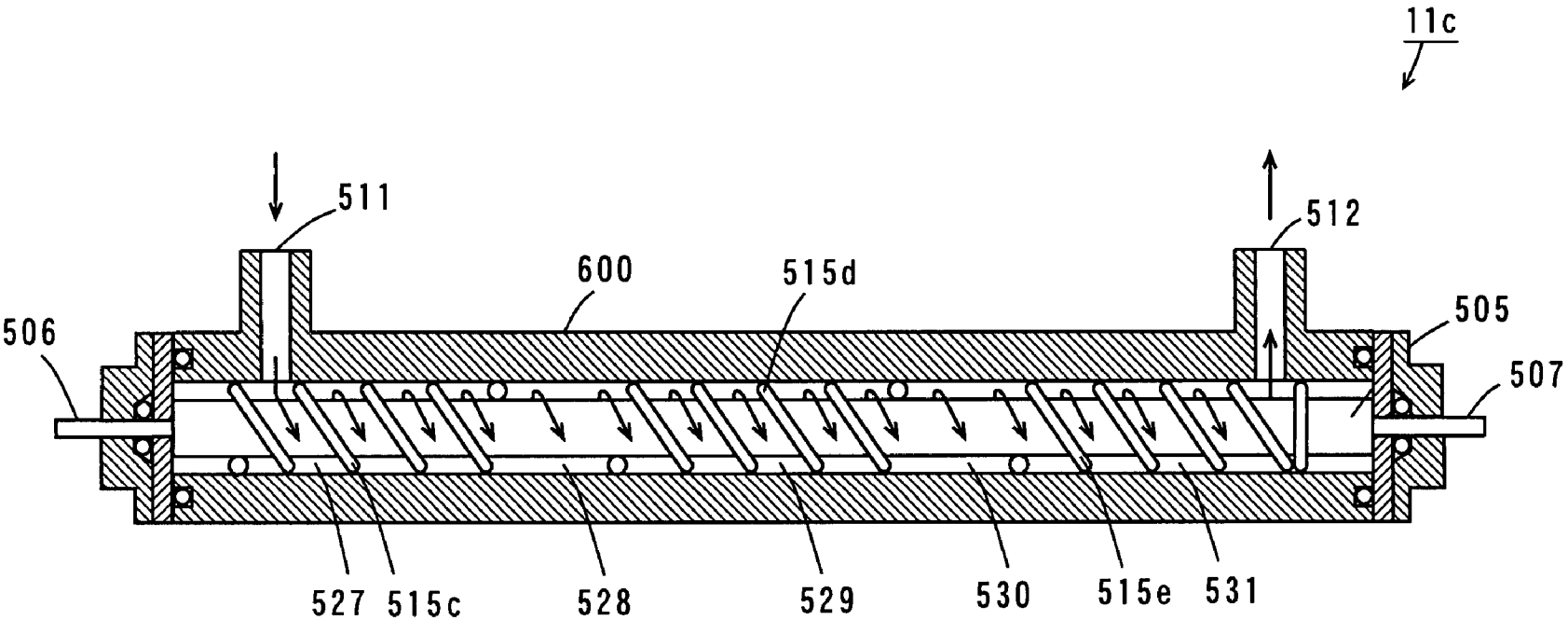
FIG. 11 is a cross-sectional view showing still another example of the fluid heating device.

FIG. 11 is a cross-sectional view showing still another example of the fluid heating device.

A fluid heating device 11*c* shown in FIG. 11 has three springs 515*c*, 515*d*, and 515*e* formed therein in place of the spring 515*a* in the fluid heating device 11*a* shown in FIG. 4, and has flow paths 527, 528, 529, 530, and 531 formed therein in place of the flow path 510.

The spring 515*c* is provided in the vicinity of a washing water inlet 511 in a case main body 600, the spring 515*d* is provided in the vicinity of the center of the case main body 600, and the spring 515*e* is provided in the vicinity of a washing water outlet 512 in the case main body 600. The springs 515*c*, 515*d*, and 515*e* are intermittently provided with predetermined spacing.

Therefore, washing water supplied to the washing water inlet 511 in the case main body 600 is circulated within the flow path 527 formed by an outer peripheral surface of a sheathed heater 505 and the spring 515*c*. Consequently, spiral flow of washing water is generated.

The spiral flow of the washing water generated by being circulated through the flow path 527 is then maintained in the flow path 528 between the springs 515*c* and 515*d*. The washing water is then circulated within the flow path 529 formed by the outer peripheral surface of the sheathed heater 505 and the spring 515*d*. Consequently, the spiral flow of the washing water is generated again.

The spiral flow of the washing water generated by being circulated through the flow path 529 is then maintained in the flow path 530 between the springs 515*d* and 515*e*. Finally, the washing water is circulated within the flow path 531 formed by the outer peripheral surface of the sheathed heater 505 and the spring 515*e*. Consequently, the spiral flow of the washing water is generated again.

Even if the spiral flow of the washing water is damped between the spring 515*c* and the spring 515*d* or between the spring 515*d* and the spring 515*e* that are provided within the case main body 600, the spiral flow is generated again by being circulated through the flow paths 529 and 531. Even in an environment in which the temperature of washing water is raised so that the generation of a scale is increased in the vicinity on the downstream side of the case main body 600, therefore, turbulent flow can be generated while making the flow of the washing water fast. As a result, the scale can be prevented from being generated.

Since no spring is provided in a part of the case main body 600, the cross-sectional areas of the flow paths 528 and 530 are not made smaller by the springs 515*c*, 515*d*, and 515*e* in a part of the case main body 600, as compared with those in a case where the spring 515*a* is provided in the whole case main body 600 (see FIG. 4). Consequently, a pressure loss of washing water is reduced in a part of the case main body 600.

Figure 12:
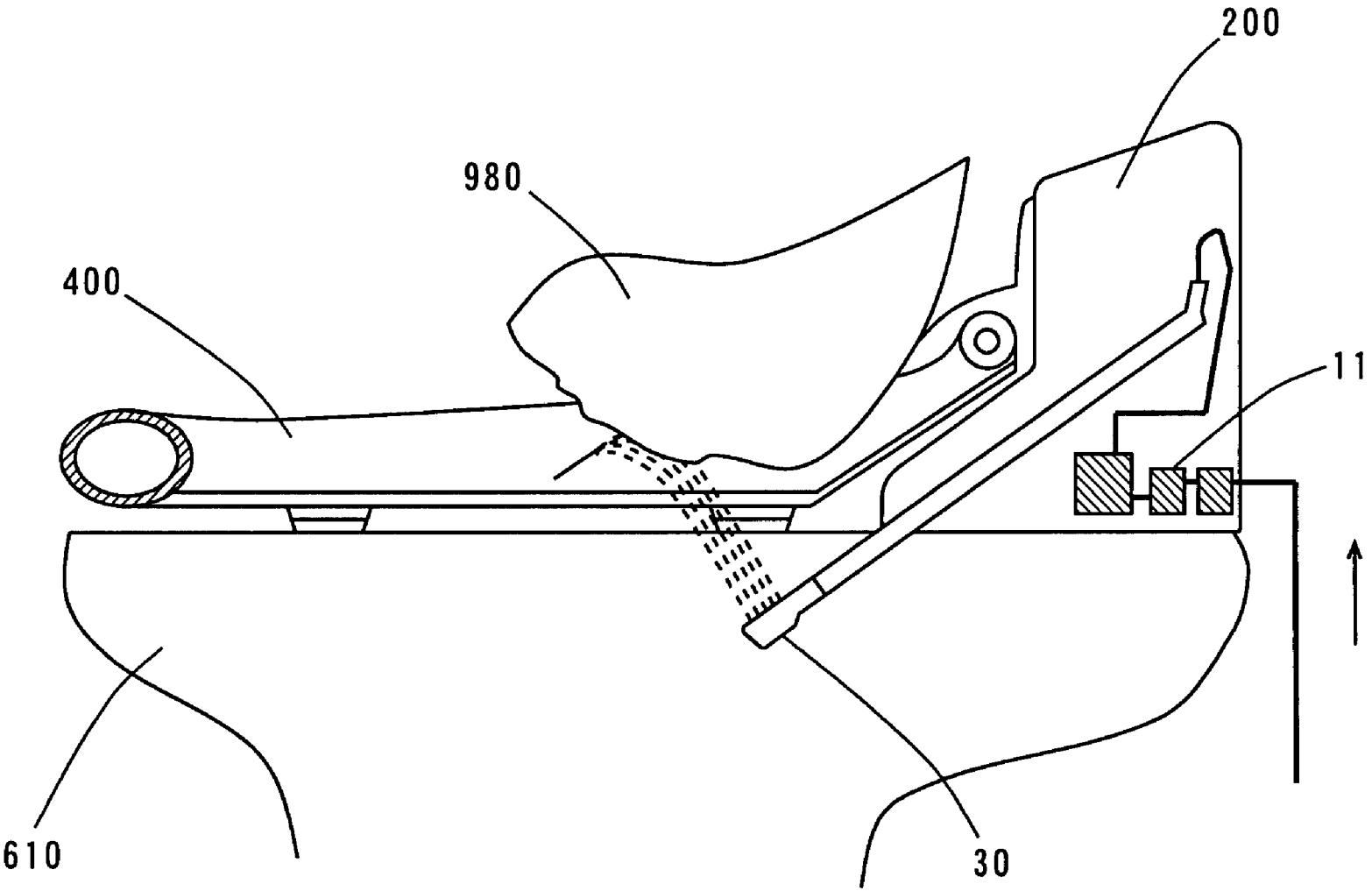
FIG. 12 is a cross-sectional view showing a state where the sanitary washing apparatus shown in FIG. 1 mounted on the toilet bowl is employed for the human body.

FIG. 12 is a cross-sectional view showing a state where the sanitary washing apparatus 100 shown in FIG. 1 mounted on the toilet bowl is employed for the human body.

As shown in FIG. 12, various types of equipment shown in FIG. 3 are arranged in a narrow space within the main body 200. Consequently, a large space may not, in some cases, be taken only for the fluid heating device 11*c*. In order to miniaturize the fluid heating device 11*c*, therefore, a fluid heating device 11*c* in which the sheathed heater 505 is curved in a U shape or a snaked shape is manufactured.

In this case, the fluid heating device 11*c* that can be miniaturized can be manufactured without providing a spring in a curved portion of the sheathed heater 505, in the fluid heating device 11*c*, curved in a U shape or a snaked shape and by providing the springs 515*c*, 515*d*, and 515*e* in a linear portion of the sheathed heater 505.

By the foregoing configuration, the fluid heating device 11*c* whose space can be saved and that can be miniaturized can be arranged within the main body 200. As a result, after the nozzle unit 30 is extended toward a portion to be washed 980 of the human body, washing water heated by the fluid heating device 11*c* can be sprayed from the nozzle unit 30 to the portion to be washed 980. Consequently, the portion to be washed 980 of the human body is washed.

In the fluid heating devices 11*a*, 11*b*, and 11*c*, washing water flows on the outer peripheral surface of the sheathed heater 505 so that heat radiated from the sheathed heater 505 can be supplied to the washing water. As a result, it is possible to realize a fluid heating device that can be miniaturized and has high heat exchange efficiency.

Since a spring is provided in a portion where the speed of washing water is reduced, it is possible to increase the speed of the washing water as well as to bring the washing water into a turbulent flow state. As a result, adhesion of a scale or the like generated on the surface of the sheathed heater 505 can be prevented, which allows the life of the fluid heating device to be lengthened. Further, no spring is provided in a portion other than the portion where the speed of washing water is liable to be reduced, whereby a pressure loss in a flow path can be prevented, as compared with that in a case where a spring is provided throughout. Further, a fluid heating device can be manufactured by inserting the sheathed heater into the spring and covering the spring with the case main body 600. Consequently, the fluid heating device is easy to manufacture, whereby it is feasible to reduce the manufacturing cost.

The present invention is not limited to the fluid heating device 11*c*. For example, fluid heating devices 11*a* and 11*b* obtained by curving the fluid heating devices 11*a* and 11*b* in a U shape or a snaked shape may be manufactured. The seating detection device 620 in the first embodiment may be a device for detecting the human body by an infrared system, a device for detecting the human body by the electrostatic capacitance of the toilet seat 400, a device for detecting that the human body enters a room provided with the sanitary washing apparatus 100 (a rest room), or a device for detecting the presence or absence of the human body in synchronization with illumination in the room provided with the sanitary washing apparatus 100.

Second Embodiment

A sanitary washing apparatus according to a second embodiment will be described.

A remote control device 300*b* in a sanitary washing apparatus 100*b* according to the second embodiment differs from the remote control device 300 in the sanitary washing apparatus 100 according to the first embodiment except for the following points.

Figure 13:
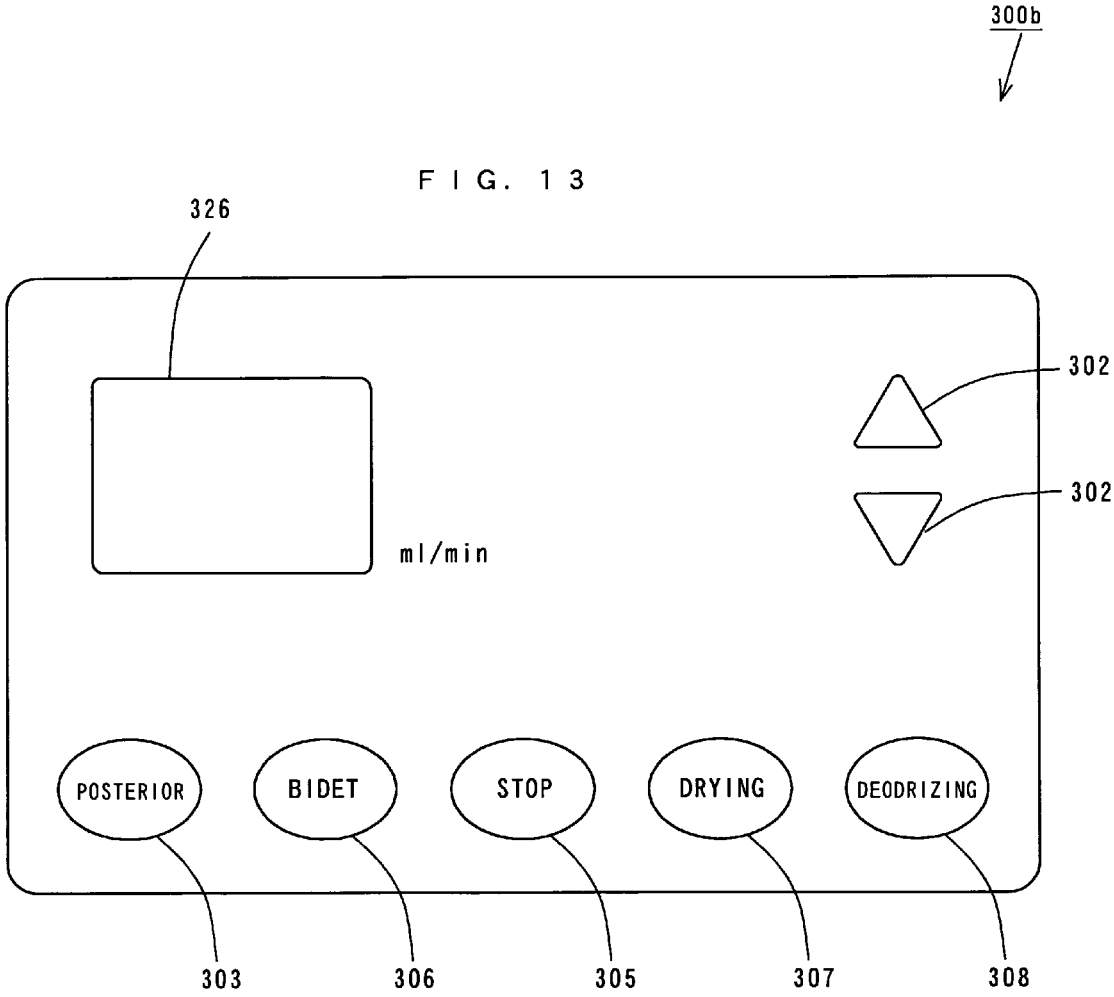
FIG. 13 is a schematic view showing an example of a remote control device in a sanitary washing apparatus according to a second embodiment.

FIG. 13 is a schematic view showing an example of the remote control device 300*b* in the sanitary washing apparatus 100*b* according to the second embodiment.

As shown in FIG. 13, the remote control device 300*b* comprises a liquid crystal display 326, a plurality of adjustment switches 302, a posterior switch 303, a stop switch 305, a bidet switch 306, a drying switch 307, and a deodorizing switch 308.

The flow rate of washing water is displayed on the liquid crystal display 326. A user can confirm the flow rate of washing water by seeing display on the liquid crystal display 326. The flow rate of washing water means the flow rate of washing water sprayed from the nozzle unit 30 shown in FIG. 1.

The user can change the flow rate of washing water sprayed from the nozzle unit 30 by operating the plurality of adjustment switches 302. Consequently, a value representing the flow rate of washing water, which is displayed on the liquid crystal display 326, is increased or decreased.

Figure 14:
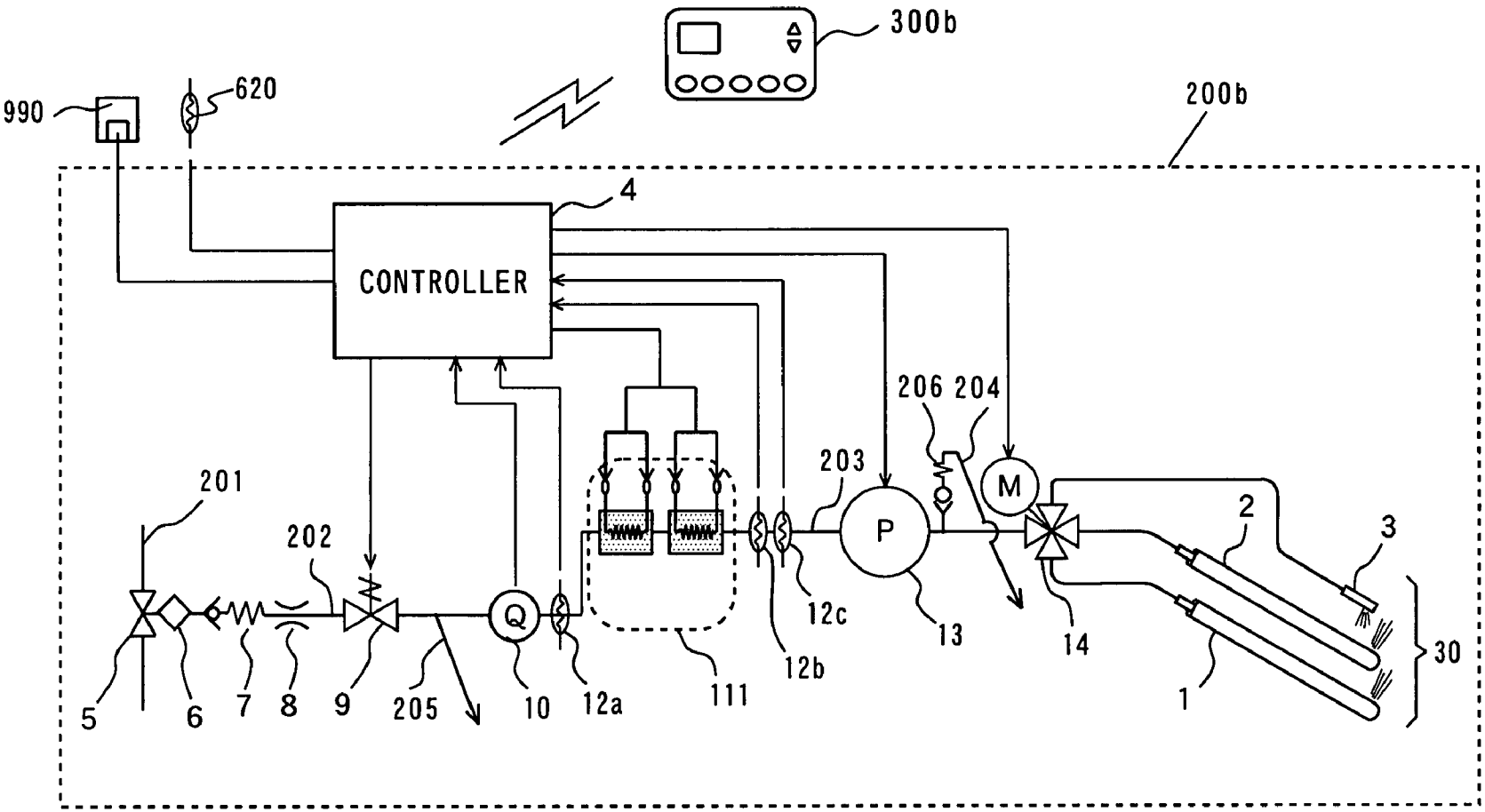
FIG. 14 is a diagram showing the configuration of a main body in the sanitary washing apparatus according to the second embodiment.

Then, FIG. 14 is a diagram showing the configuration of a main body 200*b* in the sanitary washing apparatus 100*b* according to the second embodiment.

The configuration of the main body 200*b* shown in FIG. 14 differs from the configuration of the main body 200 shown in FIG. 3 in that a fluid heating unit 111 is provided in place of the fluid heating device 11*a*. Description is now made of the fluid heating unit 111.

Figure 15:
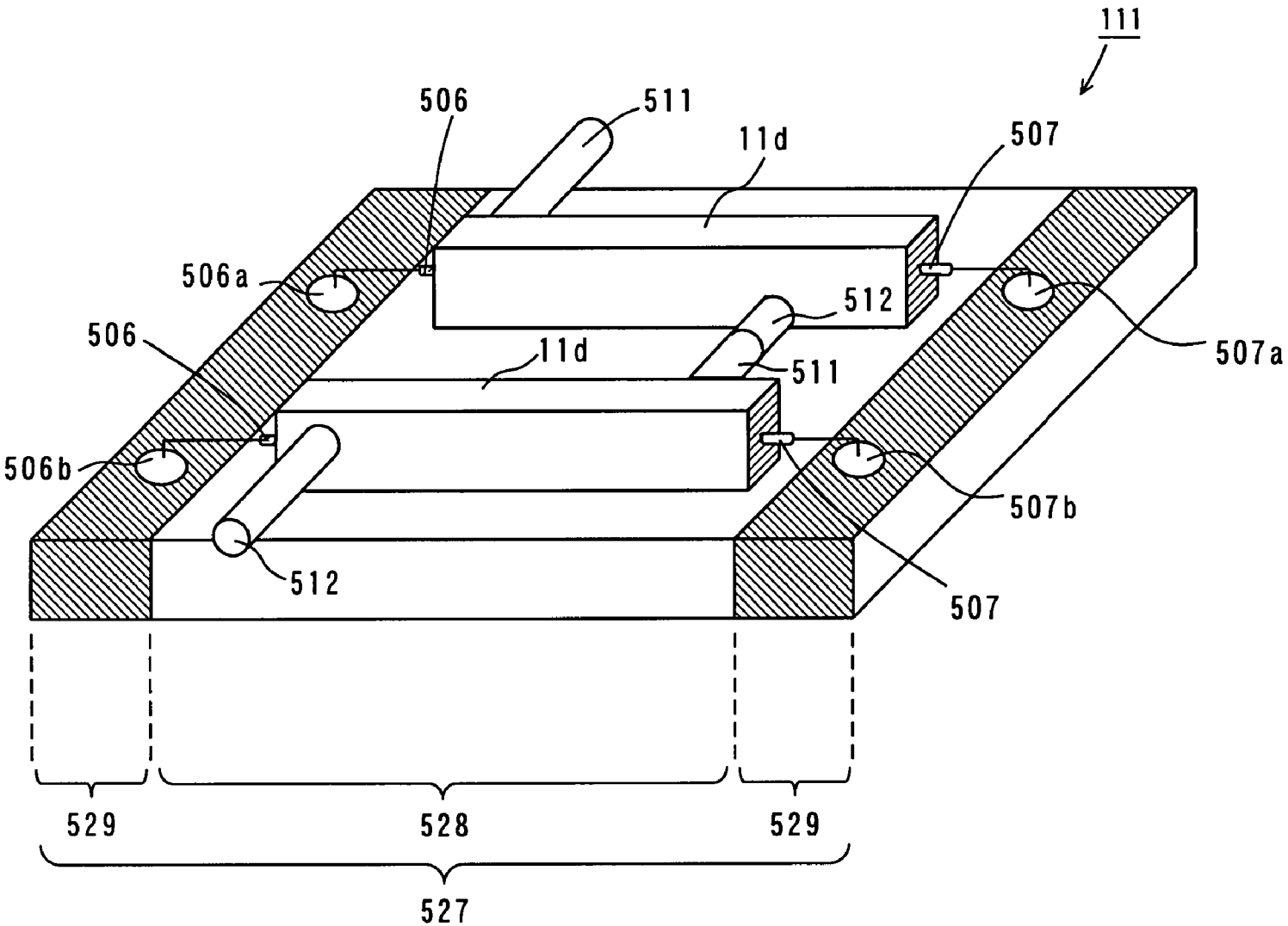
FIG. 15 is a schematic perspective view showing the configuration of a fluid heating unit.

FIG. 15 is a schematic perspective view showing the configuration of the fluid heating unit 111.

As shown in FIG. 15, the fluid heating unit 111 mainly comprises two fluid heating devices lid and a heating device disposal stand 527.

A fluid heating device mounter 528 is provided at the center of the heating device disposal stand 527, and electrical connectors 529 are respectively provided at both ends of the fluid heating device mounter 528. The electrical connector 529 is provided with electrical terminals 506*a*, 506*b*, 507*a*, and 507*b*.

Figure 16:
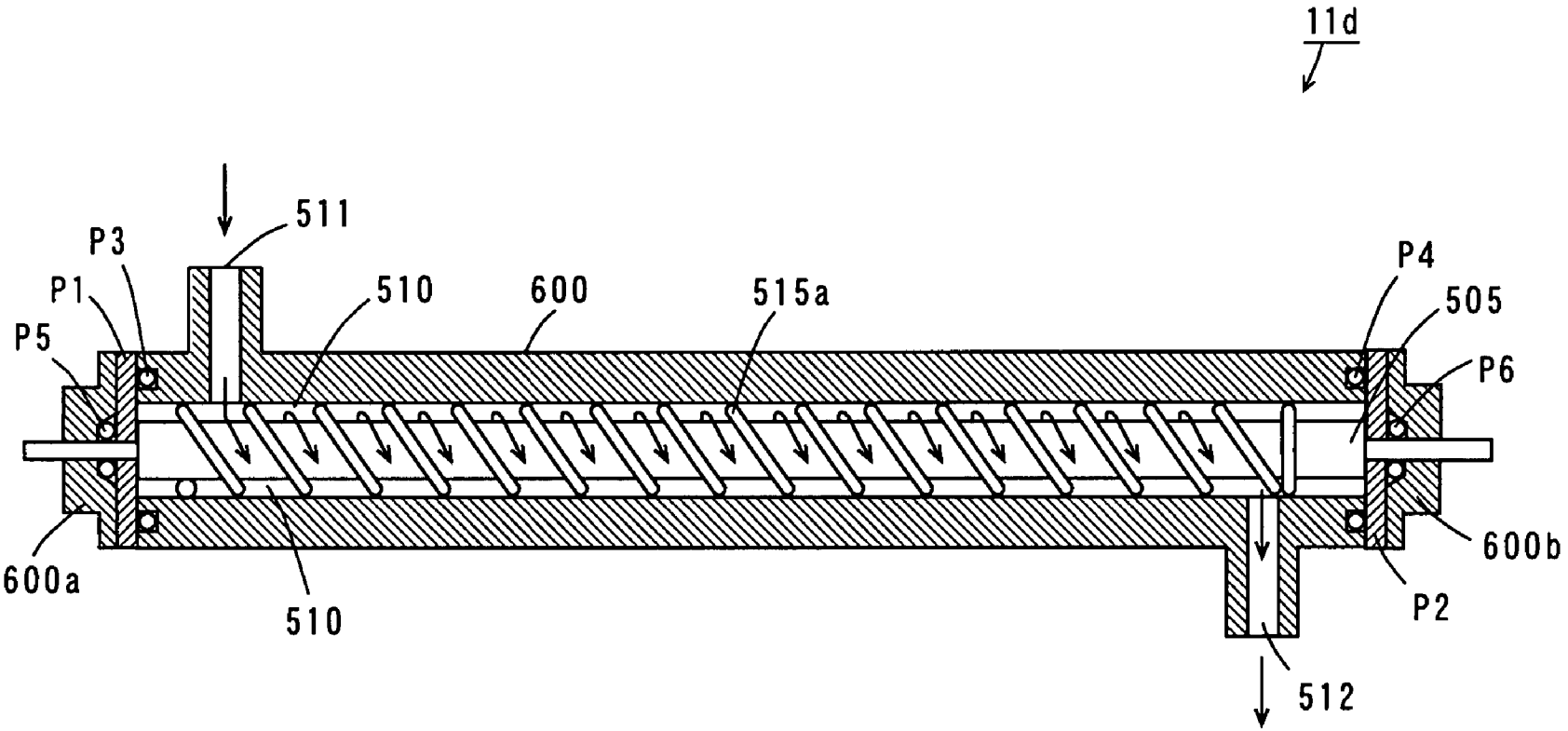
FIG. 16 is a schematic sectional view showing an example of a fluid heating device in the fluid heating unit shown in FIG. 15.

FIG. 16 is a schematic sectional view showing an example of the fluid heating device 11*d* in the fluid heating unit 111 shown in FIG. 15. The fluid heating device 11*d* shown in FIG. 16 differs from the fluid heating device 11*a* shown in FIG. 4 in the position of a washing water outlet 512.

As shown in FIG. 16, a washing water inlet 511 is provided at one end of the fluid heating device lid. The washing water outlet 512 is provided at the other end of the fluid heating device 11*d*. The washing water outlet 512 in the fluid heating device 11*d* is provided in the opposite direction to the washing water inlet 511 with a sheathed heater 505 sandwiched therebetween.

The washing water outlet 512 in the fluid heating device 11*d* has a shape connectable to the washing water inlet 511 in the fluid heating device 11*d*.

As shown in FIG. 15, the washing water outlet 512 in the one fluid heating device 11*d* is connected to the washing water inlet 511 in the other fluid heating device 11*d*.

A terminal 506 of the sheathed heater in one of the two fluid heating devices lid is connected to the electrical terminal 506*a*, and a terminal 507 of the sheathed heater in the one fluid heating device 11*d* is connected to the electrical terminal 507*a*. A terminal 506 of the sheathed heater in the other fluid heating device lid is connected to the electrical terminal 506*b*, and a terminal 507 of the sheathed heater in the other fluid heating device 11*d* is connected to the electrical terminal 507*b*.

The sheathed heaters in the two fluid heating devices 11*d* generate heat, respectively, by supply of power from the electrical terminals 506*a*, 506*b*, 507*a*, and 507*b*.

Washing water supplied to the washing water inlet 511 in the one fluid heating device 11*d* is heated by the sheathed heater in the one fluid heating device 11*d*, and is further heated by the sheathed heater in the other fluid heating device 11*b* through the washing water outlet 512*a* in the one fluid heating device 11*d* and the washing water inlet 511 in the other fluid heating device lid. Thereafter, the heated washing water is supplied to the pump 13 (see FIG. 3) from the washing water outlet 512 in the other fluid heating device 11*d*.

Therefore, the speed of washing water flowing in a flow path 510*a* formed in a spiral shape becomes higher than the speed of washing water linearly flowing along the sheathed heater from the washing water inlet 511 to the washing water outlet 512. As a result, the washing water flows in a high-speed turbulent flow state along an outer peripheral surface of the sheathed heater within the flow path 510*a*, so that the washing water is agitated, which allows heat generated on the outer peripheral surface of the sheathed heater to be efficiently transferred to the whole washing water.

Furthermore, the two fluid heating devices lid are so configured that they can be easily arranged from the exterior. Description is now made of a method of arranging the fluid heating device 11*d*.

Figure 17:
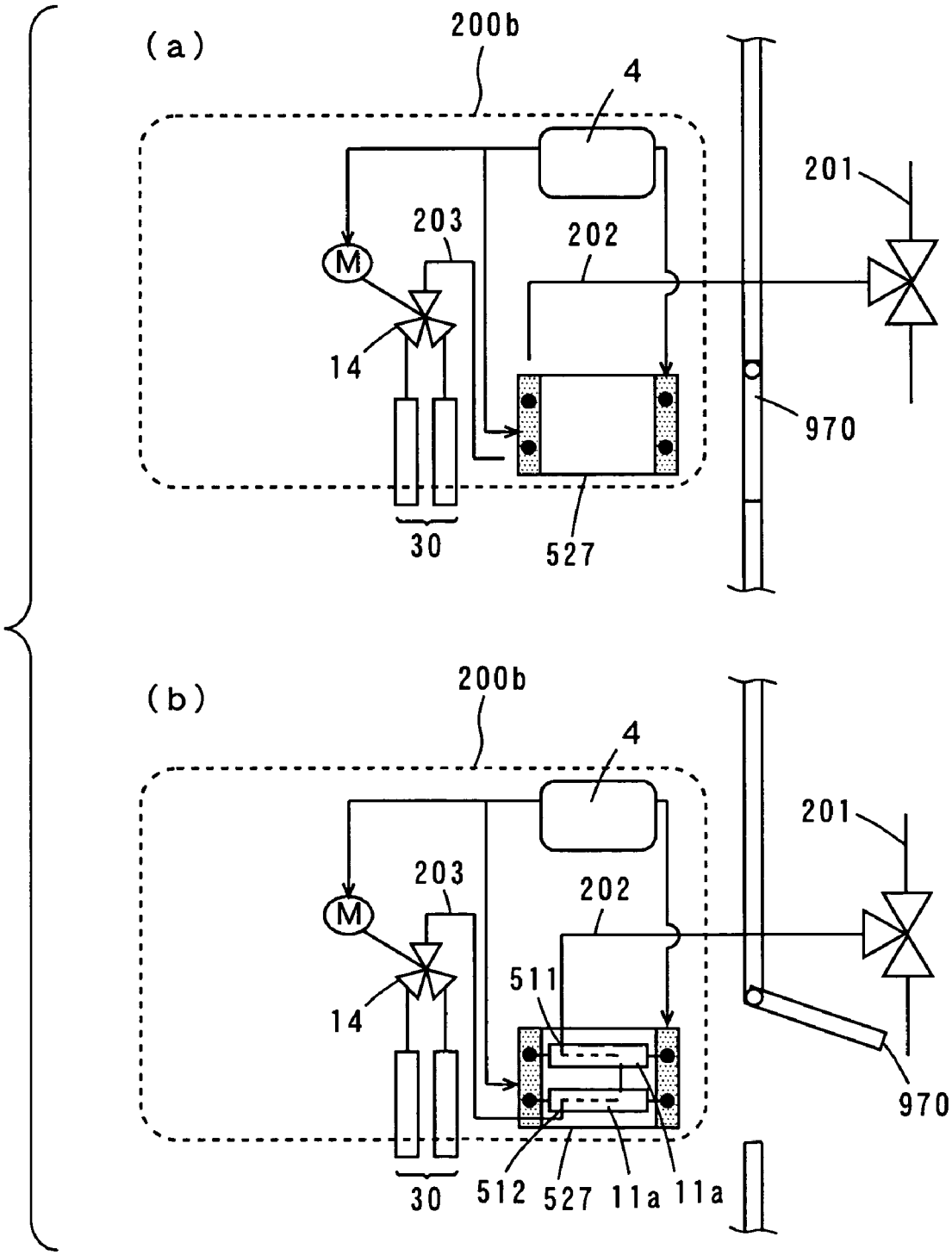
FIG. 17 is a schematic view for explaining a method of arranging the fluid heating device.

FIG. 17 is a schematic view for explaining a method of arranging the fluid heating device 11*d*.

FIG. 17(*a*) shows a state where the two fluid heating devices 11*d* have not been arranged within the main body 200*b*, and FIG. 17(*b*) shows a state where the two fluid heating devices 11*d* have been arranged within the main body 200*b*.

As shown in FIG. 17(*a*), a nozzle unit 30, a controller 4, a switching valve 14, and a heating device disposal stand 527 are provided within the main body 200*b*. Further, a fluid heating unit insertion port 970 is provided on a side surface of the main body 200*b* (see FIG. 1). In FIG. 17(*a*), the fluid heating unit insertion port 970 is closed.

As shown in FIG. 17(*b*), the fluid heating unit insertion port 970 provided on the side surface of the main body 200*b* is then opened. The two fluid heating devices 11*d* are inserted into the main body 200*b*, and are disposed on the heating device disposal stand 527.

In this case, a pipe 202 from a water supply source 201 is connected to the washing water inlet 511 in the one fluid heating device 11*d*, and the washing water outlet 512 in the other fluid heating device lid is connected to a pipe 203. Further, the terminals 506 and 507 of the two fluid heating devices lid are respectively connected to the electrical terminals 506*a*, 506*b*, 507*a*, and 507*b* (see FIG. 15). Finally, the fluid heating unit insertion port 970 is closed.

The number of fluid heating devices 11*d* is not limited to two. The number may be increased or decreased. For example, an output of the one fluid heating device 11*d* is approximately 1000 to 1500 W. In a case where the lowest water inlet temperature of washing water supplied to the fluid heating device lid is approximately 5° C., and the spray temperature of washing water to a portion to be washed of the human body is approximately 40° C., the maximum amount of washing water that can be heated to approximately 40° C. by the output of approximately 1000 to 1500 W is approximately 500 milliliters per minute. In a case where the maximum amount of washing water must be approximately 1000 milliliters per minute, therefore, the number of fluid heating devices 11*b* to be provided is two. In a case where the maximum amount of washing water must be approximately 1500 milliliters per minute, a user operates the adjustment switch 302 shown in FIG. 13, for example, so that the number of fluid heating devices 11*b* to be provided is three. In this case, the number of electrical terminals 506*a*, 506*b*, 507*a*, and 507*b* in the heating device disposal stand 527 must be increased.

In a case where the number of fluid heating devices lid is increased or decreased in the foregoing description, the controller 4 in the main body 200*b* in the sanitary washing apparatus 100 calculates an amount of power to be supplied to the sheathed heater in each of the fluid heating devices 11*d* on the basis of a water inlet temperature from a temperature sensor 12*a* and a flow rate value from a flow sensor 10, and supplies the calculated amount of power to the sheathed heater.

By the foregoing configuration, the number of fluid heating devices 11*d* can be freely changed. As a result, washing water can be heated to a suitable temperature even in a case of a severe setting environment and ambient temperature.

Figure 18:
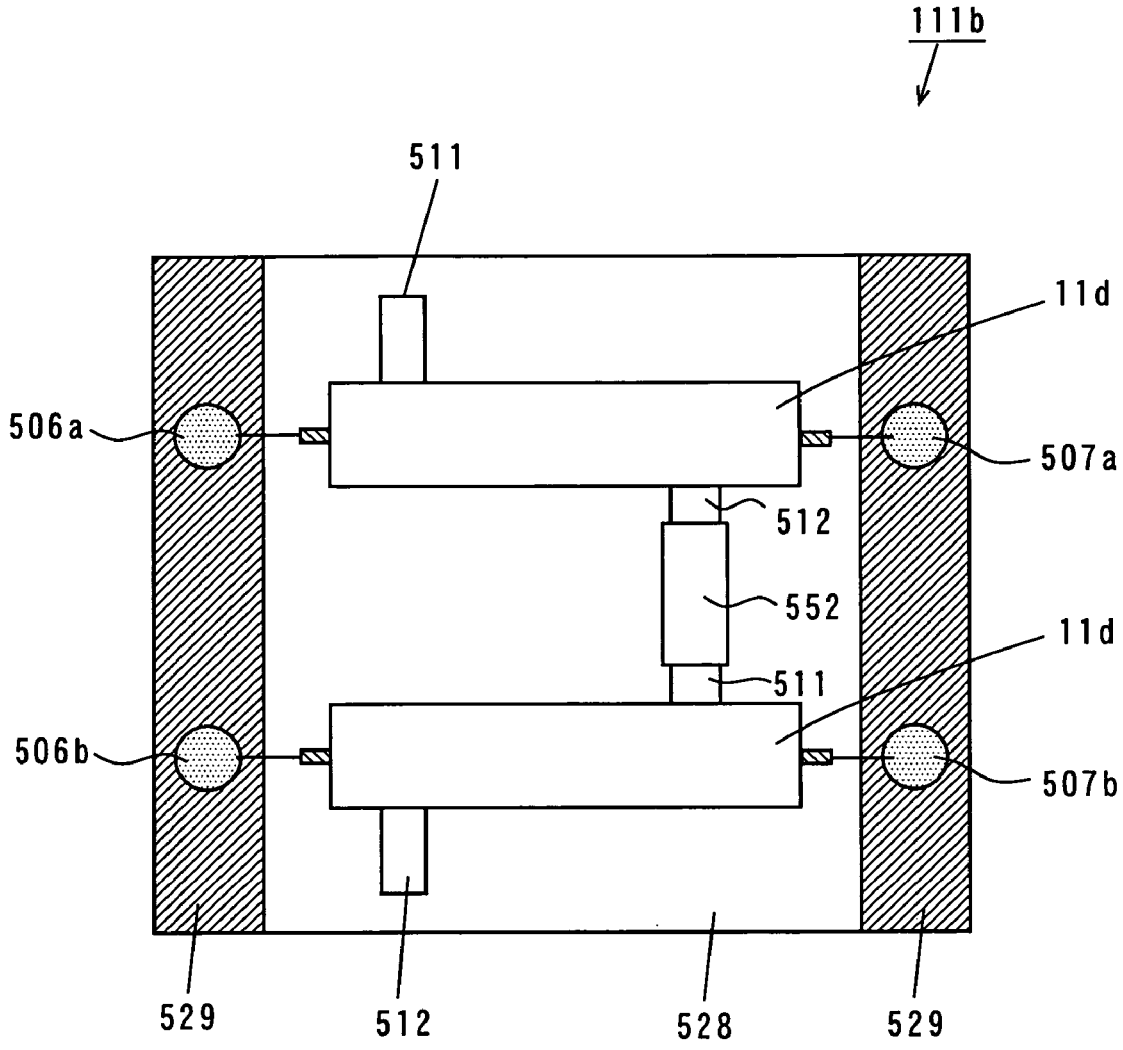
FIG. 18 is a schematic plan view showing another example of the fluid heating unit.

FIG. 18 is a schematic plan view showing another example of the fluid heating unit.

A fluid heating unit 111*b* shown in FIG. 18 comprises a connection member 552 in addition to the fluid heating unit 111 shown in FIG. 15.

As shown in FIG. 18, a washing water outlet 512 in one fluid heating device lid and a washing water inlet 511 in the other fluid heating device 11*d* are connected to each other by the connection member 552 composed of heat-resistant rubber having flexibility. Consequently, the number of fluid heating devices 11*d* can be easily increased or decreased. Further, the layout of the plurality of fluid heating devices lid can be flexibly designed.

Figure 19:
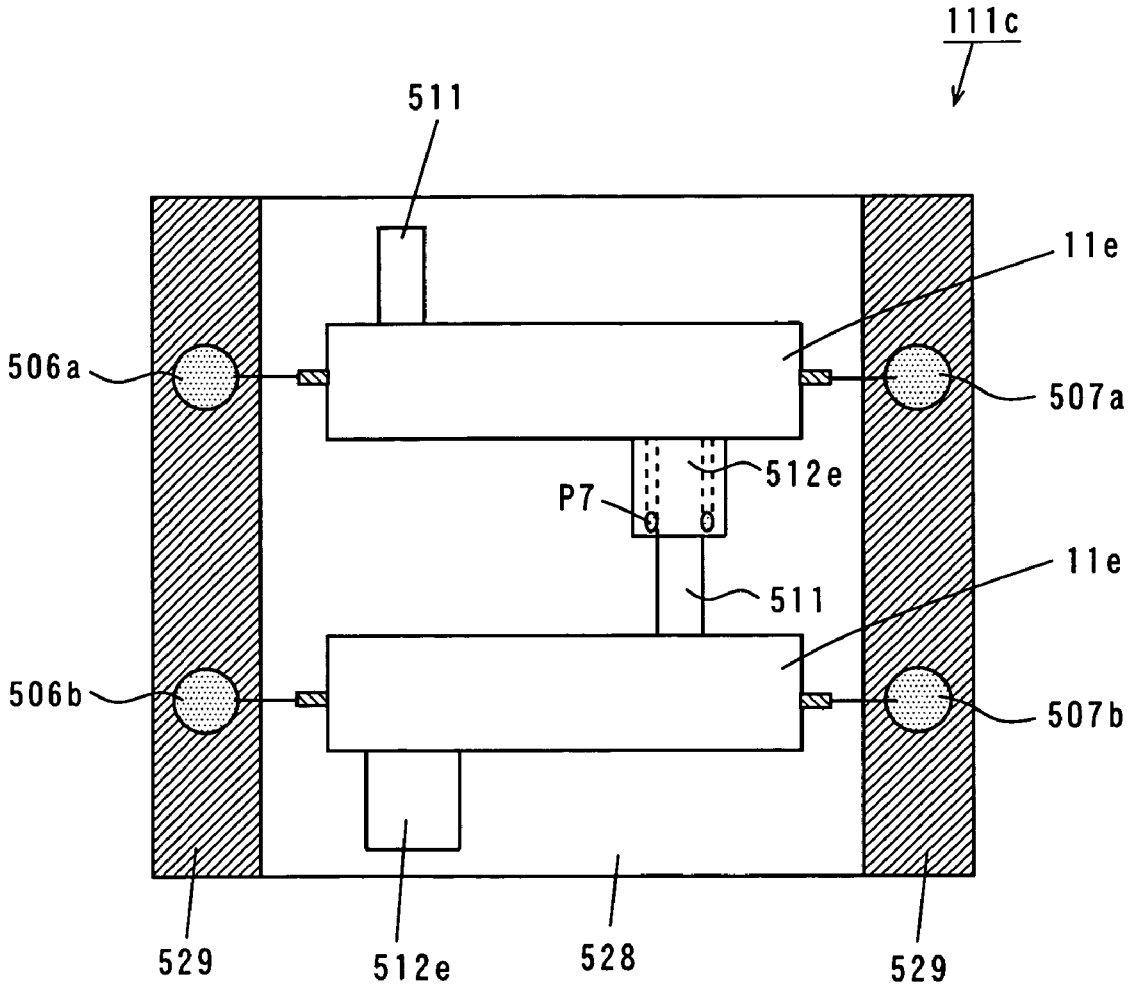
FIG. 19 is a schematic plan view showing still another example of the fluid heating unit.
Figure 20:
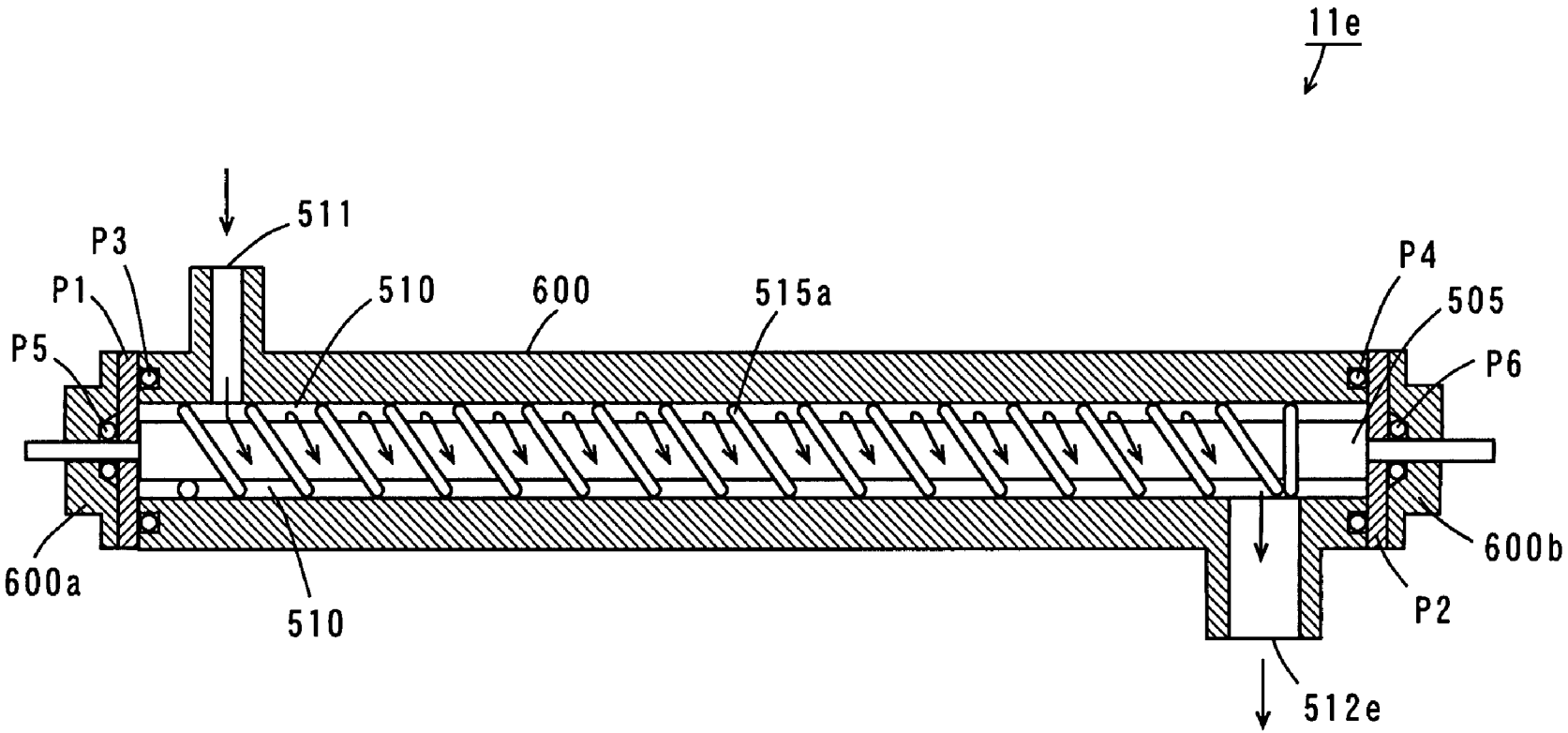
FIG. 20 is a schematic sectional view showing an example of a fluid heating device used for the fluid heating unit shown in FIG. 19.

FIG. 19 is a schematic plan view showing still another example of the fluid heating unit, and FIG. 20 is a schematic sectional view showing an example of a fluid heating device used for the fluid heating unit shown in FIG. 19.

A fluid heating unit 111*c* shown in FIG. 19 comprises two fluid heating devices lie in place of the two fluid heating devices 11*d* in the fluid heating unit 111 shown in FIG. 15. A fluid heating device lie shown in FIG. 20 differs from the fluid heating device 11*d* shown in FIG. 16 in that a washing water outlet 512*e* is provided in place of the washing water outlet 512.

Figure 21:
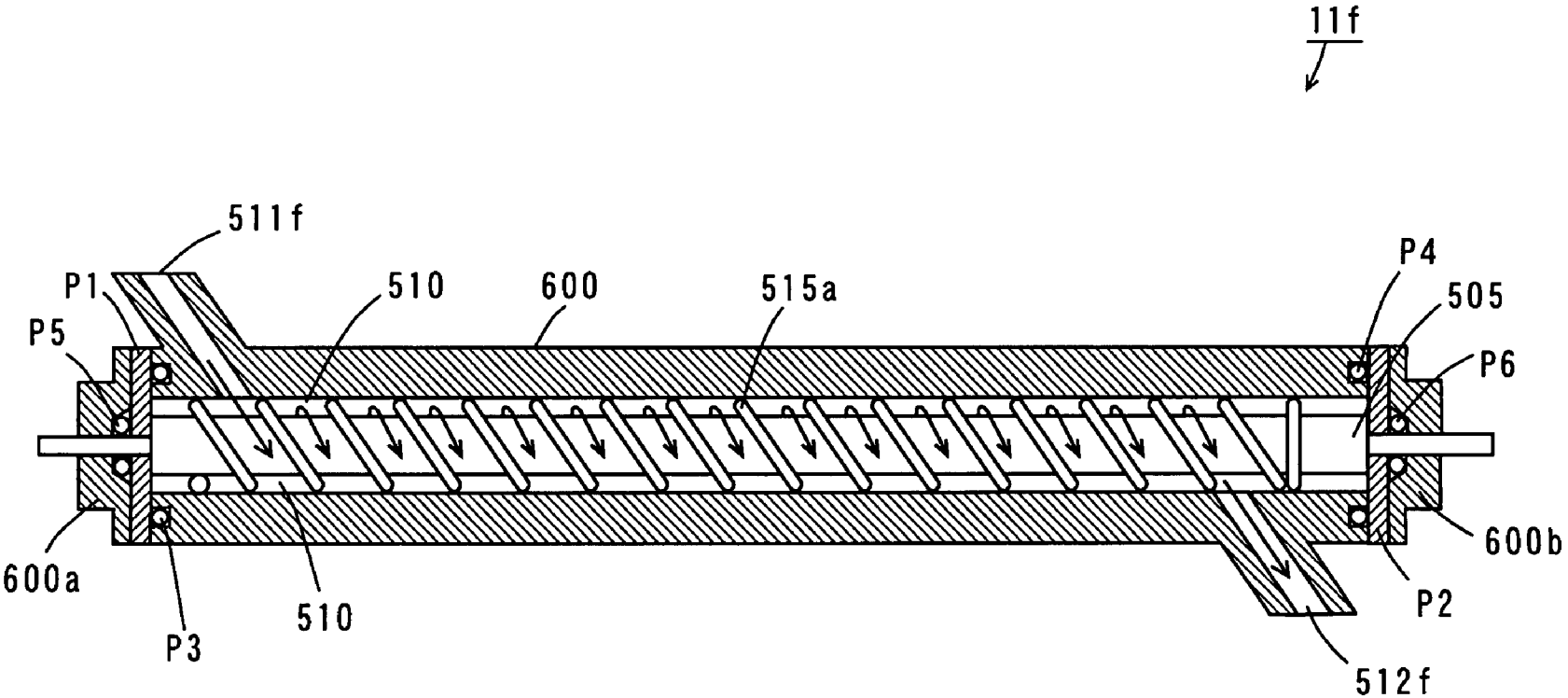
FIG. 21 is a schematic sectional view showing still another example of the fluid heating device.

As shown in FIG. 20, the inner diameter of the washing water outlet 512*e* in the fluid heating device 11*e* is larger than the outer diameter of the washing water inlet 511 in the fluid heating device lie, and is smaller than the sum of the outer diameter of the washing water inlet 511 and the diameter of an O ring P7. Consequently, the washing water outlet 512*e* in the one fluid heating device 11*e* and the washing water inlet 511 in the other fluid heating device lie can be water-tightly fitted by interposing the O ring P7 therebetween, as shown in FIG. 21. Consequently, the number of fluid heating devices 11*e* can be easily increased or decreased.

Then, FIG. 21 is a schematic sectional view showing still another example of the fluid heating device.

A fluid heating device 11*f* shown in FIG. 21 differs in cross section from the fluid heating device lid shown in FIG. 16 in the following points.

As shown in FIG. 21, a washing water inlet 511*f* is provided obliquely outward so as to be parallel to the direction of flow of a flow path 510 from one end of a main body case 600, and a washing water outlet 512*f* is provided obliquely outward so as to be parallel to the direction of flow of the flow path 510 from the other end of the main body case 600. Consequently, it is possible to reduce a pressure loss of washing water flowing in from the washing water inlet 511*f* as well as to reduce a pressure loss of washing water flowing out of the washing water outlet 512*f*. As a result, it is possible to provide washing water with a flow rate that is stable even in a case where water pressure is low.

As described in the foregoing, the fluid heating unit is provided with the plurality of fluid heating devices, so that the maximum heating amount of the fluid heating unit can be increased. As a result, a flow rate at a predetermined temperature can be ensured depending on a user's taste or a use environment.

Third Embodiment

A sanitary washing apparatus according to a third embodiment will be then described. The sanitary washing apparatus 100*c* (not shown) according to the third embodiment differs from the sanitary washing apparatus 100 according to the first embodiment in that a fluid heating device 11*g* is provided in place of the fluid heating device 11*a*.

Figure 22:
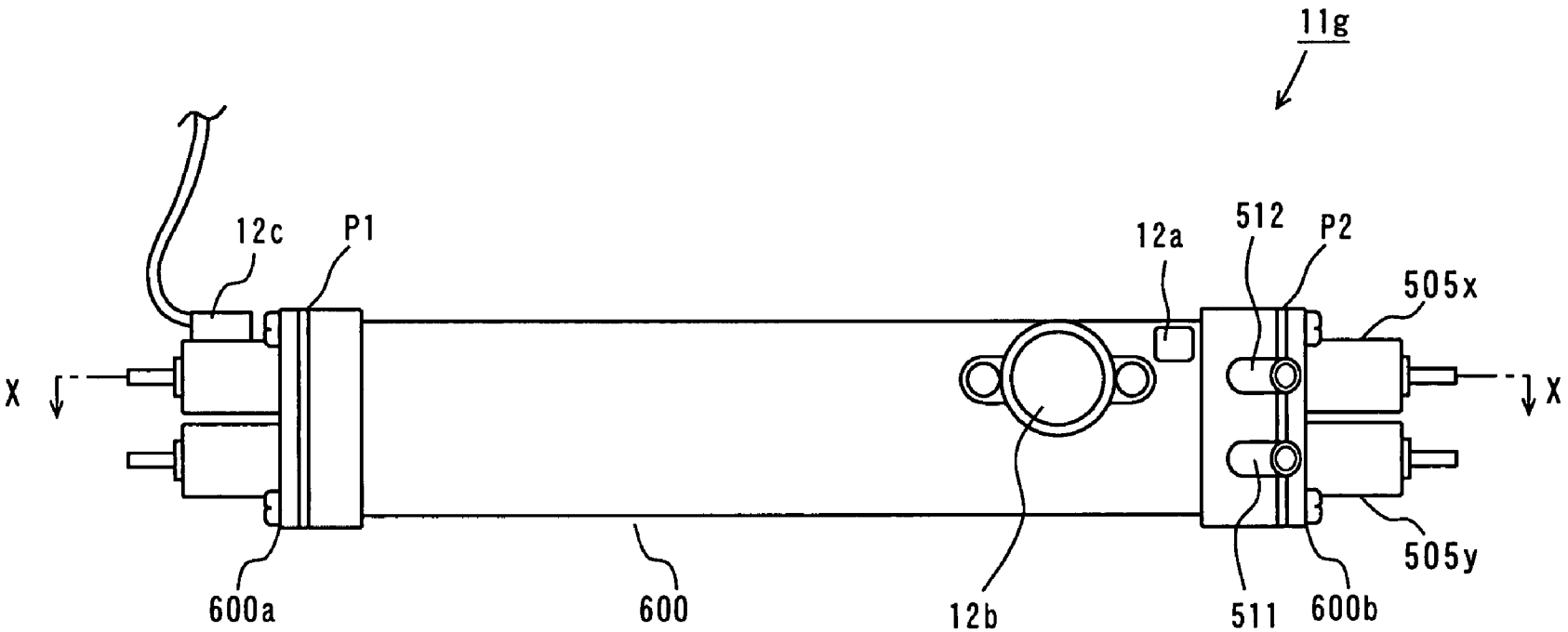
FIG. 22 is a plan view showing an example of the configuration of a fluid heating device according to a third embodiment.

FIG. 22 is a plan view showing an example of the configuration of the fluid heating device 11*g* according to the third embodiment.

As shown in FIG. 22, the fluid heating device 11*g* mainly comprises a case main body 600 in a rectangular parallelepiped shape, linear sheathed heaters 505*x* and 505*y*, springs 515*a* and 515*b* (not shown), elastic holding members P1 and P2, and end surface holding members 600*a* and 600*b*.

A washing water inlet 511 for receiving washing water supplied from a pipe 202 and a washing water outlet 512 for feeding heated washing water to a pump 13 are provided on an upper surface at one end of the case main body 600 in the fluid heating device 11*a*.

A temperature sensor 12*a* and a temperature sensor 12*b* are provided near the washing water outlet 512. Further, a temperature fuse 12*c* is provided at the other end of the sheathed heater 505*x*.

The end surface holding members 600*a* and 600*b* are respectively mounted on both end surfaces of the case main body 600 through the elastic holding member P1 and P2. Thus, respective clearances between openings at both ends of the case main body 600, described later, and the sheathed heaters 505*x* and 505*y* are closed.

Figure 23:
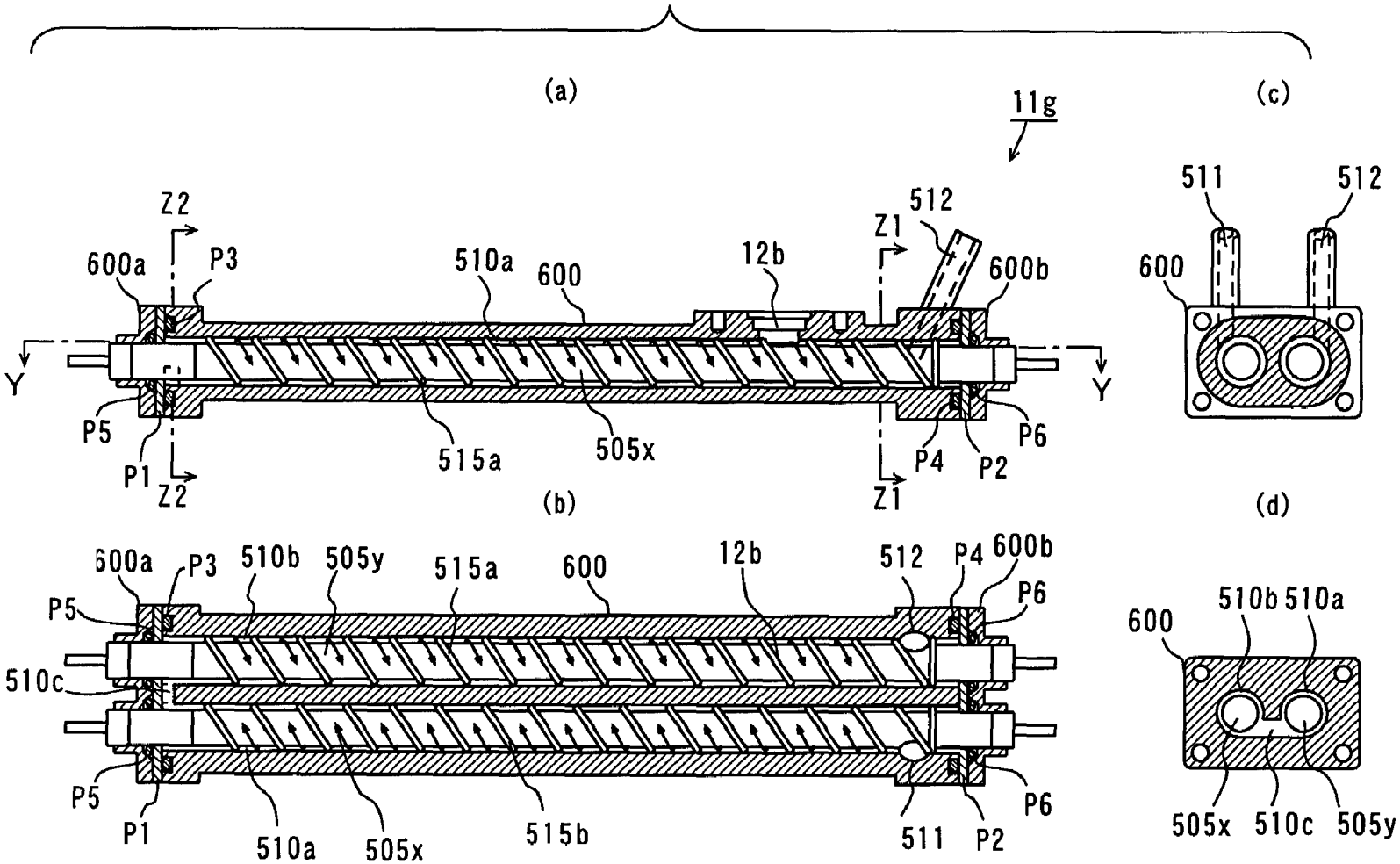
FIG. 23 is a diagram for explaining the internal configuration of the fluid heating device shown in FIG. 22.

Then, FIG. 23 is a diagram for explaining the internal configuration of the fluid heating device 11*g* shown in FIG. 22. FIG. 23(*a*) illustrates a cross section taken along a line X-X in the fluid heating device 11*g* shown in FIG. 22, FIG. 23(*b*) illustrates a cross section taken along a line Y-Y in the fluid heating device 11*g* shown in FIG. 23(*a*), FIG. 23(*c*) illustrates a cross section taken along a line Z1-Z1 in the fluid heating device 11*g* shown in FIG. 23(*a*), and FIG. 23(*a*) illustrates a cross section taken along a line Z2-Z2 in the fluid heating device 11*g* shown in FIG. 23(*a*). In FIGS. 23(*c*) and 23(*d*), the illustration of the springs 515*a* and 515*b* is omitted.

Linear sheathed heaters 505*x* and 505*y* are arranged substantially parallel to each other so as to penetrate the case main body 600. A spring 515*a* is spirally wound around an outer peripheral surface of the sheathed heater 505*x*, and the spring 515*b* is spirally wound around an outer peripheral surface of the sheathed heater 505*y*.

A flow path 510*a* is formed by the outer peripheral surface of the sheathed heater 505*x*, the spring 515*a*, and an inner peripheral surface of the case main body 600. The flow path 510*a* is formed in a spiral shape with the length of the case main body 600 used as its axis. Similarly, a flow path 510*b* is formed by the outer peripheral surface of the sheathed heater 505*y*, the spring 515*b*, and the inner peripheral surface of the case main body 600. The flow path 510*b* is formed in a spiral shape with the length of the case main body 600 used as its axis.

O rings P3 and P4 are respectively provided between both the end surfaces of the case main body 600 and the elastic holding members P1 and P2, and O rings P5 and P6 are respectively provided between end surface holding members 600*a* and 600*b* and the elastic holding members P1 and P2. Consequently, washing water is prevented from flowing out of respective joints between both the end surfaces of the case main body 600 and the end surface holding members 600*a* and 600*b*.

Furthermore, the respective vicinities at both ends of the outer peripheral surfaces of the sheathed heaters 505*x* and 505*y* are held so as to be axially movable by the elastic holding members P1 and P2. Here, an example of a state where the sheathed heaters 505*x* and 505*y* are held so as to be axially movable is a state where the sheathed heaters 505*x* and 505*y* are held so as to be axially movable by the respective deflections of the elastic holding members P1 and P2 composed of rubber or a state where the sheathed heaters 505*x* and 505*y* are held so as to be axially movable by sliding between surfaces of the elastic holding members P1 and P2 composed of rubber and surfaces of the sheathed heaters 505*x* and 505*y*. The vicinities at both ends of the outer peripheral surfaces of the sheathed heaters 505*x* and 505*y* correspond to a nichrome wire part used as a heating element but a metal terminal part connected to a nichrome wire (a non-heating portion L2; see FIG. 5). Therefore, the vicinities at both the ends of the sheathed heaters 505*x* and 505*y* do not reach high temperatures. Consequently, the elastic holding members P1 and P2 are not melted.

A controller 4 carries out feedback control of the respective temperatures of the sheathed heaters 505*x* and 505*y* in the fluid heating device 11 on the basis of a temperature measured value given from the temperature sensor 12*a*. A detector in the temperature sensor 12*b* is inserted into the cylindrical space 510*b*. The controller 4 controls the supply of power to the sheathed heaters 505*x* and 505*y* in the fluid heating device 11 and the cutoff thereof on the basis of a temperature excess signal fed from the temperature sensor 12*b*.

The temperature fuse 12*c* cuts off the supply of power to the sheathed heaters 505*x* and 505*y* in a case where the temperature of the sheathed heater 505*y* exceeds a predetermined temperature. Since the temperature sensor 12*a* is provided near the washing water outlet 512, the temperature of washing water supplied to the posterior nozzle 1 can be accurately controlled. Further, the sheathed heaters 505*x* and 505*y* are prevented from being abnormally heated, which results in improved safety.

Since the temperature sensor 12*b* is provided near the washing water outlet 512 similarly to the temperature sensor 12*a*, the controller 4 can accurately control the temperature of washing water supplied to the posterior nozzle 1.

Washing water is supplied to the spiral flow path 510*a* formed around the sheathed heater 505*x* from the washing water inlet 511 provided at one end of the fluid heating device 11*g* shown in FIG. 23(*c*). Here, the washing water inlet 511 is provided at a position eccentric from the axis of the flow path 510*a*. Therefore, washing water flows in the spiral flow path 510*a* formed along the outer peripheral surface of the sheathed heater 505*x*.

As shown in FIG. 23(*d*), a flow path 510*c* is provided at a position eccentric from the respective axes of the spiral flow paths 510*a* and 510*b*. Consequently, washing water flowing in the flow path 510*a* is supplied to the spiral flow path 510*b* formed around the sheathed heater 505*y* from the flow path 510*c* in the fluid heating device 11*g* shown in FIG. 23(*d*) without damping the speed thereof. Washing water is discharged from the washing water outlet 512 provided at one end of the fluid heating device 11*g* shown in FIG. 23(*c*).

Consequently, the speed of washing water flowing in the flow paths 510*a* and 510*b* formed in a spiral shape becomes higher than the speed of washing water linearly flowing along the sheathed heaters 505*x* and 505*y* from the washing water inlet 511 to the flow path 510*c* and from the flow path 510*c* to the washing water outlet 512.

As a result, the washing water flows in a high-speed turbulent flow state along the outer peripheral surfaces of the sheathed heaters 505*x* and 505*y* within the flow paths 510*a* and 510*b*, so that the washing water is agitated, which allows heat generated on the outer peripheral surfaces of the sheathed heaters 505*a* and 505*b* to be efficiently transferred to the whole washing water.

Even in a case where the sheathed heaters 505*x* and 505*y* thermally expand or thermally shrink in an axial direction, the direction of deformation due to the thermal expansion or the thermal shrinkage is limited to a substantially axial direction. Consequently, the deformation of the sheathed heaters 505*x* and 505*y* by the thermal expansion or the thermal shrinkage can be effectively absorbed by sliding between both their ends relative to the elastic holding members P1 and P2. Consequently, no stress is exerted on the sheathed heaters 505*x* and 505*y* and the case main body 600 in a rectangular parallelepiped shape, so that the sheathed heaters 505*x* and 505*y* and the case main body 600 are prevented from being damaged and deformed.

Since the outer peripheries of the sheathed heaters 505*x* and 505*y* are not brought into contact with the case main body 600 in a rectangular parallelepiped shape, no stress is exerted on the sheathed heaters 505*x* and 505*y* and the case main body 600 even if the sheathed heaters 505*x* and 505*y* thermally expand or thermally shrink in a radial direction, so that the sheathed heaters 505*x* and 505*y* and the case main body 600 are prevented from being damaged and deformed.

Although in the present embodiment, the controller 4 controls the respective temperatures of the sheathed heaters 505*x* and 505*y* in the fluid heating device 11 by feedback control, the present invention is not limited to the same. For example, the respective temperatures of the sheathed heaters 505*x* and 505*y* may be controlled by feed-forward control. Alternatively, complex control for controlling the sheathed heaters 505*x* and 505*y* by feed-forward control at the time of temperature rise and controlling the sheathed heaters 505*x* and 505*y* by feedback control at the normal time may be carried out.

Furthermore, the respective energization amounts of the plurality of sheathed heaters 505*x* and 505*y* may be controlled by a triac element. For example, such control may be carried out that the duty ratio is set depending on the plurality of sheathed heaters 505*x* and 505*y* and the sheathed heaters are alternately energized depending on the duty ratio. As a result, the production of flicker noise or the like can be restrained.

Although in the present embodiment, the two linear sheathed heaters 505*x* and 505*y* that are low in cost and are difficult to damage are used, the present invention is not limited to the same. Any number of linear sheathed heaters may be used. Further, although in the present embodiment, the columnar sheathed heaters 505*x* and 505*y* are used, the present invention is not limited to the same. For example, triangular prism-, square prism-, polyangular prism-shaped sheathed heaters may be used.

Although in the present embodiment, the sheathed heaters 505*x* and 505*y* are used, the present invention is not limited to the same. For example, a ceramic heater having the same cylindrical shape as that of the sheathed heaters 505*x* and 505*y* may be used.

Figure 24:
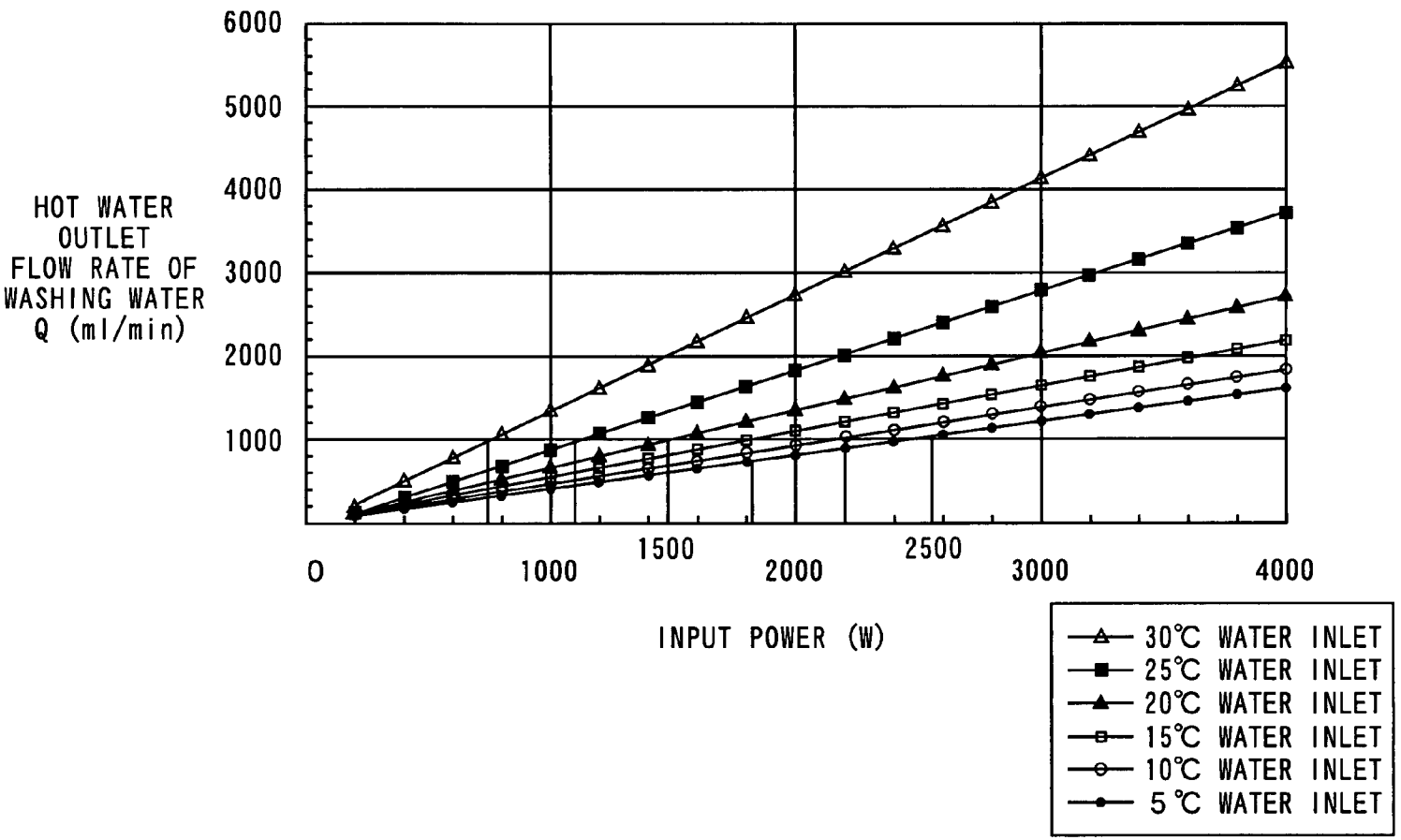
FIG. 24 is a diagram showing the heating properties of the fluid heating device according to the third embodiment.

Then, FIG. 24 is a diagram showing the heating properties of the fluid heating device 11*g* according to the third embodiment. In FIG. 24, the horizontal axis indicates the hot water outlet flow rate Q (milliliter per minute) of washing water, and the vertical axis indicates input power (watt).

In FIG. 24, a white triangle indicates heating properties in a case where washing water having a water inlet temperature of 30° C. is raised to approximately 40° C., a black square indicates heating properties in a case where washing water having a water inlet temperature of 25° C. is raised to approximately 40° C., a black triangle indicates heating properties in a case where washing water having a water inlet temperature of 20° C. is raised to approximately 40° C., a white square indicates heating properties in a case where washing water having a water inlet temperature of 15° C. is raised to approximately 40° C., a white circle indicates heating properties in a case where washing water having a water inlet temperature of 10° C. is raised to approximately 40° C., and a black circle indicates heating properties in a case where washing water having a water inlet temperature of 5° C. is raised to approximately 40° C.

Generally, the water inlet temperature of washing water in the winder months is 5° C., for example. The amount of washing water required for a user to obtain a sufficient washing feeling is approximately 1000 milliliters. In this case, in the heating properties indicated by the black circle shown in FIG. 24 (the water inlet temperature 5° C.), the maximum input power required to raise the temperature of washing water whose amount is approximately 1000 milliliters to approximately 40° C. is 2500 watts.

The water inlet temperature of washing water in an intermediate period or the summer months is approximately 20° C., for example. The amount of washing water required for a user to obtain a sufficient washing feeling is approximately 1000 milliliters, similarly to that in the winter months. In this case, in the heating properties indicated by the black triangle shown in FIG. 24 (the water inlet temperature 20° C.), the maximum input power required to raise the temperature of washing water whose amount is approximately 1000 milliliters to approximately 40° C. is 1500 watts.

From the foregoing, the maximum input power of the sum of the respective input powers of the sheathed heaters 505*x* and 505*y* is set to 2500 watts. As a result, in the winter months, an intermediate period, and the summer months, even when the water inlet temperature is either 5° C. or 20° C., washing water having 40° C. suitable for washing of the human body, which is 1000 milliliters per minute, can be formed. As a result, even if the user continuously employs the sanitary washing apparatus 100, washing water having a predetermined temperature of 40° C. can be sprayed, so that hot water can be prevented from being run out of.

Figure 25:
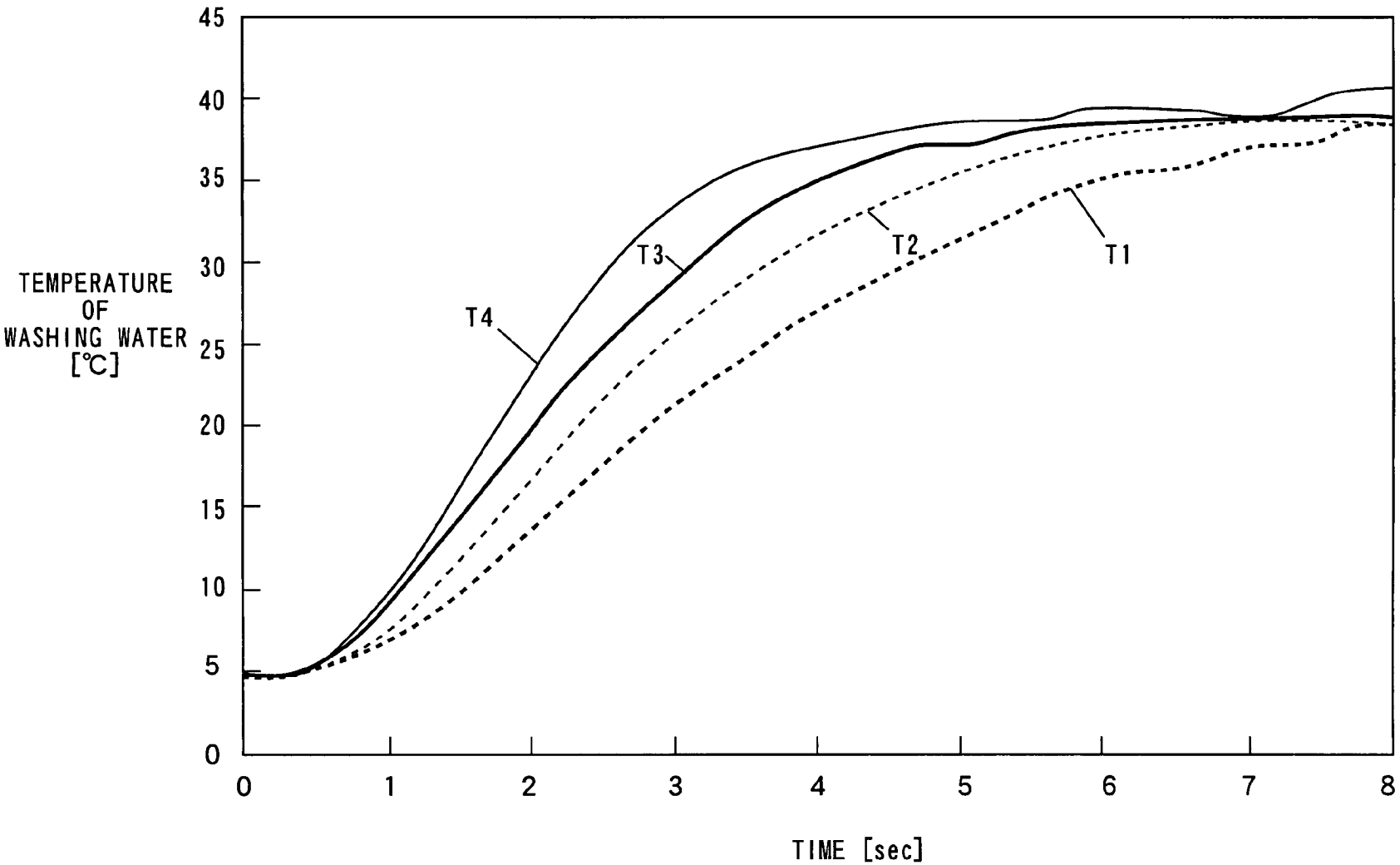
FIG. 25 is a characteristic view showing the rise in temperature of washing water in the fluid heating device according to the third embodiment.
Figure 26:
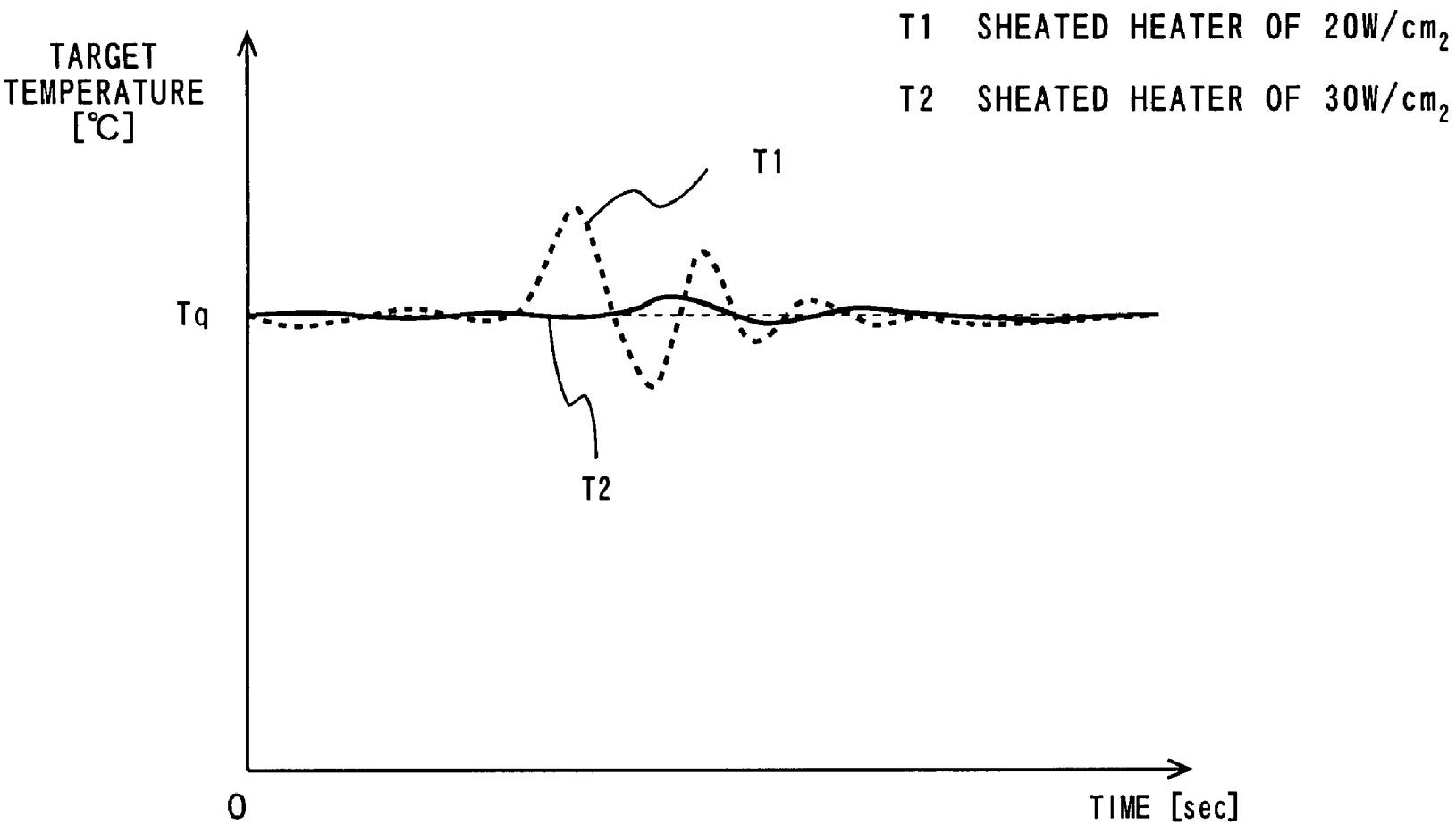
FIG. 26 is a characteristic view showing temperature control response for washing water of the fluid heating device according to the third embodiment.

Then, FIG. 25 is a characteristic view showing the rise in temperature of washing water in the fluid heating device 11*g* according to the third embodiment, and FIG. 26 is a characteristic view showing temperature control response for washing water of the fluid heating device 11*g* according to the third embodiment.

In FIG. 25, the horizontal axis indicates the temperature (° C.) of washing water, and the vertical axis indicates response time (sec). In FIG. 26, the vertical axis indicates the target temperature Tq (° C.), and the horizontal axis indicates response time (sec).

In FIGS. 25 and 26, a dotted line T1 indicates heating properties of a fluid heating device having 20 watts per square centimeter (wattage per square centimeter is referred to as a watt density (W/cm$^2$)), a dotted line T2 indicates heating properties of a fluid heating device having a watt density of 30 (W/cm$^2$), a thick line T3 indicates heating properties of a fluid heating device having a watt density of 38 (W/cm$^2$), and a thick line T4 indicates heating properties of a fluid heating device having a watt density of 50 (W/cm$^2$). The detailed definition of the watt density will be described later.

As shown in FIG. 25, as the watt density as the heating properties of the fluid heating device increases, the temperature of washing water can be raised in a short time. A maximum of approximately 8 K can be raised for one second in the fluid heating device having as heating properties a watt density of 20 (W/cm$^2$), as indicated by the dotted line T1, a maximum of approximately 10 K can be raised for one second in the fluid heating device having as heating properties a watt density of 30 (W/cm$^2$), as indicated by the dotted line T2, a maximum of approximately 12 K can be raised for one second in the fluid heating device having as heating properties a watt density of 38 (W/cm$^2$), as indicated by the solid line T3, and a maximum of approximately 14 K can be raised for one second in the fluid heating device having as heating properties a watt density of 50 (W/cm$^2$), as indicated by the solid line T4.

As indicated by the dotted line T1 in FIG. 26, overshoot and undershoot appear in temperature control response for washing water of the fluid heating device having as heating properties a watt density of 20 (W/cm$^2$). The temperature control response for washing water indicated by the dotted line T1 indicates that thermal response of a sheathed heater is low. This is considered to be due to the fact that the respective heat capacities of a sheathed pipe 505*a* and insulating powder 505*c* are relatively higher than the heat capacities of heater wires 505*b* in the sheathed heaters 505*x* and 505*y*. As a result, the fluid heating device having as heating properties a watt density of 20 watts is difficult to heat and cool. Therefore, it is not suitable for heating of stable washing water whose variation width is not more than approximately 1° C.

On the other hand, as indicated by the dotted line T2, no overshoot and undershoot appear in temperature control response for washing water of the fluid heating device having as heating properties a watt density of 30 (W/cm$^2$) . The temperature control response for washing water indicated by the dotted line T2 indicates that thermal response of a sheathed heater is fast. As a result, the fluid heating device having as heating properties a watt density of 30 (W/cm$^2$) is suitable for heating of stable washing water whose variation width is approximately 1° C. Consequently, it is a fluid heating device having as heating properties a watt density of not less than 30 (W/cm$^2$) that can quickly control the temperature of washing water to one desired by a user.

It is possible to manufacture a fluid heating device having as heating properties a watt density of not less than 50 (W/cm$^2$). As a result of a life duration test, however, a life time period of approximately 10 years to be a target is not easy to ensure, and the heater wires 505*a* in the sheathed heaters 505*x* and 505*y* may be fractured in a short time in the fluid heating device having as heating properties a watt density of not less than 50 (W/cm$^2$).

Here, the watt density will be described using FIG. 5. The watt density is a value that is power applied between the terminals 506 and 507 of the sheathed heater 505 divided by the surface area of the sheathed pipe 505*a* in the heater effective length L1, that is, power per unit surface area in the heater effective length L1. For example, the watt density (W/cm$^2$) in a case where the sheathed pipe 505*a* is in a columnar shape is a value that is power (W) applied between the terminals 506 and 507 divided by the result of multiplication of the diameter ϕh (cm) of the sheathed pipe 505*a*, the heater effective length L1 (cm), and n.

The user operates the remote control device 300*b* so that the temperature of washing water, the flow rate of washing water, the water inlet temperature, or the like is changed. In this case, the controller 4 automatically adjusts power applied to the sheathed heaters 505*x* and 505*y*. As a result, the watt densities of the sheathed heaters 505*x* and 505*y* are increased or decreased. Consequently, the watt density in the foregoing description means a watt density in a case where power applied to the sheathed heaters 505*x* and 505*y* reaches its maximum in order to change the temperature of washing water to a set temperature.

In the sheathed heaters 505, 505*x*, and 505*y* having a watt density of 30 (W/cm$^2$), the allowable watt density is several times an allowable watt density of approximately 4 to 8 (W/cm$^2$) in each company. The allowable watt density is determined from the viewpoint of heater life.

In the present embodiment, the sheathed heaters 505*x* and 505*y* whose total calorific value is large instead of suitably setting conditions such as the thickness of the heater wires in the sheathed heaters 505*x* and 505*y*, the winding diameter of the heater wires formed in a spiral shape, and the winding pitch to keep the unit length or the average temperature per unit volume of the heater wires relatively low are developed, to manufacture the fluid heating devices 11*a*, 11*b*, 11*c*, and 11*d* that have long life, are low in heat capacity, and are superior in thermal response.

Consequently, the speed of washing water flowing in the flow path 510 formed in a spiral shape becomes relatively higher than the speed of washing water linearly flowing along the sheathed heater from the washing water inlet 511 to the washing water outlet 512. As a result, the washing water flows in a high-speed turbulent flow state along the outer peripheral surface of the sheathed heater within the flow path 510, so that the washing water is agitated, which allows heat generated on the outer peripheral surface of the sheathed heater to be efficiently transferred to the whole washing water.

Although in each of the foregoing embodiments, the sheathed heater is employed as the heating element, the present invention is not limited to the same. For example, a ceramic heater may be employed. Although the number of sheathed heaters is set to two, the present invention is not limited to the same. For example, any number of sheathed heaters may be used. Although the shape of the sheathed heater is a cylindrical shape or a columnar shape, the present invention is not limited to the same. For example, the shape may be another arbitrary shape such as a triangular prism shape or a square prism shape.

Fourth Embodiment

A sanitary washing apparatus according to a fourth embodiment will be then described. The sanitary washing apparatus according to the fourth embodiment differs from the sanitary washing apparatus 100 according to the first embodiment in that a fluid heating device 11*h* is provided in place of the fluid heating device 11*a*.

Figure 27:
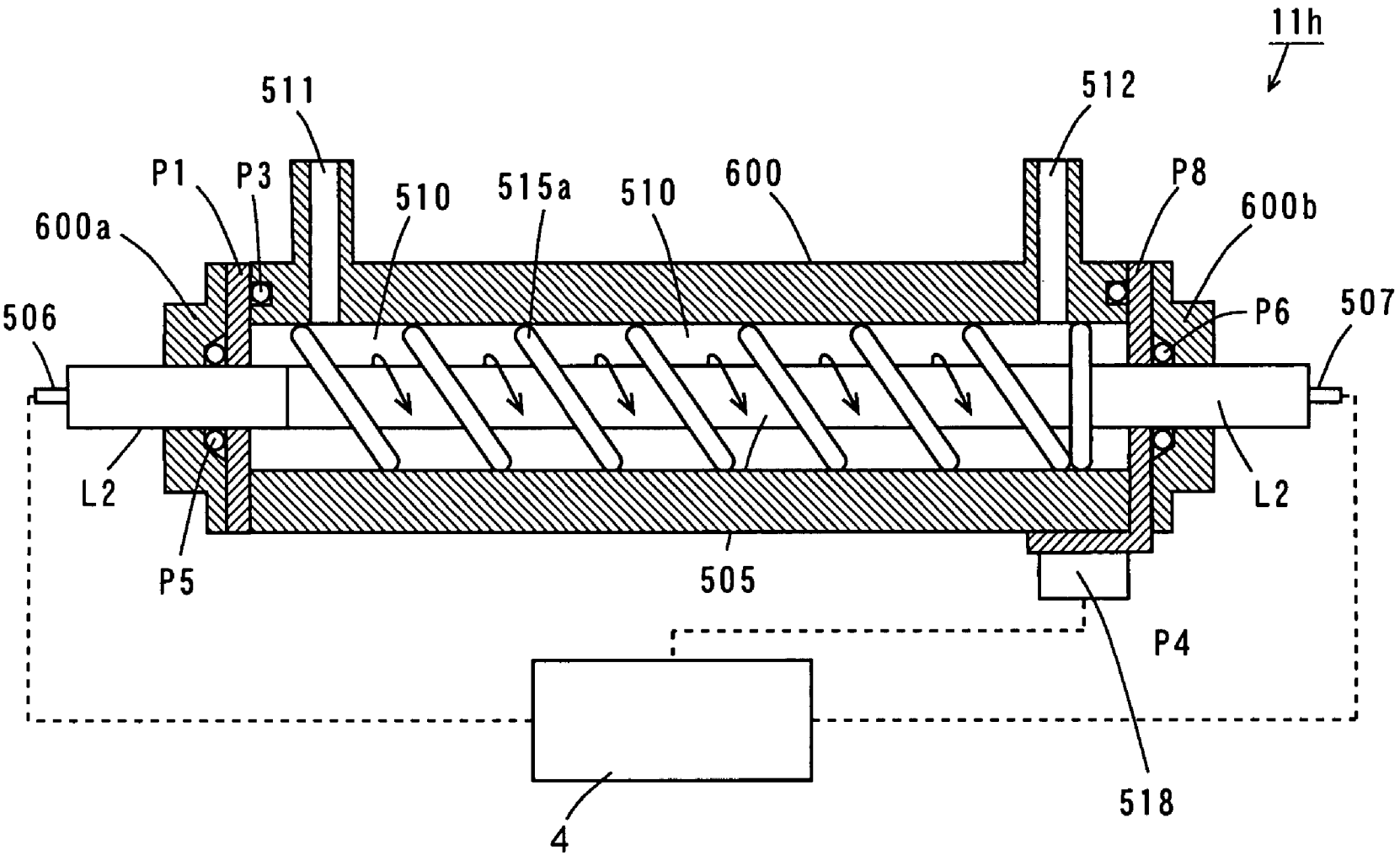
FIG. 27 is a schematic sectional view showing a fluid heating device according to a fourth embodiment.

FIG. 27 is a schematic sectional view showing the fluid heating device 11*h* according to the fourth embodiment.

The fluid heating device 11*h* shown in FIG. 27 comprises a heat sensitive plate P8 and a thermistor 518 in place of the elastic holding member P2 in the fluid heating device 11*a* shown in FIG. 4.

The thermistor 518 is mounted on the heat sensitive plate P8. The heat sensitive plate P8 is composed of copper having high thermal conductivity. The thermistor 518 can accurately detect the temperature of a non-heating portion L2 in a sheathed heater 505 through the heat sensitive plate P8.

The operations of the fluid heating device 11*h* will be then described.

First, washing water is supplied to a washing water inlet 511 in the fluid heating device 11*h*. A controller 4 applies power to terminals 506 and 507 of the sheathed heater 505. Consequently, heat generated in the sheathed heater 505 is supplied to washing water flowing in a flow path 510 formed by the sheathed heater 505, a spring 515*a*, and a case main body 600*a*. The heated washing water flows out of a washing water outlet 512.

In this case, the temperature of the washing water flowing out of the washing water outlet 512 can be presumed from the temperature of the non-heating portion L2 in the sheathed heater 505. Consequently, the controller 4 adjusts power applied to the sheathed heater 505 on the basis of the temperature detected by the thermistor 518. Even if the flow rate of washing water flowing in the flow path 510 varies, therefore, washing water having a predetermined temperature can flow out of the washing water outlet 512.

Even when the flow rate of washing water becomes low, the controller 4 adjusts the power applied to the sheathed heater 505 on the basis of the gradient of the rise in temperature detected from the thermistor 518, so that the temperature of the sheathed heater 505 can be prevented from being greatly raised, which allows a fault in the fluid washing apparatus 11*h* itself to be prevented. As a result, the safety can be improved.

Even in a case where the flow rate of washing water becomes low so that the washing water stays, the temperature of the thermistor 518 can be prevented from being raised, not to generate a scale on a surface of the sheathed heater 505.

The fluid heating device 11*h* shown in FIG. 27 is an instantaneous fluid heating device that raises washing water with a required flow rate to a predetermined temperature in a short time, so that it can realize lower cost and reduction in power consumption, as compared with a hot water storage type fluid heating device that previously heats and holds washing water.

As described in the foregoing, in the fourth embodiment, the thermistor 518 and the non-heating portion L2 in the sheathed heater 505 (see FIG. 5) are brought into contact with each other through the heat sensitive plate P8, so that the heat sensitive plate P8 does not inhibit the flow of washing water and the assembling properties of the fluid heating device 11*h*. Further, temperature control and measures against boil-dry of washing water can be carried out by providing the heat sensitive plate P8 and the thermistor 518 to suitably detect the temperature of the sheathed heater 14.

The speed of washing water flowing in the flow path 510 formed in a spiral shape in the fluid heating device 11*h* becomes relatively higher than the speed of washing water linearly flowing along the sheathed heater 505 from the washing water inlet 511 to the washing water outlet 512. As a result, the washing water flows in a high-speed turbulent flow state along an outer peripheral surface of the sheathed heater 505 within the flow path 510, so that the washing water is agitated, which allows heat generated on the outer peripheral surface of the sheathed heater 505 to be efficiently transferred to the whole washing water.

Furthermore, even when the cross-sectional shape of the fluid heating device 11*h* is formed of a circular or elliptical curved surface, for example, the thermistor 518 can be easily mounted on the heat sensitive plate P8 by being fixed thereto. As a result, the heating temperature of the fluid heating device 11*h* can be accurately detected.

Furthermore, in the fluid heating device 11*h*, the heat sensitive plate P8 is composed of copper, and the sheathed heater 505 is also composed of copper of the same material, which allows easy brazing.

Since the heat sensitive plate P8 composed of copper has particularly superior thermal conductivity and long-term usable corrosion resistance, the temperature of the sheathed heater 505 can be quickly and accurately transmitted to the thermistor 518 over a long time period.

The material for the heat sensitive plate P8 is not limited to copper. Even when the material for a sheathed pipe 505*a* in the sheathed heater 505 is changed, the material for the heat sensitive plate P8 may be changed such that brazing becomes easy depending on the material for the sheathed pipe 505*a*. Even when the sheathed pipe 505*a* is formed of stainless steel, for example, the material for the heat sensitive plate P8 may be stainless steel.

Figure 28:
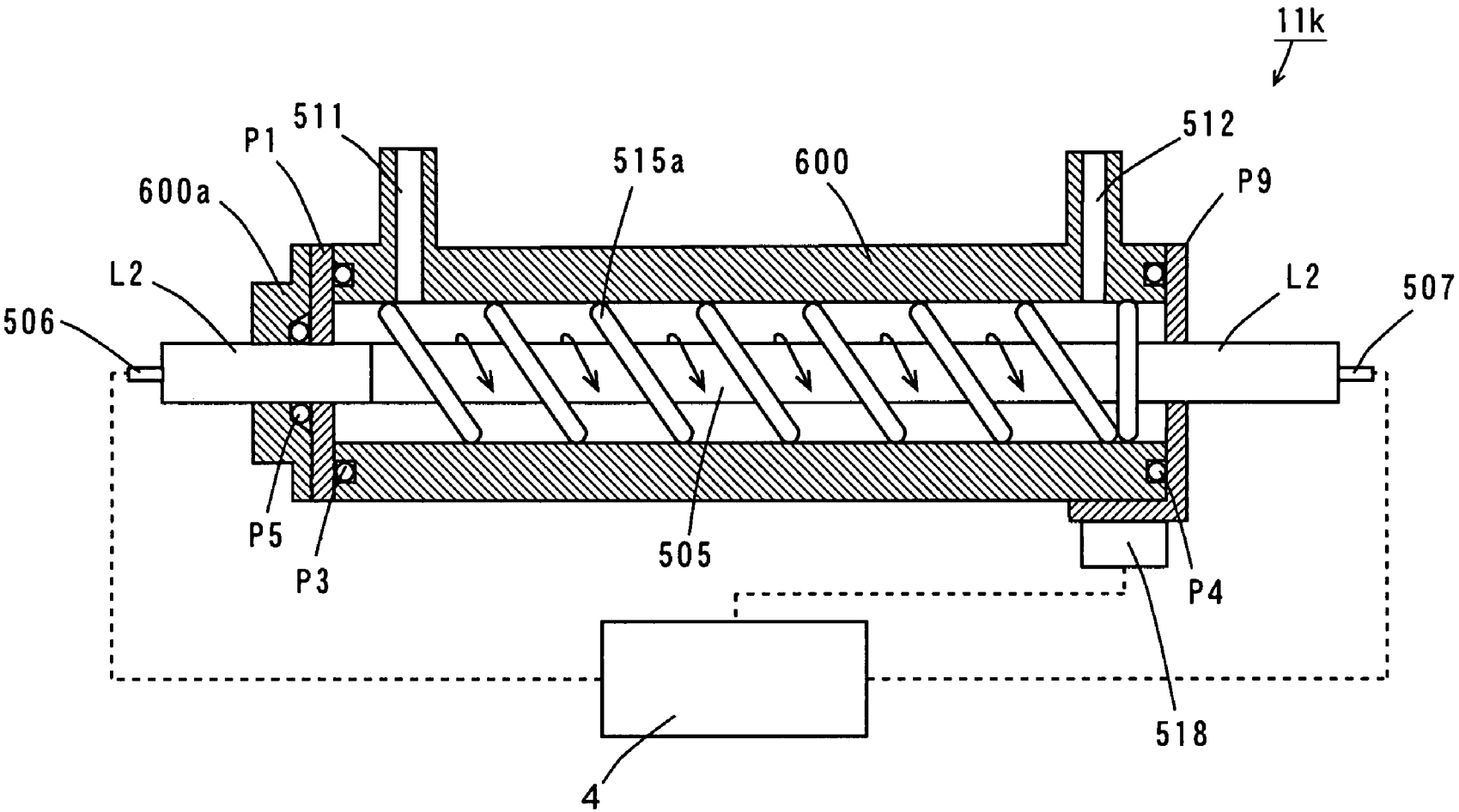
FIG. 28 is a schematic sectional view showing another example of the fluid heating device.

FIG. 28 is a schematic sectional view showing another example of the fluid heating device.

A fluid heating device ilk shown in FIG. 28 differs in configuration from the fluid heating device 11*h* shown in FIG. 27 in that an end surface holding member 600*b* is not provided.

A heat sensitive plate P8 is brazed to a non-heating portion L2 in a sheathed heater 505 and one end of a case main body 600. Consequently, washing water can be prevented from leaking out of a joint of an end surface of the case main body 600 and the heat sensitive plate P8. As a result, in the fluid heating device 11*k*, the necessity of the end surface holding member 600*b* is eliminated, whereby it is possible to reduce the number of components and to improve cost properties and assembling properties.

Figure 29:
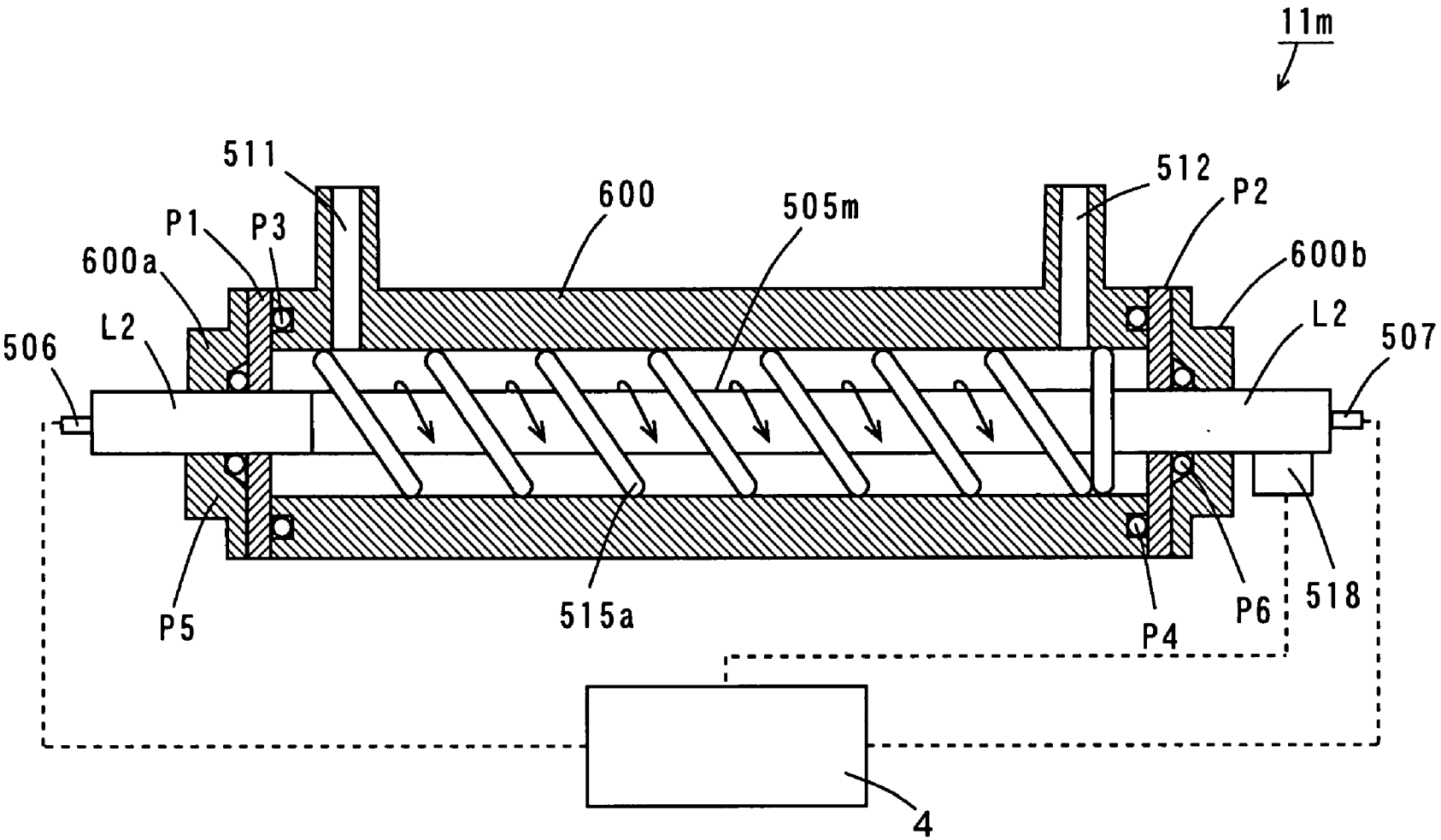
FIG. 29 is a schematic sectional view showing still another example of the fluid heating device.
Figure 30:
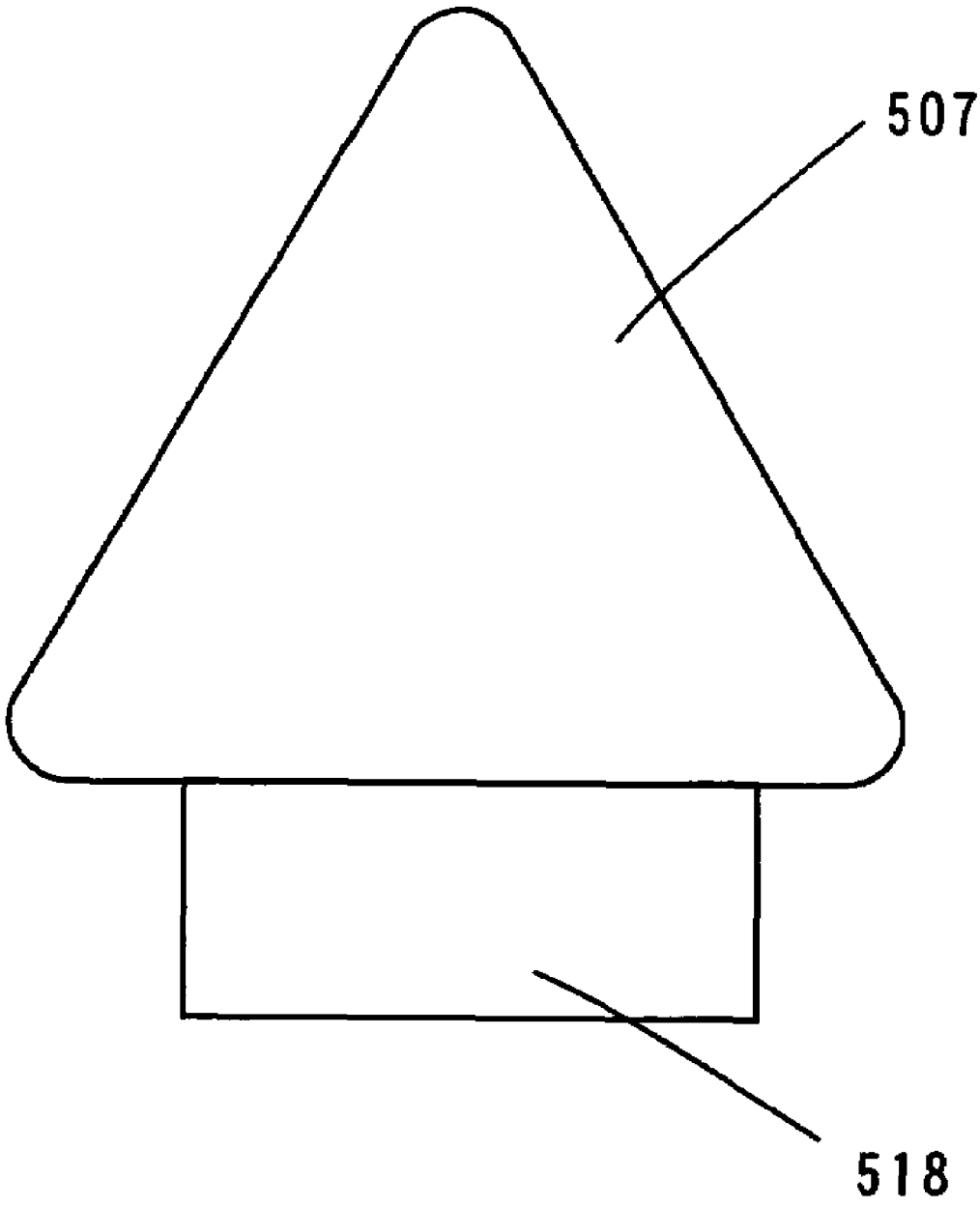
FIG. 30 is a side view of the fluid heating device shown in FIG. 29.

FIG. 29 is a schematic sectional view showing still another example of the fluid heating device, and FIG. 30 is a side view of the fluid heating device shown in FIG. 29.

A fluid heating device 11*m* shown in FIG. 29 differs from the fluid heating device 11*h* shown in FIG. 27 in that a sheathed heater 505*m*, which is triangular in cross section, is provided in place of the cylindrical sheathed heater 505 and an elastic holding member P2 is provided in place of the heat sensitive plate P8.

As shown in FIGS. 29 and 30, a thermistor 518 is mounted on one surface of a terminal 507 of a non-heating portion L2 in the sheathed heater 505*m*, which is triangular in cross section, without using the heat sensitive plate P8. As a result, the number of components can be reduced to improve cost properties and assembling properties, and the heating temperature of the fluid heating device 11*m* can be accurately detected.

Fifth Embodiment

A sanitary washing apparatus according to a fifth embodiment will be then described. The sanitary washing apparatus according to the fifth embodiment differs from the sanitary washing apparatus 100 according to the first embodiment in that a fluid heating device 11*p* is provided in place of the fluid heating device 11*a*.

Figure 31:
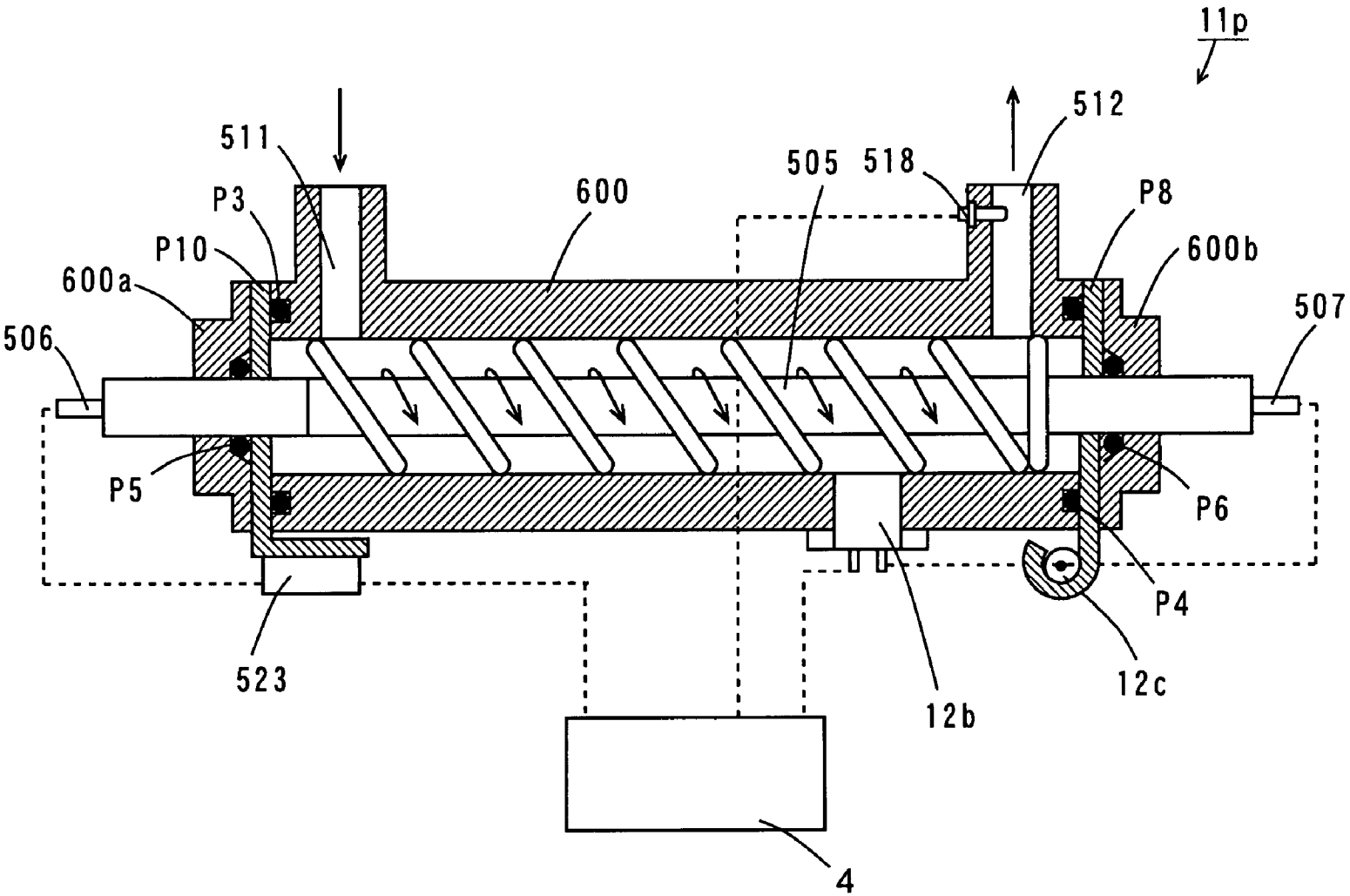
FIG. 31 is a schematic sectional view showing the fluid heating device according to the fourth embodiment.

FIG. 31 is a schematic sectional view showing the fluid heating device 11*p* according to the fourth embodiment.

The fluid heating device 11*p* comprises a heat transfer plate P10 and a triac element 523 in place of the elastic holding member P1 in the fluid heating device 11*a* shown in FIG. 4, comprises a heat sensitive plate P8 and a temperature fuse 12*c* in place of the elastic holding member P2, and further comprises a temperature sensor 12*b* and a thermistor 518.

The heat transfer plate P10 is provided so as to directly come into direct contact with washing water supplied to the washing water inlet 511 shown in FIG. 31. The heat transfer plate P10 is composed of copper having high thermal conductivity. The triac element 523 that is a power control element and a heat generating electronic component in a sheathed heater 505 is fastened and fixed to the heat transfer plate P10 by a machine screw.

The heat sensitive plate P8 is provided so as to come into contact with a non-heating portion L2 in the sheathed heater 505. The heat sensitive plate P8 is composed of copper having high thermal conductivity. The heat sensitive plate P8 is provided with the temperature fuse 12*c* for cutting off the supply of power to terminals 506 and 507 of the sheathed heater 505 when the sheathed heater 505 is heated to an abnormal temperature.

The thermistor 518 for detecting the temperature of heated washing water is mounted on a washing water outlet 512 in the fluid heating device 11*p*. The thermistor 518 is connected to a controller 4. The temperature sensor 12*b* that is a temperature switch for mechanically turning on and off an electrical contact at a predetermined temperature for preventing the abnormal rise in temperature of the sheathed heater 505 in the fluid heating device 11*p* even when an electrical fault occurs in the thermistor 518 is provided in the vicinity of the washing water outlet 512.

The operations of the fluid heating device 11*p* will be then described. In a case where washing water is supplied from the washing water inlet 511, the controller 4 applies power to the terminals 506 and 507 of the sheathed heater 505. Consequently, heat generated by the sheathed heater 505 is applied to washing water flowing in the flow path 510, so that the washing water that has been heated to a predetermined temperature flows out of the washing water outlet 512. In this case, the temperature of the washing water flowing out of the washing water outlet 512 is detected by the thermistor 518. The thermistor 518 transmits the detected temperature of the washing water as a signal to the controller 4. The controller 4 receives the signal from the thermistor 518, to control power to the sheathed heater 505 through the triac element 523 such that the temperature of the washing water flowing out of the washing water outlet 512 reaches the predetermined temperature.

As described in the foregoing, the triac element 523 that is a power control element and a heat generating electronic component generates heat when power is applied to the terminals 506 and 507 of the sheathed heater 505. Consequently, the rise in temperature of the triac element 523 itself can be restrained by bringing the heat sensitive plate P8 to which the triac element 523 is fixed into contact with washing water having a low temperature flowing in the washing water inlet 511.

In the fluid heating device 11*p*, the water cooling effect of the triac element 523 that is a heat generating electronic component can be thus ensured, whereby a fault in the heat generating electronic component mounted on the heat transfer plate P10 can be prevented. Further, the heat transfer plate P10 can be used for both preventing leakage of washing water and radiating heat from the triac element 523.

The speed of washing water flowing in a flow path 510 formed in a spiral shape in the fluid heating device 11*p* becomes relatively higher than the speed of washing water linearly flowing along the sheathed heater 505 from the washing water inlet 511 to the washing water outlet 512. As a result, the washing water flows in a high-speed turbulent flow state along an outer peripheral surface of the sheathed heater 505 within the flow path 510, so that the washing water is agitated, which allows heat generated on the outer peripheral surface of the sheathed heater 505 to be efficiently transferred to the whole washing water.

Furthermore, the heat transfer plate P10 comes into contact with washing water having a low temperature that has not been heated by the sheathed heater 550 by providing the heat transfer plate P10 to which the triac element 523 is fixed in the vicinity of the washing water inlet 511 in the fluid heating device 11*p*, so that heat generated by the triac element 523 is efficiently applied to the washing water through the heat transfer plate P10.

The controller 4 controls the supply of power to the terminals 506 and 507 of the sheathed heater 505 on the basis of the signal detected by the thermistor 518, whereby the washing water having a predetermined temperature can be caused to flow out of the washing water outlet 512 even if the flow rate of the washing water flowing in the fluid heating device 11*p* varies. Thus, the fluid heating device 11*p* shown in FIG. 31 is an instantaneous fluid heating device. Therefore, it is possible to achieve lower cost and reduction in power consumption, as compared with those in the hot water storage type fluid heating device.

Even in a case where an electrical fault occurs in the thermistor 518, the temperature sensor 12*b* for mechanically turning on and off the electrical contact at a predetermined temperature is provided in the vicinity of the washing water outlet 512 in the fluid heating device 11*p*. Even in a case where an electrical fault occurs in the thermistor 518, therefore, the electrical contact in the temperature sensor 12*b* enters a mechanically opened state when washing water is heated to not less than the predetermined temperature, so that the supply of power to the terminals 506 and 507 of the sheathed heater 505 is cut off.

Furthermore, the heat sensitive plate P8 on the side of the washing water outlet 512 in the fluid heating device 11*p* is provided with the temperature fuse 12*c*. Even when the thermistor 518 and the temperature sensor 12*b* respectively develop faults, therefore, the supply of power to the terminals 506 and 507 of the sheathed heater 505 is cut off by the temperature fuse 12 when the temperature of washing water reaches not less than a predetermined temperature.

The fluid heating device 11*p* can radiate heat generated by the triac element 523 to washing water through the heat transfer plate P10, and can detect abnormal heating of the sheathed heater 505 and washing water through the heat sensitive plate P8, whereby it is possible to reliably prevent a fault in the triac element 523 as well as cutting off the supply of power to the terminals 506 and 507 of the sheathed heater 505 at the time of abnormal heating of the fluid heating device 11*p* to ensure safety.

Although the heat sensitive plate P8 and the heat transfer plate P10 in the fluid heating device 11*p* are composed of copper, the present invention is not limited to the same. For example, they may be composed of another arbitrary metal. As a result, it is possible to ensure thermal conductivity required to radiate heat generated by the triac element 523 and mechanical strength required to prevent leakage of washing water.

Furthermore, even when the heat sensitive plate P8 and the heat transfer plate P10 in the fluid heating device 11*p* are composed of copper, long-term usable corrosion resistance and particularly superior thermal conductivity can be obtained.

The heat sensitive plate P8 and the heat transfer plate P10 in the fluid heating device 11*p* are formed in a substantially L shape, so that there is no large projection toward the outside of the fluid heating device 11*p*, whereby it is feasible to miniaturize the fluid heating device 11*p*.

Furthermore, it is possible to realize sanitary washing apparatuses 100 using the fluid heating devices 11*a* and 11*p* that can be miniaturized and have high heat exchange efficiency. Consequently, washing water having a temperature that is comfortable for the human body can be sprayed.

Although in the first to fifth embodiments, washing water is heated using the sheathed heater 505, the present invention is not limited to the sheathed heater. Another arbitrary heating device, for example, a ceramic heater may be used.

Although in the first to fifth embodiments, the case main body 600 corresponds to a case member, the sheathed heater 505 corresponds to a heating element, the flow paths 510, 522, 523, 524, 527, 528, 529, 530, and 531 correspond to a flow path, the spring 515*a* to 515*e* correspond to a spiral spring, a turbulent flow generation mechanism, and a spiral member, the washing water inlet 511 corresponds to a fluid inlet and a cylindrical fluid inlet, the washing water outlet 512 corresponds to a fluid outlet and a cylindrical fluid outlet, the thermistor 518 corresponds to a temperature detector, the controller 4 corresponds to a control device, the heat sensitive plate P8 corresponds to a heat sensitive plate, the heat transfer plate P10 corresponds to a thermal transfer member, the triac element 523 corresponds to a heat generating electronic component, and the nozzle unit 30 corresponds to a spray device.

Sixth Embodiment

A clothes washing apparatus comprising a fluid heating device according to a sixth embodiment of the present invention will be described.

Figure 32:
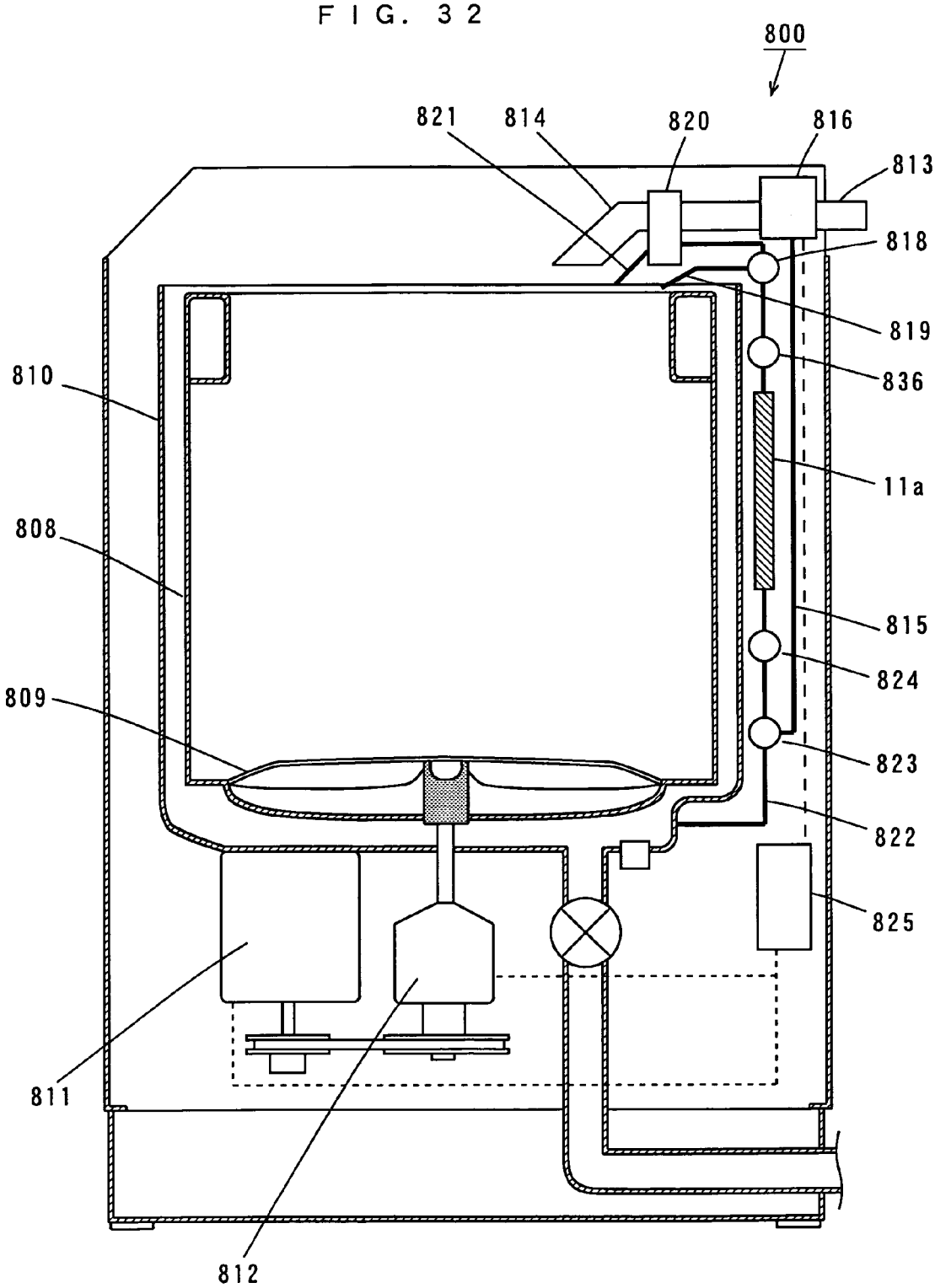
FIG. 32 is a schematic sectional view showing an example of a clothes washing apparatus using the fluid heating device according to the embodiment of the present invention.

FIG. 32 is a schematic sectional view showing an example of the clothes washing apparatus using the fluid heating device according to the embodiment of the present invention. The fluid heating device used in the clothes washing apparatus has the same configuration as the fluid heating device 11*a* shown in FIG. 4.

First, a driving system in a clothes washing apparatus 800 will be briefly described.

A washing tub 810 is fixed within the clothes washing apparatus 800. An inner tub 808 is provided inside the washing tub 810. The inner tub 808 is provided within the washing tub 810 so as to be rotatable with the vertical direction as its axis. Further, an agitating blade 809 is provided in a lower part of the inner tub 808. The agitating blade 809 is provided so as to be rotatable with the vertical direction as its axis independently of the inner tub 808.

A motor 811 is provided below the washing tub 810. The axis of the motor 811 is connected to a bearing 812 through a rotation transmission mechanism. The bearing 812 is connected so as to be rotatable to either one or both of the agitating blade 809 and the inner tub 808.

Consequently, the motor 811 is rotated depending on an instruction from a controller 825, whereby the bearing 812 is rotated with the vertical direction as its axis, so that either one or both of the agitating blade 809 and the inner tub 808 connected to the bearing 812 is/are selectively rotated.

A path of washing water supplied to the washing tub 810 in the clothes washing apparatus 800 will be then described.

A path of washing water in the clothes washing apparatus 800 mainly comprises a main water path 814, a bypass path 815, a water suction path 822, a hot water path 819, and a detergent/hot water path 821.

Washing water supplied from a water supply source is supplied to the washing tub 810 after flowing in the main water path 814 from a water supply port 813. A switching valve 816 and a detergent inlet port 820 are inserted into the main water path 814. An end of the bypath path 815 is connected to the switching valve 816.

One end of the water suction path 822 is connected to the lower part of the washing tub 810. A water inlet switching valve 823, a pump 824, a fluid heating device 11*a*, and a water temperature detector 836 are inserted in this order into the water suction path 822. The other end of the water suction path 822 is connected to the switching valve 818.

The other end of the bypath path 815 is connected to the water inlet switching valve 823 in the water suction path 822. The hot water path 819 and the detergent/hot water path 821 are connected to the switching valve 818.

Figure 33:
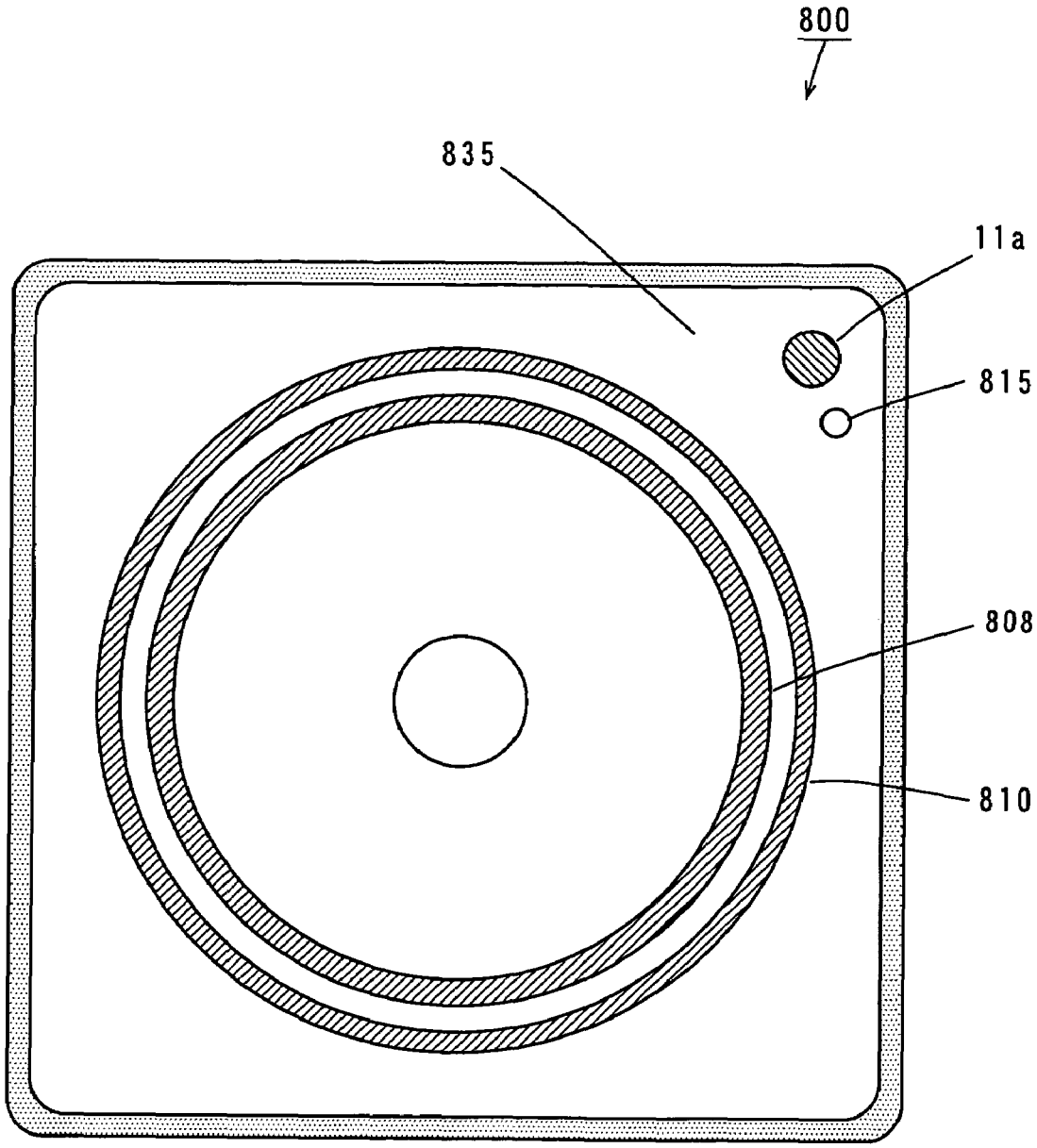
FIG. 33 is a schematic sectional view of the clothes washing apparatus shown in FIG. 32.

Then, FIG. 33 is a schematic sectional view of the clothes washing apparatus 800 shown in FIG. 32.

As shown in FIG. 33, the washing tub 810 and the inner tub 808 in the clothes washing apparatus 800 are provided at the center of the clothes washing apparatus 800. On the other hand, the fluid heating device 11*a* and the bypath path 815 are provided at a corner 835 of the clothes washing apparatus 800.

As shown in FIG. 32, the fluid heating device 11*a* has a vertically long shape so that the fluid heating device 11*a* can be arranged lengthwise at the corner 835 of the clothes washing apparatus 800. Thus, the clothes washing apparatus 800 can be miniaturized.

The speed of washing water flowing in the flow path 510 formed in a spiral shape in the fluid heating device 11*a* becomes relatively higher than the speed of washing water linearly flowing along the sheathed heater 505 from the washing water inlet 511 to the washing water outlet 512. As a result, the washing water flows in a high-speed turbulent flow state along an outer peripheral surface of the sheathed heater 505 within the flow path 510, so that the washing water is agitated, which allows heat generated on the outer peripheral surface of the sheathed heater 505 to be efficiently transferred to the whole washing water. Consequently, it is possible to supply washing water having a temperature at which a detergent can be dissolved.

The specific operations of the clothes washing apparatus 800 in a case where washing is done using hot water will be then described.

Figure 34:
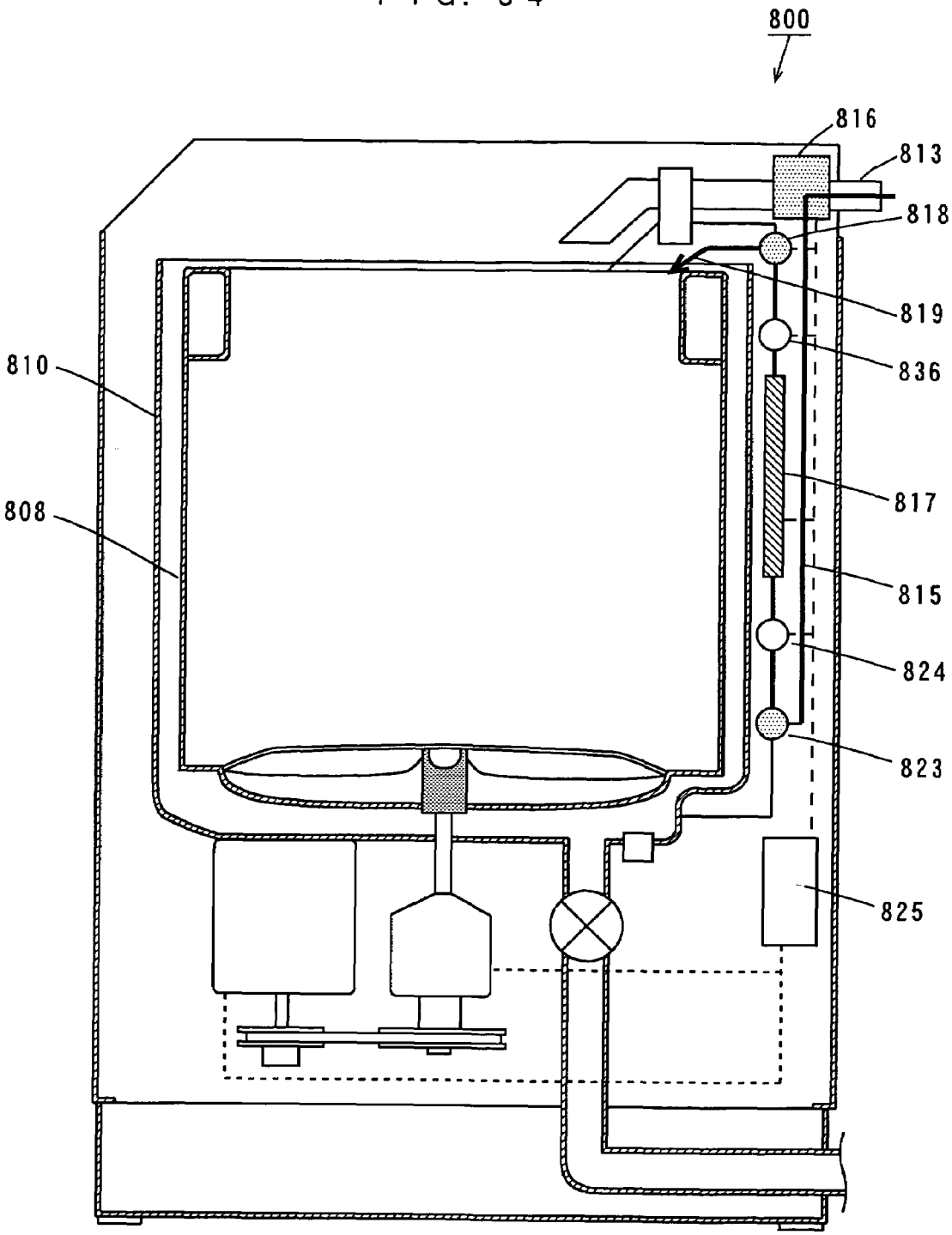
FIG. 34 is a diagram showing a path of washing water in a case where washing water supplied from a water supply port is heated by a fluid heating device and supplied to a washing tub.

FIG. 34 is a diagram showing a path of washing water in a case where washing water supplied from the water supply port 813 is heated by the fluid heating device 11*a* and supplied to the washing tub 810. The path of washing water is indicated by a thick line.

The controller 825 issues an instruction to the switching valve 816, the switching valve 818, and the water inlet switching valve 823. The switching valve 816 is switched such that washing water flows in the bypath path 815 depending on the instruction from the controller 825. The water inlet switching valve 823 is switched such that washing water flows from the bypath path 815 to the water suction path 822 depending on the instruction from the controller 825. The switching valve 818 is switched such that washing water flows from the water suction path 822 to the hot water path 819 depending on the instruction from the controller 825.

The controller 825 issues an instruction to drive the pump 824. Washing water is drawn by the action of the pump 824. The controller 825 applies power to the sheathed heater 505 in the fluid heating device 11*a*.

Consequently, washing water supplied from the water supply port 813 is supplied to the washing tub 810 after flowing in the bypath path 815, the water suction path 822, the pump 824, and the fluid heating device 11*a* in this order. In this case, the washing water supplied from the water supply port 813 is heated to the most suitable temperature by the fluid heating device 11*a*.

The specific operations of the clothes washing apparatus 800 in a case where washing water supplied to the washing tub 810 is heated once and supplied to the washing tub 810 will be then described.

Figure 35:
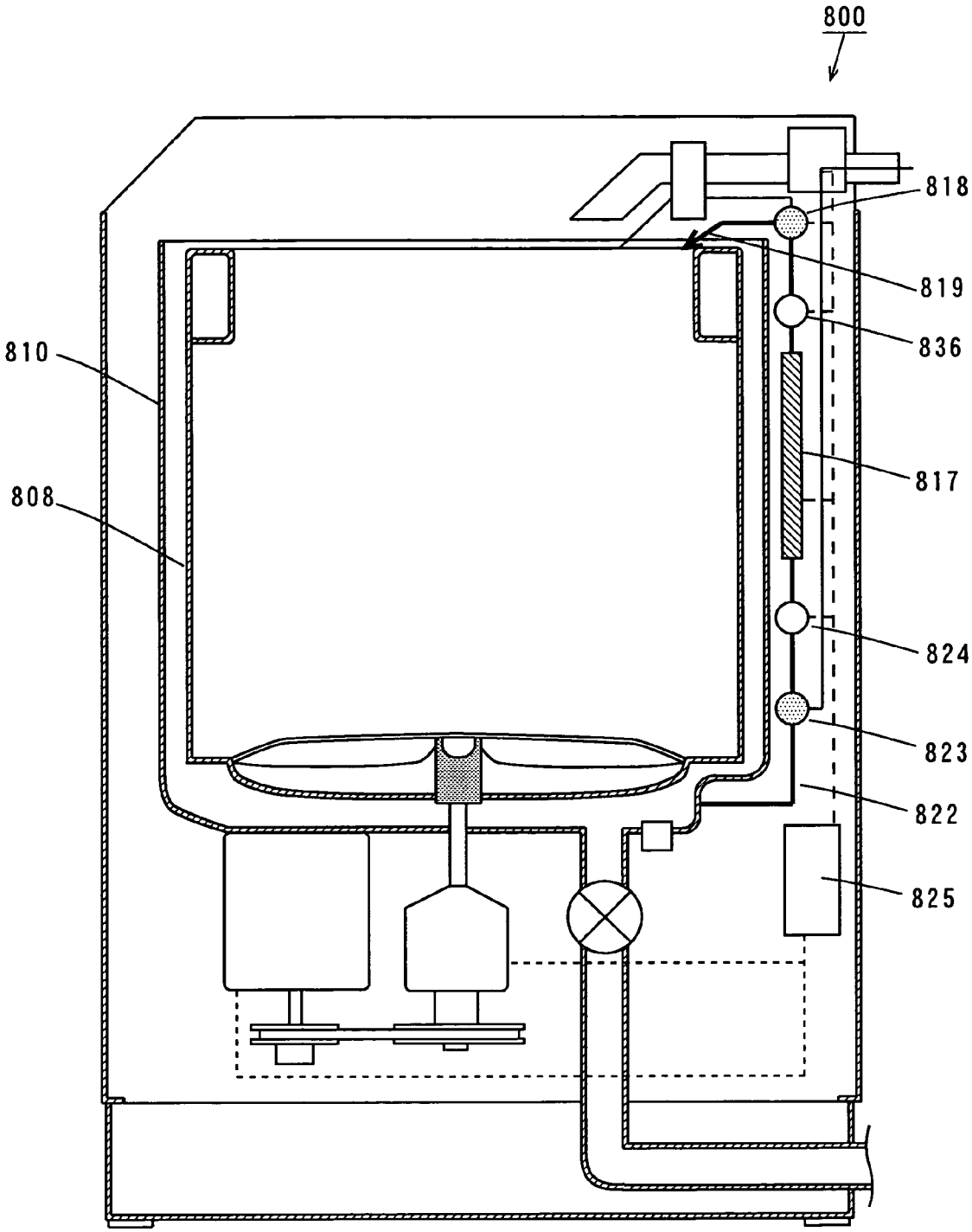
FIG. 35 is a diagram showing a path of washing water in a case where washing water supplied to a washing tub is heated once and supplied to the washing tub.

FIG. 35 is a diagram showing a path of washing water in a case where washing water supplied to the washing tub 810 is heated once and supplied to the washing tub 810. The path of washing water is indicated by a thick line.

The controller 825 issues an instruction to the switching valve 818 and the water inlet switching valve 823. The water inlet switching valve 823 is switched such that washing water flows from the washing tub 810 to the water suction path 822 depending on the instruction from the controller 825. The switching valve 818 is switched such that washing water flows from the water suction path 822 to the hot water path 819 depending on the instruction from the controller 825.

The controller 825 issues an instruction to drive the pump 824. Washing water is drawn by the action of the pump 824. The controller 825 applies power to the sheathed heater 505 in the fluid heating device 11*a*.

Consequently, washing water drawn by suction from the washing tub 810 is supplied to the washing tub 810 again after flowing in the suction path 822, the pump 824, and the fluid heating device 11*a* in this order. In this case, the washing water is heated to the most suitable temperature by the fluid heating device 11*a*.

The specific operations of the clothes washing apparatus 800 in a case where hot water having a detergent added thereto is supplied to the washing tub 810 will be then described.

Figure 36:
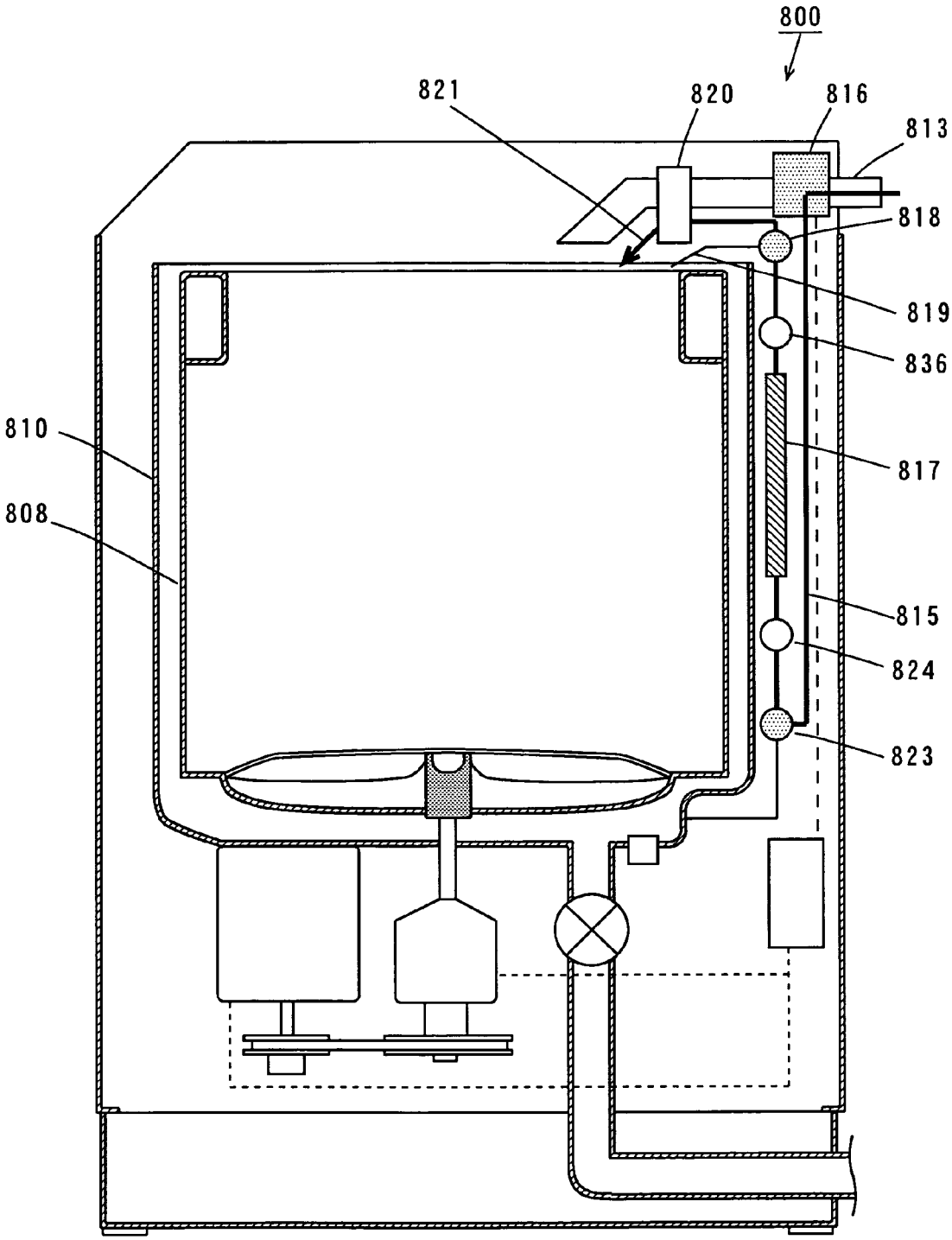
FIG. 36 is a diagram showing a path of washing water in a case where hot water having a detergent added thereto is supplied to a washing tub.

FIG. 36 is a diagram showing a path of washing water in a case where hot water having a detergent added thereto is supplied to the washing tub 810. The path of washing water is indicated by a thick line.

The controller 825 issues an instruction to the switching valve 816, the switching valve 818, and the water inlet switching valve 823. The switching valve 816 is switched such that washing water flows in the bypath path 815 depending on the instruction from the controller 825. The water inlet switching valve 823 is switched such that washing water flows from the bypath path 815 to the water suction path 822 depending on the instruction from the controller 825. The switching valve 818 is switched such that washing water flows from the water suction path 822 to the detergent/hot water path 819 depending on the instruction from the controller 825.

The controller 825 issues an instruction to drive the pump 824. Washing water is drawn by the action of the pump 824. The controller 825 applies power to the sheathed heater 505 in the fluid heating device 11*a*.

Consequently, the washing water supplied from the water supply port 813 is supplied to the washing tub 810 after flowing in the bypath path 815, the water suction path 822, the pump 824, the fluid heating device 11*a*, and the detergent inlet port 820 in this order. In this case, the washing water supplied from the water supply port 813 is heated to the most suitable temperature by the fluid heating device 11*a*, and the detergent is dissolved by the heated washing water.

Finally, description is made of a case where clear water is supplied to the washing tub 810 in the clothes washing apparatus 800.

Figure 37:
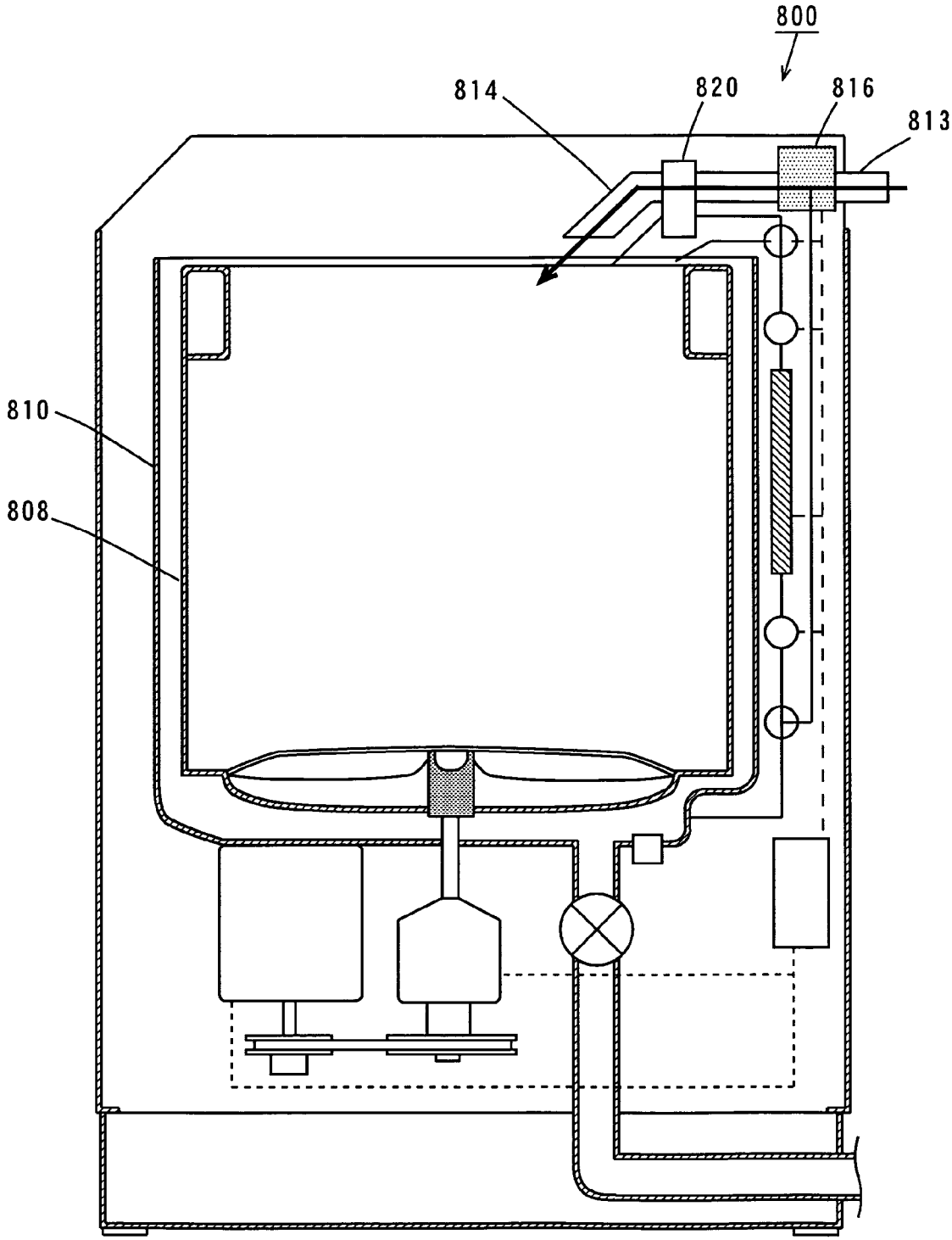
FIG. 37 is a diagram showing a path of washing water in a case where clear water is supplied to a washing tub in the clothes washing apparatus.

FIG. 37 is a diagram showing a path of washing water in a case where clear water is supplied to the washing tub 810 in the clothes washing apparatus 800. The flow of washing water is indicated by a thick line.

The controller 825 issues an instruction to the switching valve 816. The switching valve 816 is switched such that washing water flows in the main water path 814 depending on the instruction from the controller 825.

Thus, washing water supplied from the water supply port 813 is supplied to the washing tub 810 after flowing through the main water path 814 and the detergent inlet port 820 in this order. In this case, the detergent is dissolved by the washing water supplied from the water supply port 813.

Figure 38:
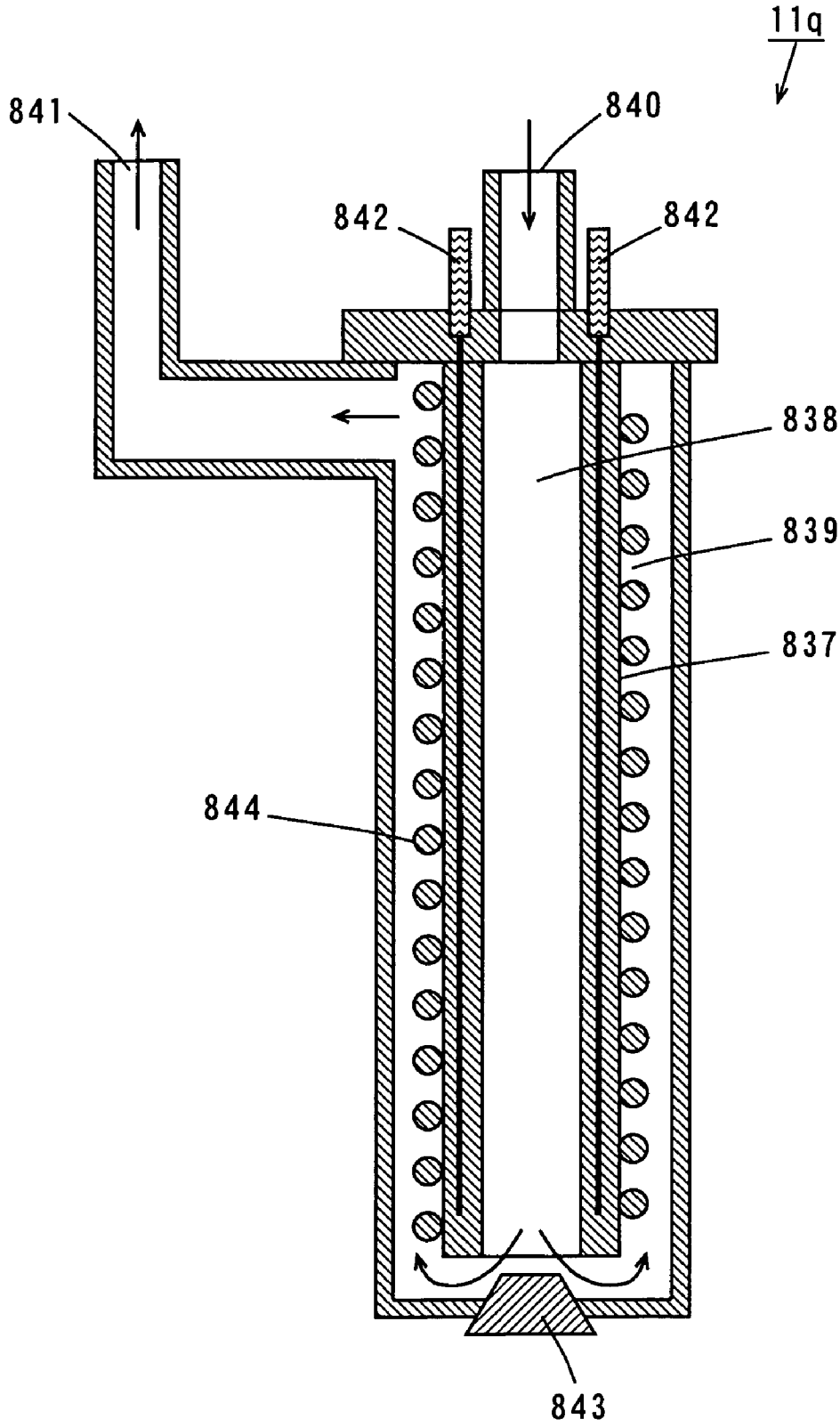
FIG. 38 is a schematic sectional view showing another example of the fluid heating device used for the clothes washing apparatus.
Figure 39:
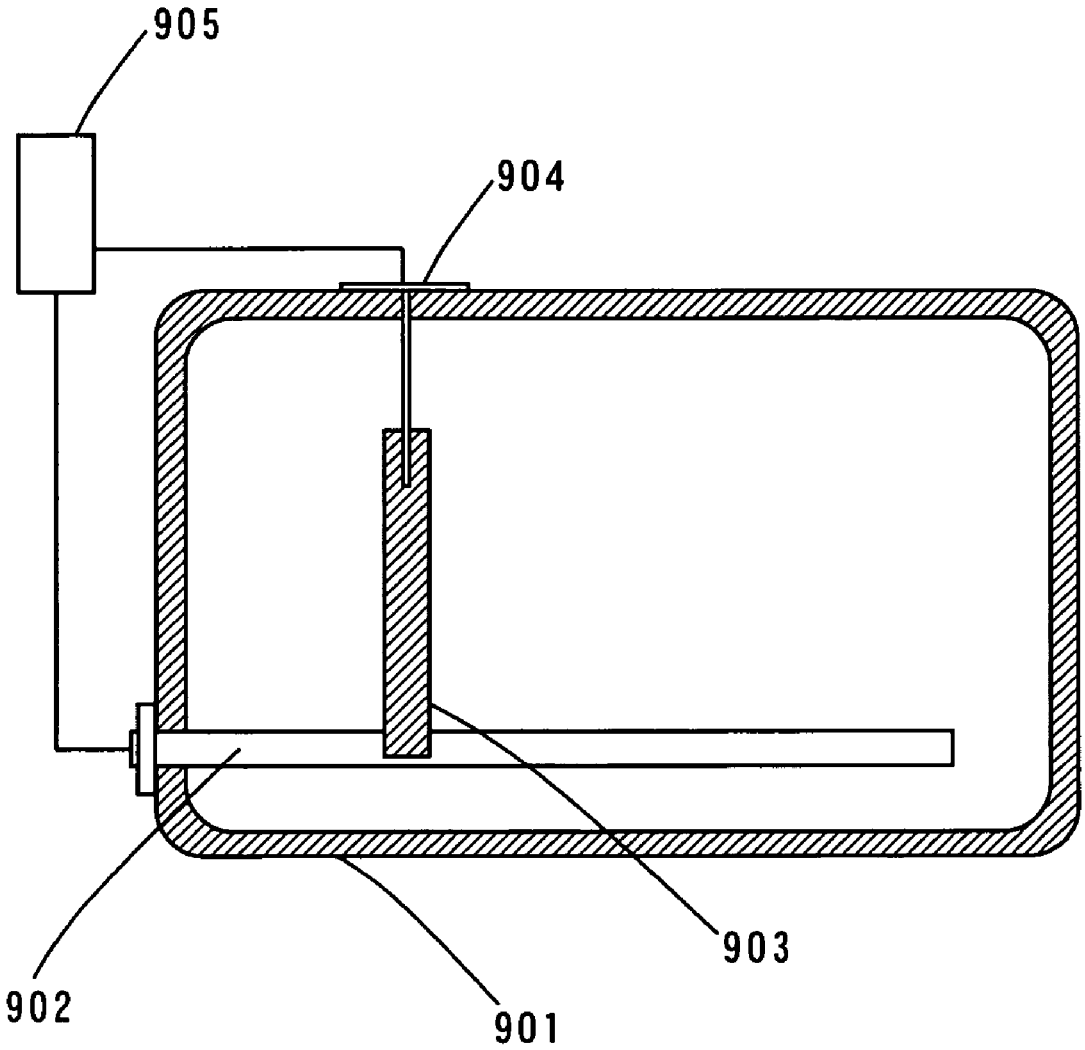
FIG. 39 PRIOR ART
FIG. 39 is a schematic sectional view of a hot water tank unit in a conventional hot water storage type sanitary washing apparatus.
Figure 40:
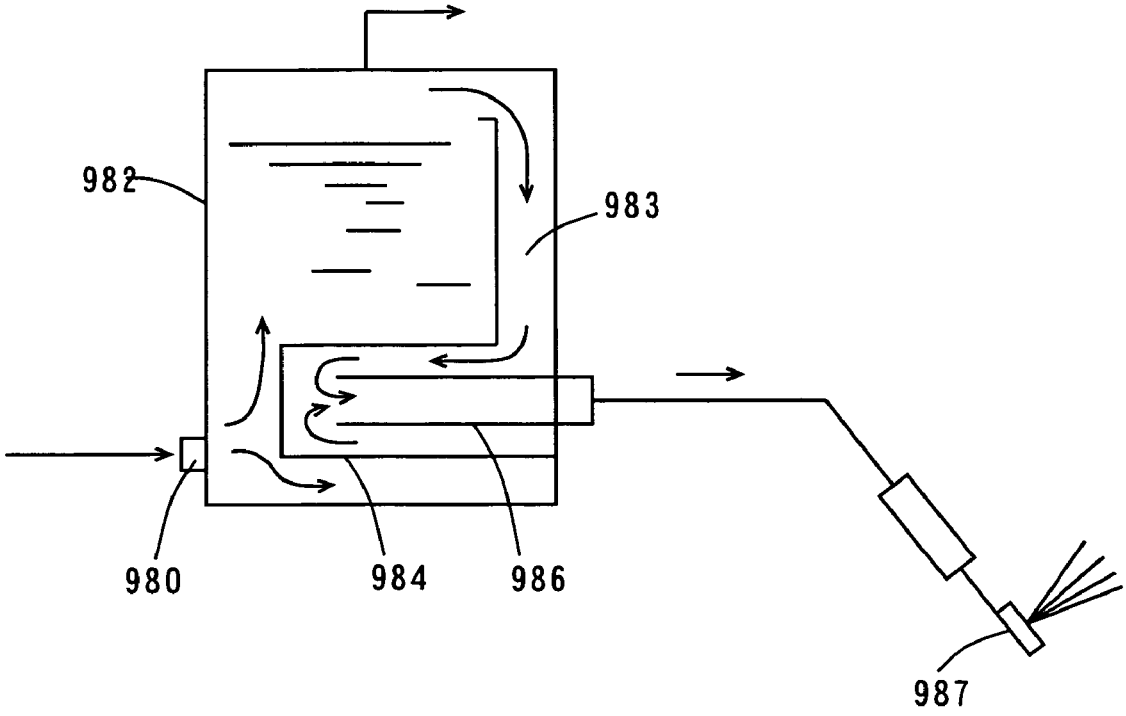
FIG. 40 PRIOR ART
FIG. 40 is a schematic view of a conventional heating device having both the respective configurations of a hot water storage type sanitary washing apparatus and an instantaneous heating device.
Figure 41:
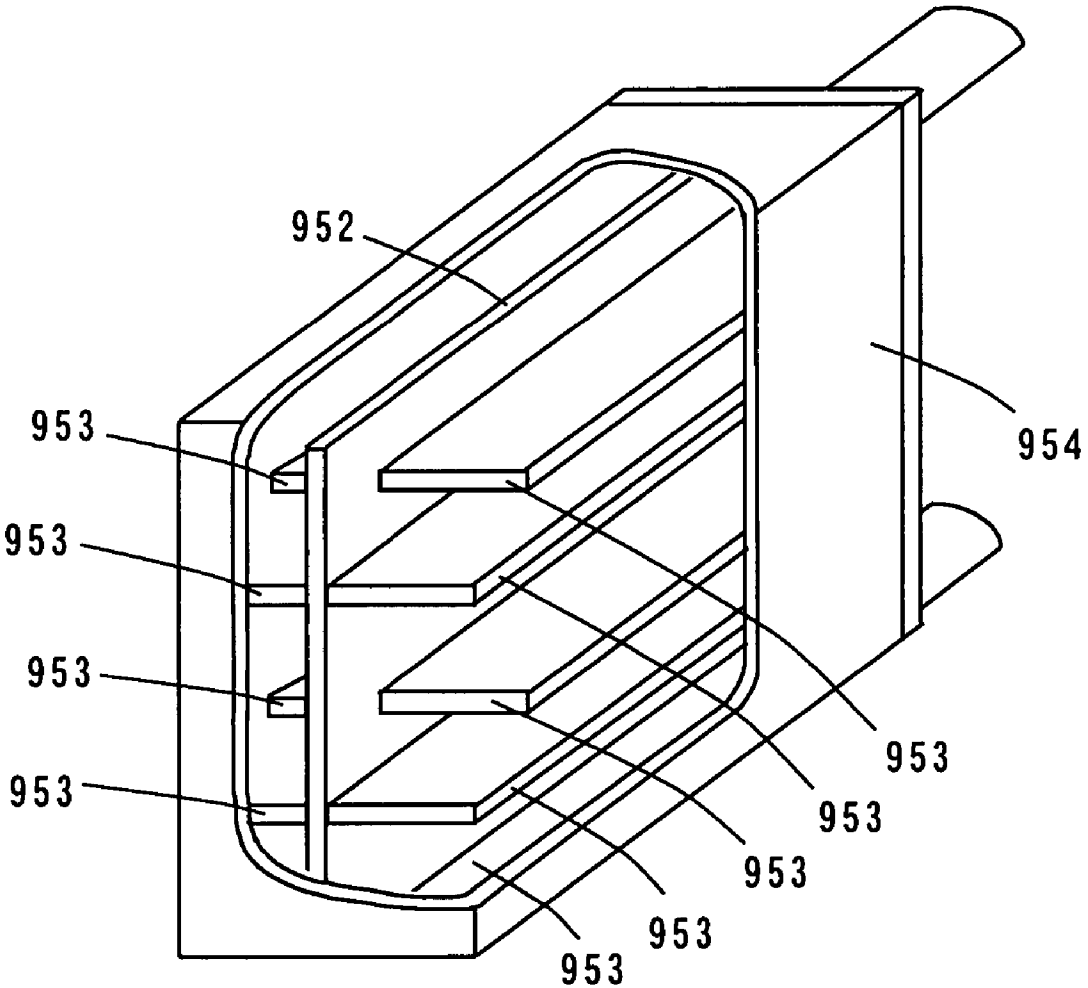
FIG. 41 PRIOR ART
FIG. 41 is a perspective view showing an example of a conventional ceramic heater.
Figure 42:
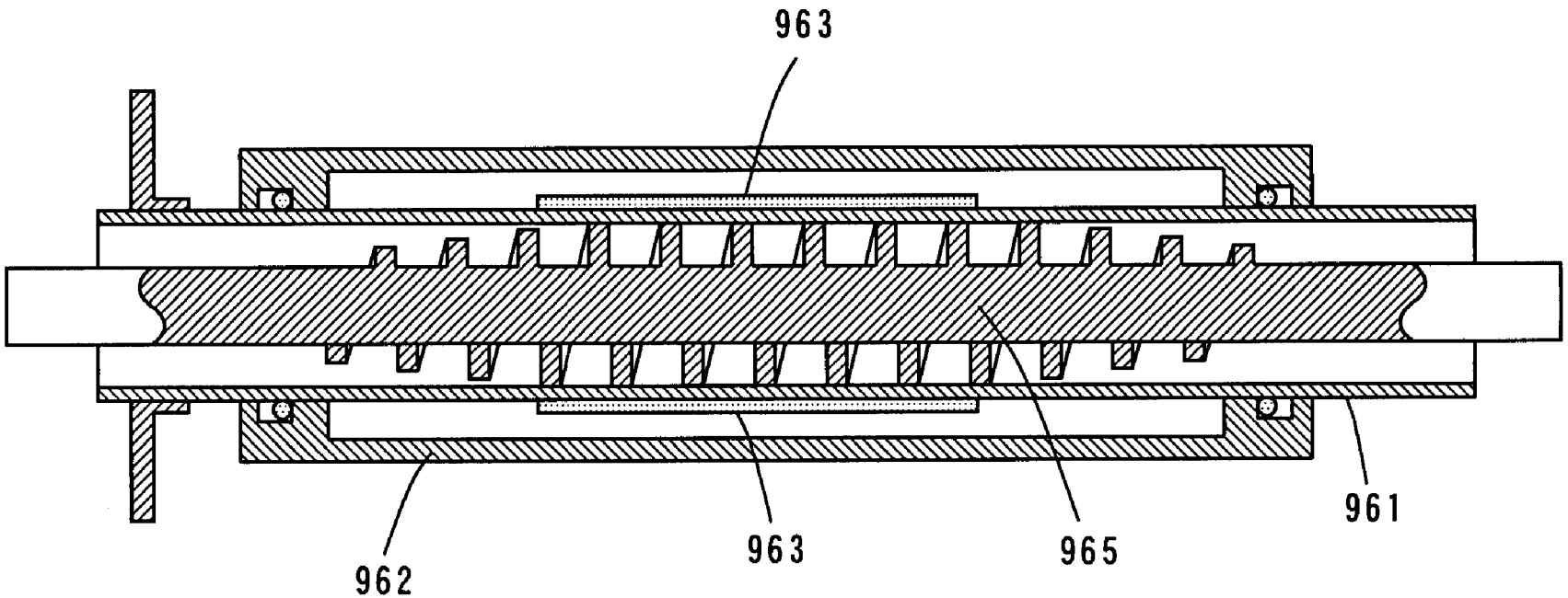
FIG. 42 PRIOR ART
FIG. 42 is a schematic sectional view of a conventional heating device.
Figure 43:
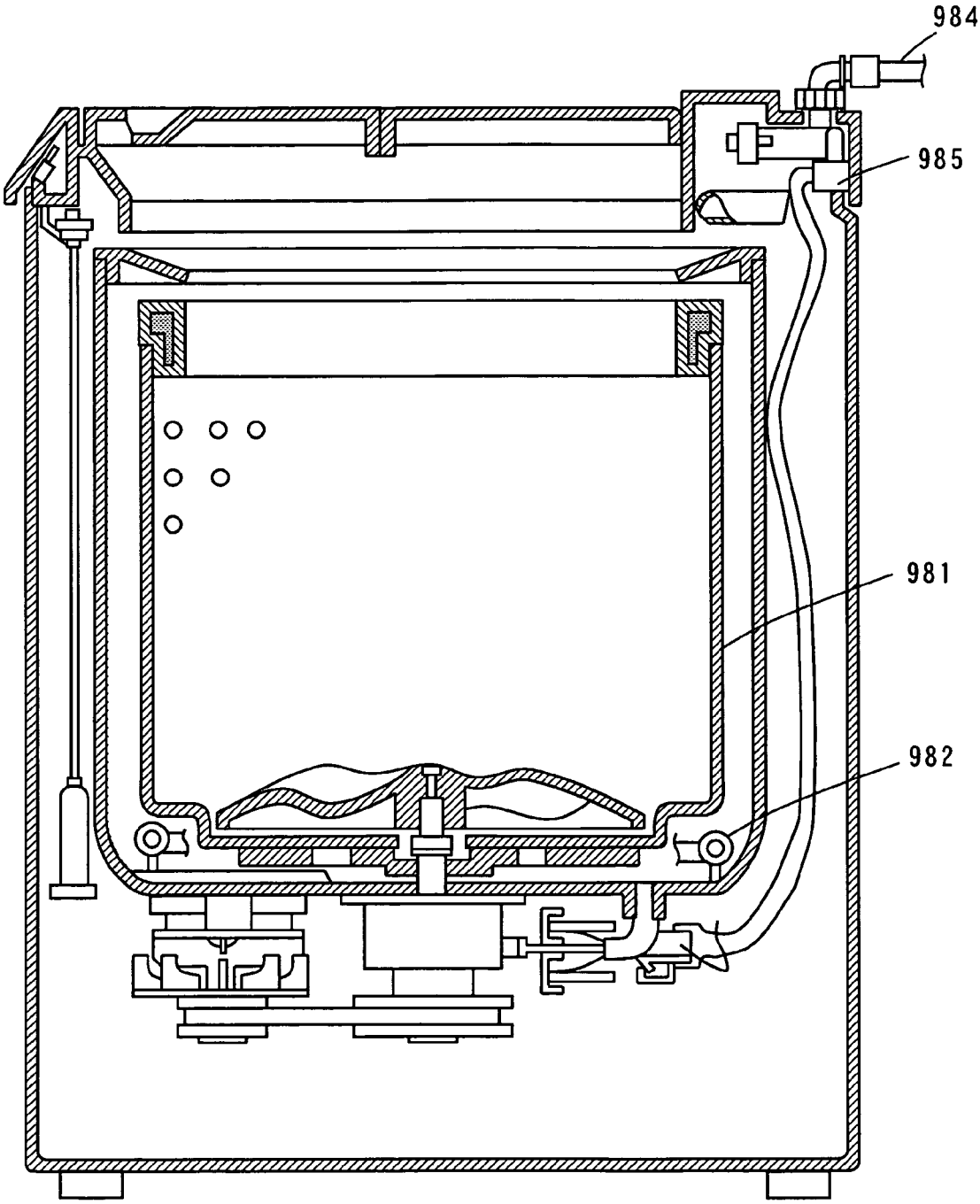
FIG. 43 PRIOR ART
FIG. 43 is a schematic sectional view of a conventional clothes washing apparatus.

Then, FIG. 38 is a schematic sectional view showing another example of the fluid heating device used for the clothes washing apparatus 800. A fluid heating device 11*q* shown in FIG. 38 is a heating device using a ceramic heater.

The fluid heating device 11*q* shown in FIG. 38 mainly comprises a cylindrical ceramic heater 837, a pair of electrode terminals 842, a spring 844, a trap plug 843, a water inlet port 840, and a discharge port 841. The spring 844 is spirally wound around an outer peripheral surface of the cylindrical ceramic heater 837, similarly to the outer peripheral surface of the sheathed heater 505 shown in FIG. 4.

First, washing water is supplied from the water inlet port 840. In this case, predetermined power is supplied to the pair of electrode terminals 842 from the controller 825. Thus, the cylindrical ceramic heater 837 is heated. The washing water supplied from the water inlet port 840 is heated while flowing downward along the inner side of the cylindrical ceramic heater 837, and is heated while flowing upward along the outer side of the ceramic heater 837 from below the fluid heating device 11*a*.

In a case where washing water flows upward along an outer peripheral surface of the ceramic heater 837 from below the fluid heating device 11*a*, heat generated by the ceramic heater 837 is efficiently supplied to the washing water by the spiral flow path 510 formed of the spring 844. The heated washing water is discharged from the discharge port 841.

The upper limit of power that can energize the clothes washing apparatus 800 for domestic use is generally 1500 W from a limit by breaker in a distribution panel. Considering power used for the motor 811 contained in the clothes washing apparatus 800, therefore, power usable for the fluid heating device 11*a* is limited. In the clothes washing apparatus 800 in the sixth embodiment, therefore, the controller 825 distributes power such that an added value of the powers used for the fluid heating device 11*a* and the motor 811 reaches its maximum within a range that does not exceed a predetermined value (e.g., 1300 W).

Specifically, in a case where the motor 811 is not rotated in storing tapped water in the washing tub 810, when power to be supplied to the fluid heating device 11*a* is set to the maximum value (e.g., 1300 W) to rotate the motor 811, for example, when the temperature of washing water is low during washing, power found by subtracting the power used for the motor 811 from a predetermined value is set as power to be supplied to the fluid heating device 11*a*.

The controller 825 controls the flow rate of the pump 824 such that the water temperature detected by a thermostat (not shown) provided on the downstream side of the fluid heating device 11*a* reaches a temperature suitable for washing by a suitable temperature control function.

The controller 825 carries out control so as to reduce the power to be supplied to the fluid heating device 11*a* in a case where hot water whose temperature is higher than a set temperature is run even if the flow rate of the pump 824 is controlled.

When the water temperature is 5° C., a detergent is not easily dissolved in the washing water. In the present embodiment, however, washing water supplied from the water supply port 813 through the bypath path 815 and the water suction path 822 is heated by the fluid heating device 11*a*, so that the detergent put into the detergent inlet port 820 can be easily dissolved in the washing water.

By using washing water having a detergent dissolved therein, the detergent penetrates objects to be washed (clothes), for example, and washing can be done without damaging fabric of the clothes. Further, the washing water is instantaneously heated, whereby the washing water need not be uselessly heated, so that it is possible to realize lower cost and reduction of power consumption.

Washing water flows on the outer peripheral surface of the sheathed heater 505 by using the fluid heating device 11*a*. Therefore, all heat radiated from the sheathed heater 505 can be supplied to the washing water. Consequently, the heat from the sheathed heater 505 can be efficiently supplied to the washing water. As a result, it is possible to realize the clothes washing apparatus 800 using the fluid heating device 11*a* that can be miniaturized and has high heat exchange efficiency.

Washing water heated in addition to dissolving a detergent therein is effective in making it easy to decompose diet or oil on the clothes. Consequently, it is possible to do washing that takes a short time and is high in washing performance.

Furthermore, the washing water heated by the fluid heating device 11*a* is supplied to the washing tub 810, so that the inside of the washing tub 810 can be sterilized by heat to obtain the effect of bacteria killing or bacteria elimination. In this case, although the temperature of the washing water heated by the fluid heating device 11*a* may be approximately 60° C., the present invention is limited to a case where a cover of the clothes washing apparatus 800 is closed in order to ensure the safety of a user.

Although description was made of a case where the fluid heating device is applied to the sanitary washing apparatus 800 arranged lengthwise, the present invention is not limited to the same. The fluid heating device is also applied to clothes washing apparatuses of other types. For example, the fluid heating device is applicable to a drum-type clothes washing apparatus longitudinally arranged or obliquely arranged.

Although description was made of a case where the fluid heating device is applied to the sanitary washing apparatus and the clothes washing apparatus in the first to sixth embodiments, the present invention is not limited to the same. The fluid heating device is also applicable to a shower, a dishwasher, and so on.

In the sixth embodiment, the case main body 600 corresponds to a case member, the sheathed heater 505 corresponds to a heating element, the flow paths 510, 522, 523, 524, 527, 528, 529, 530, and 531 correspond to a flow path, the springs 515*a* to 515*e* correspond to a spiral spring, a turbulent flow generation mechanism, and a spiral member, the washing water inlet 511 corresponds to a fluid inlet and a cylindrical fluid inlet, the washing water outlet 512 corresponds to a fluid outlet and a cylindrical fluid outlet, the thermistor 518 corresponds to a temperature detector, the controller 4 corresponds to a control device, the heat sensitive plate P8 corresponds to a heat sensitive plate, the heat transfer plate P10 corresponds to a thermal transfer member, the triac element 523 corresponds to a heat generating electronic component, and the pump 824 corresponds to a supply device.

The invention claimed is:

1. A fluid heating device, comprising:

a case; and a heating element accommodated in the case, wherein a flow path is defined between an outer surface of the heating element and an inner surface of the case, wherein the fluid heating device further comprises a turbulent flow generation mechanism having a part which is configured to slide and vibrate such that a turbulent flow is generated in at least a part of the flow path.

2. The fluid heating device according to claim 1, wherein the turbulent flow generation mechanism is provided in a portion of the flow path where the speed of a fluid circulated in the flow path is reduced.

3. The fluid heating device according to claim 1, wherein the turbulent flow generation mechanism is provided at a downstream side of the flow path.

4. The fluid heating device according to claim 1, wherein the turbulent flow generation mechanism is intermittently provided in the flow path.

5. The fluid heating device according to claim 1, wherein the turbulent flow generation mechanism is provided at an upstream side of the flow path.

6. The fluid heating device according to claim 1, wherein the heating element comprises a stick shape having a circular or an elliptical cross section.

7. The fluid heating device according to claim 6, wherein the turbulent flow generation mechanism comprises a spiral member wound around an outer peripheral surface of the heating element.

8. The fluid heating device according to claim 7, wherein the spiral member is composed of a spiral spring.

9. The fluid heating device according to claim 7, wherein the case comprises a cylindrical fluid inlet and a cylindrical fluid outlet that are provided parallel to the direction in which the spiral member is wound.

10. The fluid heating device according to claim 6, wherein the case comprises a fluid inlet and a fluid outlet, and wherein at least one of the fluid inlet and the fluid outlet is provided at a position eccentric from the center axis of the heating element such that a fluid flows in a direction along an outer peripheral surface of the heating element or flows out in the direction along the outer peripheral surface of the heating element.

11. The fluid heating device according to claim 1, wherein the heating element has a maximum calorific value in a range of approximately 1.5 kW to approximately 2.5 kW.

12. The fluid heating device according to claim 1, wherein the heating element is configured so that the maximum gradient of the temperature rise speed of a fluid is not less than approximately 10 K per second.

13. The fluid heating device according to claim 1, wherein the heating element comprises a sheathed heater.

14. The fluid heating device according to claim 13, wherein the sheathed heater has a maximum watt density in a range of approximately 30 $W/cm^2$ to approximately 50 $W/cm^2$.

15. The fluid heating device according to claim 1, wherein the heating element comprises a ceramic heater.

16. The fluid heating device according to claim 1, further comprising:

a temperature detector that detects the temperature of the heating element; and a controller that controls the supply of power to the heating element based on the temperature detected by the temperature detector.

17. The fluid heating device according to claim 16, further comprising:

a heat sensitive plate comprising a portion configured to come into contact with the heating element and to project toward an outside of the case, wherein the temperature detector is provided outside the case and is configured to detect the temperature of the heating element through the heat sensitive plate.

18. The fluid heating device according to claim 17, wherein the heating element comprises a heating portion and a non-heating portion, and the heat sensitive plate is configured to come into contact with the non-heating portion of the heating element.

19. The fluid heating device according to claim 17, wherein the case comprises a fluid inlet and a fluid outlet, and the heat sensitive plate is configured so as to come into contact with the heating element in a vicinity of the fluid outlet.

20. The fluid heating device according to claim 17, wherein the heat sensitive plate is joined onto the heating element.

21. The fluid heating device according to claim 17, wherein the heat sensitive plate is brazed to the heating element.

22. The fluid heating device according to claim 17, wherein the heat sensitive plate comprises a leakage preventing function configured to prevent leakage of a fluid within the case.

23. The fluid heating device according to claim 17, wherein the heat sensitive plate is composed of a metal.

24. The fluid heating device according to claim 17, wherein the heat sensitive plate is composed of a copper plate.

25. The fluid heating device according to claim 17, wherein the heat sensitive plate is formed having a substantially L shape.

26. The fluid heating device according to claim 1, further comprising:

a heat transfer member comprising a portion configured to come into contact with a fluid in the flow path and to project toward the outside of the case, and a heat generating electronic component provided in a portion of the heat transfer member projecting toward an outside of the case configured to supply power to the heating element.

27. The fluid heating device according to claim 26, wherein the case comprises a fluid inlet and a fluid outlet, and the heat transfer member is configured to come into contact with the fluid in the vicinity of the fluid inlet.

28. The fluid heating device according to claim 26, wherein the heat transfer member performs a leakage preventing function configured to prevent leakage of a fluid within the case.

29. The fluid heating device according to claim 26, wherein the heat transfer member is composed of a metal.

30. The fluid heating device according to claim 26, wherein the heat transfer member is composed of a copper plate.

31. The fluid heating device according to claim 26, wherein the heat transfer member is formed having a substantially L shape.

32. The fluid heating device according to claim 1, wherein the turbulent flow generation mechanism has a free end and a fixed end, and wherein the fixed end is connected to the heating element.

33. A fluid heating device, comprising:

a case; and a heating element accommodated in the case, wherein a flow path is defined between an outer surface of the heating element and an inner surface of the case, wherein the fluid heating device further comprises a turbulent flow generation mechanism that generates turbulent flow in at least a part of the flow path, wherein the case comprises a plurality of case parts, the heating element comprises a plurality of heating element parts respectively accommodated in the plurality of case member parts, a flow path defined between an inner surface of each of the case parts and an outer surface of each of the heating element parts, and wherein the turbulent flow generation mechanism further comprises a plurality of turbulent flow generation mechanism parts configured to slide and vibrate such that a turbulent flow is generated in at least a part of each of the plurality of flow paths.

34. The fluid heating device according to claim 33, wherein each of the plurality of case parts comprises a fluid inlet and a fluid outlet, and the fluid outlet of one of the case parts is configured to be fitted in the fluid inlet of another case part.

35. The fluid heating device according to claim 33, wherein each of the plurality of case parts comprises a fluid inlet and a fluid outlet, the fluid heating device further comprising:

a connector configured to connect the fluid outlet of one of the case parts to the fluid inlet of another of the case part.

36. The fluid heating device according to claim 33, wherein the plurality of case parts have the same shape.

37. The fluid heating device according to claim 33, wherein the turbulent flow generation mechanism has a free end and a fixed end, and wherein the fixed end is connected to the heating element.

38. A washing apparatus that sprays a fluid supplied from a water supply source to a portion to be washed of the human body, comprising:

a fluid heating device that heats the fluid supplied from the water supply source while causing the fluid to flow; and a sprayer that sprays the fluid heated by the fluid heating device to the human body, the fluid heating device comprising:

a case, and a heating element accommodated in the case, a flow path defined between an outer surface of the heating element and an inner surface of the case, wherein the fluid heating device further comprises a turbulent flow generation mechanism comprising a part that is configured to slide and vibrate such that a turbulent flow is generated in at least a part of the flow path.

39. The fluid heating device according to claim 38, wherein the turbulent flow generation mechanism has a free end and a fixed end, and wherein the fixed end is connected to the heating element.

40. A washing apparatus that washes clothes using a fluid supplied from a water supply source, comprising:

a washing tub;

a fluid heating device that heats the fluid supplied from the water supply source while causing the fluid to flow; and a supplier that supplies the fluid heated by the fluid heating device to the washing tub, the fluid heating device comprising:

a case, and a heating element accommodated in the case, a flow path defined between an outer surface of the heating element and an inner surface of the case, wherein the fluid heating device further comprises a turbulent flow generation mechanism comprising a part that is configured to slide and vibrate such that a turbulent flow is generated in at least a part of the flow path.

41. The fluid heating device according to claim 40, wherein the turbulent flow generation mechanism has a free end and a fixed end, and wherein the fixed end is connected to the heating element.

* * * * *